US012331261B2

(12) United States Patent
Waynick et al.

(10) Patent No.: US 12,331,261 B2
(45) Date of Patent: Jun. 17, 2025

(54) COMPOSITION AND METHOD OF MANUFACTURING SULFONATE-BASED GREASES USING A GLYCEROL DERIVATIVE

(71) Applicant: NCH Corporation, Irving, TX (US)

(72) Inventors: J. Andrew Waynick, Lantana, TX (US); Gaston Aguilar, Farmers Branch, TX (US)

(73) Assignee: NCH Corporation, Irving, TX (US)

( * ) Notice: Subject to any disclaimer, the term of this patent is extended or adjusted under 35 U.S.C. 154(b) by 0 days.

(21) Appl. No.: 16/681,232

(22) Filed: Nov. 12, 2019

(65) Prior Publication Data

US 2020/0157459 A1 May 21, 2020

Related U.S. Application Data

(60) Provisional application No. 62/769,704, filed on Nov. 20, 2018.

(51) Int. Cl.
*C10M 169/02* (2006.01)
*C10M 105/38* (2006.01)
(Continued)

(52) U.S. Cl.
CPC ..... *C10M 169/02* (2013.01); *C10M 105/38* (2013.01); *C10M 125/10* (2013.01);
(Continued)

(58) Field of Classification Search
CPC ..... C10M 169/02; C10M 135/10; C10M 125/24; C10M 125/26; C10M 125/10;
(Continued)

(56) References Cited

U.S. PATENT DOCUMENTS 2,270,577 A 1/1942 Bergstrom
2,402,325 A 6/1946 Griesinger
(Continued)

FOREIGN PATENT DOCUMENTS

CN 101153239 4/2008
CN 101993767 3/2011
(Continued)

OTHER PUBLICATIONS

Boner, C.J., Manufacture and Application of Lubricating Greases, Hafner Publishing Company, Inc., 1954, p. 357, 369.
(Continued)

*Primary Examiner* — Taiwo Oladapo
(74) *Attorney, Agent, or Firm* — Scheef & Stone, LLP; Robin L. Barnes

(57) ABSTRACT

A sulfonate-based grease composition and method of manufacture comprising the addition of one or more glycerol derivatives. The glycerol derivative acts to optimally disperse the thickener in the grease such that the conventional step of milling the grease may not be needed. The glycerol derivative reacts with water to form in-situ complexing acids, which may replace at least some of the normally used complexing acids for reacting with calcium containing bases. The greases according to preferred embodiments have a high dropping point, improved thickener yield, and faster conversion time.

43 Claims, 8 Drawing Sheets

(51) Int. Cl.

| | |
|---|---|
| ***C10M 125/10*** | (2006.01) |
| ***C10M 125/24*** | (2006.01) |
| ***C10M 125/26*** | (2006.01) |
| ***C10M 129/32*** | (2006.01) |
| ***C10M 129/44*** | (2006.01) |
| ***C10M 135/10*** | (2006.01) |
| ***C10M 141/02*** | (2006.01) |
| *C10N 50/10* | (2006.01) |

(52) U.S. Cl.
CPC ..... *C10M 125/24* (2013.01); *C10M 125/26* (2013.01); *C10M 129/32* (2013.01); *C10M 129/44* (2013.01); *C10M 135/10* (2013.01); *C10M 141/02* (2013.01); *C10M 2201/062* (2013.01); *C10M 2201/08* (2013.01); *C10M 2201/085* (2013.01); *C10M 2201/087* (2013.01); *C10M 2207/122* (2013.01); *C10M 2207/128* (2013.01); *C10M 2207/2835* (2013.01); *C10M 2219/0466* (2013.01); *C10N 2050/10* (2013.01)

(58) Field of Classification Search
CPC ..... C10M 129/44; C10M 129/32; C10M 141/02; C10M 105/38; C10M 2207/2835; C10M 2219/0466; C10M 2207/128; C10M 2207/122; C10M 2201/08; C10M 2201/085; C10M 2201/087; C10M 2201/062; C10M 141/08; C10M 2207/12; C10M 2207/289; C10N 2050/10; C10N 2010/04; C10N 2030/52
See application file for complete search history.

(56) References Cited

U.S. PATENT DOCUMENTS

| | | | |
|---|---|---|---|
| 2,418,894 | A | 4/1947 | McNab |
| 2,444,970 | A | 7/1948 | Zimmer |
| 2,485,861 | A | 10/1949 | Campbell |
| 2,501,731 | A | 3/1950 | Mertes |
| 2,535,101 | A | 12/1950 | Sproule |
| 2,540,533 | A | 2/1951 | Kolfenbach |
| 2,585,520 | A | 2/1952 | Ess |
| 2,616,904 | A | 11/1952 | Asseff |
| 2,616,905 | A | 11/1952 | Asseff |
| 2,616,906 | A | 11/1952 | Asseff |
| 2,616,911 | A | 11/1952 | Asseff |
| 2,616,924 | A | 11/1952 | Asseff |
| 2,616,925 | A | 11/1952 | Asseff |
| 2,617,049 | A | 11/1952 | Asseff |
| 2,695,910 | A | 11/1954 | Asseff |
| 2,723,235 | A | 11/1955 | Asseff |
| 2,839,470 | A | 6/1958 | Warren |
| 2,861,951 | A | 11/1958 | Carlyle |
| 2,865,956 | A | 12/1958 | Ellis |
| 2,898,296 | A | 8/1959 | Pattenden et al. |
| 2,920,105 | A | 1/1960 | Kluge |
| 2,937,991 | A | 5/1960 | Carlyle |
| 2,940,930 | A | 6/1960 | Pattenden et al. |
| 2,956,018 | A | 10/1960 | Carlyle |
| 2,967,151 | A | 1/1961 | Morway |
| 2,977,301 | A | 3/1961 | Bergen |
| 2,978,410 | A | 4/1961 | Fullerton |
| 3,027,325 | A | 3/1962 | McMillen |
| 3,057,896 | A | 10/1962 | Schlicht et al. |
| 3,150,088 | A | 9/1964 | Hunt et al. |
| 3,186,944 | A | 6/1965 | Dreher |
| 3,242,079 | A | 3/1966 | McMillen |
| 3,372,114 | A | 3/1968 | Rense |
| 3,372,115 | A | 3/1968 | McMillen |
| 3,376,222 | A | 4/1968 | McMillen |
| 3,377,283 | A | 4/1968 | McMillen |
| 3,492,231 | A | 1/1970 | McMillen |
| 3,537,996 | A | 11/1970 | Holst |
| 3,629,109 | A | 12/1971 | Karn et al. |
| 3,655,558 | A | 4/1972 | Geyer et al. |
| 3,661,622 | A | 5/1972 | Rogers |
| 3,671,012 | A | 6/1972 | Scott |
| 3,679,584 | A | 7/1972 | Hellmuth |
| 3,681,242 | A | 8/1972 | Gilani et al. |
| 3,746,643 | A | 7/1973 | Rogers |
| 3,758,407 | A | 9/1973 | Harting |
| 3,791,973 | A | 2/1974 | Gilani et al. |
| 3,816,310 | A | 6/1974 | Hunt |
| 3,850,823 | A | 11/1974 | Kjonaas |
| 3,907,691 | A | 9/1975 | King et al. |
| 3,929,650 | A | 12/1975 | King et al. |
| 3,940,339 | A | 2/1976 | Clarke, Jr. et al. |
| 4,129,589 | A | 12/1978 | Eliades et al. |
| 4,297,227 | A | 10/1981 | Witte et al. |
| 4,376,060 | A | 3/1983 | Stadler |
| 4,435,299 | A | 3/1984 | Carley et al. |
| 4,444,669 | A | 4/1984 | Wittse, Jr. et al. |
| 4,483,775 | A | 11/1984 | Yamaguchi |
| 4,560,489 | A | 12/1985 | Muir |
| 4,597,880 | A | 7/1986 | Eliades |
| 4,728,578 | A | 3/1988 | Higgins et al. |
| 4,744,920 | A | 5/1988 | Fischer et al. |
| 4,780,224 | A | 10/1988 | Jao |
| 4,787,992 | A | 11/1988 | Waynick |
| 4,810,396 | A | 3/1989 | Jao et al. |
| 4,810,398 | A | 3/1989 | Van Kruchten et al. |
| 4,824,584 | A | 4/1989 | Muir |
| 4,830,767 | A | 5/1989 | Waynick |
| 4,902,435 | A | 2/1990 | Waynick |
| 4,904,399 | A | 2/1990 | Waynick |
| 4,929,371 | A | 5/1990 | Waynick |
| 5,084,193 | A | 1/1992 | Waynick |
| 5,126,062 | A | 6/1992 | Barnes |
| 5,190,678 | A | 3/1993 | Swartz |
| 5,308,514 | A | 5/1994 | Olson |
| 5,338,467 | A | 8/1994 | Olson et al. |
| 5,484,542 | A | 1/1996 | Cahoon et al. |
| 5,885,942 | A * | 3/1999 | Zhang ..... C10M 129/74 508/184 |
| 6,172,122 | B1 | 1/2001 | Lawate et al. |
| 6,239,083 | B1 | 5/2001 | Muir |
| 6,432,889 | B1 | 8/2002 | Kinoshita et al. |
| 6,534,450 | B1 | 3/2003 | Harrison et al. |
| 6,596,672 | B1 | 7/2003 | Carrick et al. |
| 6,869,111 | B2 | 3/2005 | Goto et al. |
| 6,875,731 | B1 | 4/2005 | Bence |
| 7,241,723 | B2 | 7/2007 | Zhang |
| 7,294,608 | B2 | 11/2007 | Oldiges |
| 7,517,837 | B2 | 4/2009 | Kurosky et al. |
| 9,273,265 | B2 | 3/2016 | Waynick |
| 9,458,406 | B2 | 10/2016 | Waynick |
| 9,976,101 | B2 | 5/2018 | Waynick |
| 9,976,102 | B2 | 5/2018 | Waynick |
| 10,087,387 | B2 | 10/2018 | Waynick |
| 10,087,388 | B2 | 10/2018 | Waynick et al. |
| 10,087,391 | B2 | 10/2018 | Waynick |
| 2003/0111838 | A1 | 6/2003 | Goto et al. |
| 2003/0134756 | A1 | 7/2003 | Carrick et al. |
| 2004/0214732 | A1 | 10/2004 | Oldiges et al. |
| 2004/0235679 | A1 | 11/2004 | Kurosky et al. |
| 2005/0054541 | A1 | 3/2005 | Zhang et al. |
| 2005/0215442 | A1 | 9/2005 | Sivik et al. |
| 2006/0025317 | A1 | 2/2006 | Olson et al. |
| 2006/0223719 | A1 | 10/2006 | Riff et al. |
| 2007/0060485 | A1 | 3/2007 | Waynick |
| 2009/0305920 | A1 | 12/2009 | Kato et al. |
| 2011/0021391 | A1 | 1/2011 | E et al. |
| 2011/0048809 | A1 | 3/2011 | Duckworth |
| 2011/0092404 | A1 | 4/2011 | Zhang et al. |
| 2011/0136709 | A1 | 6/2011 | Tanaka et al. |
| 2011/0160105 | A1 | 6/2011 | Tanaka et al. |
| 2011/0190177 | A1 | 8/2011 | Zaki |
| 2011/0195880 | A1 | 8/2011 | Kawamura et al. |
| 2011/0233473 | A1 | 9/2011 | Fletcher |
| 2012/0165235 | A1 | 6/2012 | Li et al. |
| 2013/0109602 | A1 | 5/2013 | Waynick |

(56) References Cited

U.S. PATENT DOCUMENTS

| | | | | |
|---|---|---|---|---|
| 2014/0121139 | A1 | 5/2014 | Waynick | |
| 2015/0191674 | A1* | 7/2015 | Goto | C10M 169/04 285/94 |
| 2016/0040093 | A1* | 2/2016 | Bertin | C10M 169/02 508/488 |
| 2016/0115416 | A1 | 4/2016 | Waynick | |
| 2016/0230112 | A1* | 8/2016 | Waynick | C10M 121/04 |
| 2017/0335229 | A1* | 11/2017 | Waynick | C10M 121/04 |
| 2019/0144776 | A1* | 5/2019 | Famg | C10M 169/00 508/563 |
| 2020/0157459 | A1 | 5/2020 | Waynick et al. | |

FOREIGN PATENT DOCUMENTS

| | | |
|---|---|---|
| CN | 102051257 | 5/2011 |
| CN | 102167991 | 8/2011 |
| CN | 102634400 | 8/2012 |
| CN | 104010972 | 8/2014 |
| CN | 104024162 | 9/2014 |
| CN | 104327906 | 2/2015 |
| CN | 104449959 | 3/2015 |
| CN | 103740435 | 6/2015 |
| CN | 103952215 | 11/2020 |
| GB | 816318 | 7/1959 |
| GB | 1239860 | 7/1971 |
| JP | 2003301190 | 10/2003 |
| JP | 2004346120 | 12/2004 |
| JP | 2007084620 | 4/2007 |
| JP | 2009286950 | 12/2009 |
| JP | 2009292918 | 12/2009 |
| JP | 2009298890 | 12/2009 |
| JP | 2016160356 | 9/2016 |
| WO | WO2011098616 | 8/2011 |
| WO | WO2013066952 | 5/2013 |
| WO | WO2013066955 | 5/2013 |
| WO | WO2015071331 | 5/2015 |

OTHER PUBLICATIONS

Bondi et al., Developments in the field of Soda Base Greases, Third World Petroleum Congress, The Hague, 1951, p. 373-395.

Smith, Gerould, The Phase Behavior of Soaps in Organic Solvents and its Relation to Lubricating Greases, The Journal of the American Oil Chemists' Society, Nov. 1947, p. 353-359.

Bradley-Shaw et al., Self-assembly and friction of glycerol monooleate and its hydrolysis products in bulk and confined non-aqueous solvents, Royal Society of Chemistry, Phys. Chem. Chem. Phys., 2018, 20, 17648-17657.

Kobylyanskli, E.V., Structure of Ultrabasic Sulfonate Greases, Chem. And Tech. of Fuels and Oils, 2002, 38(2), p. 110-114.

* cited by examiner

COMPOSITION AND METHOD OF MANUFACTURING SULFONATE-BASED GREASES USING A GLYCEROL DERIVATIVE

CROSS-REFERENCE TO RELATED APPLICATION

This application claims the benefit of U.S. provisional patent application No. 62/769,704 filed Nov. 20, 2018.

BACKGROUND OF THE INVENTION

1. Field of the Invention

This invention relates to overbased calcium sulfonate greases and overbased calcium magnesium sulfonate greases made by adding a glycerol derivative to improve thickener yield, increase dropping point, reduce conversion time, and/or to achieve a final grease that does not require milling.

2. Description of Related Art

Overbased calcium sulfonate greases have been an established grease category for many years. One known process for making such greases is a two-step process involving the steps of "promotion" and "conversion." Typically the first step ("promotion") is to react a stoichiometric excess amount of calcium oxide (CaO) or calcium hydroxide ($Ca(OH)_2$) as the base source with an alkyl benzene sulfonic acid, carbon dioxide ($CO_2$), and with other components to produce an oil-soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. For the purposes of this disclosure, the terms "overbased oil-soluble calcium sulfonate" and "oil-soluble overbased calcium sulfonate" and "overbased calcium sulfonate" refer to any overbased calcium sulfonate suitable for making calcium sulfonate greases.

Typically the second step ("conversion") is to add a converting agent or agents, to the product of the promotion step, along with a suitable base oil (such as mineral oil) if needed to keep the initial grease from being too hard, to convert the amorphous calcium carbonate contained in the overbased calcium sulfonate to a very finely divided dispersion of crystalline calcium carbonate (calcite). Prior art converting agents include water and conventional non-aqueous converting agents, such as propylene glycol, isopropyl alcohol, formic acid or acetic acid. When acetic acid or other acids are used as a converting agent, typically water and another conventional non-aqueous converting agent (a third converting agent, such as an alcohol) are also used; alternatively only water (without the third converting agent) is added, but the conversion then typically occurs in a pressurized vessel. The most common conventional non-aqueous converting agents are mono-hydroxy or poly-hydroxy alcohols. Glycols (di-hydroxy alcohols) are one of the most often used of this family of conventional non-aqueous converting agents.

Because an excess of calcium hydroxide or calcium oxide is used to achieve overbasing, a small amount of residual calcium oxide or calcium hydroxide may also be present as part of the oil soluble overbased calcium sulfonate and will be dispersed in the initial grease structure. The extremely finely divided calcium carbonate formed by conversion, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

It is also known in the prior art to combine these two steps, by carefully controlling the reaction, into a single step. In this one-step process, the simple calcium sulfonate grease is prepared by reaction of an appropriate sulfonic acid with either calcium hydroxide or calcium oxide in the presence of carbon dioxide and a system of reagents that simultaneously act as both promoter (creating the amorphous calcium carbonate overbasing by reaction of carbon dioxide with an excess amount of calcium oxide or calcium hydroxide) and converting agents (converting the amorphous calcium carbonate to very finely divided crystalline calcium carbonate). Thus, the grease-like consistency is formed in a single step wherein the overbased, oil-soluble calcium sulfonate (the product of the first step in the two-step process) is never actually formed and isolated as a separate product. This one-step process is disclosed, for example, in U.S. Pat. Nos. 3,661,622; 3,671,012; 3,746,643; and 3,816,310.

Conversion in overbased calcium sulfonate greases is typically determined by FTIR analysis. An FTIR spectrum showing a peak at 862 $cm^{-1}$ indicates the amorphous calcium carbonate contained in the overbased calcium sulfonate that will be converted to dispersed crystalline calcium carbonate. An intermediate peak at 874 $cm^{-1}$ is commonly observed during the conversion process of calcium sulfonate-based greases, at least when the conversion process occurs under open atmospheric pressure conditions. Depending on minor variations in the grease being made, this intermediate peak can be observed within the range of about 872 $cm^{-1}$ to 877 $cm^{-1}$. Complete conversion to the desirable dispersion of crystalline calcium carbonate (calcite) has typically been evidenced in the prior art by the elimination of the original amorphous calcium carbonate peak at 862 $cm^{-1}$ and any intermediate peak formed during the conversion process and the establishment of a new single peak at about 882 $cm^{-1}$.

In addition to simple calcium sulfonate greases, calcium sulfonate complex greases are also known in the prior art. These complex greases are typically produced by adding a strong calcium-containing base, such as calcium hydroxide or calcium oxide, to the simple calcium sulfonate grease produced by either the two-step or one-step process and reacting with up to stoichiometrically equivalent amounts of complexing acids, such as 12-hydroxystearic acid, boric acid, acetic acid (which may also be a converting agent when added pre-conversion), or phosphoric acid. The claimed advantages of the calcium sulfonate complex grease over the simple grease include reduced tackiness, improved pumpability, and improved high temperature utility. Calcium sulfonate complex greases are disclosed, for example, in U.S. Pat. Nos. 4,560,489; 5,126,062; 5,308,514; and 5,338,467. In making a complex calcium sulfonate grease, the complexing acids may be added directly or may be formed in-situ by adding any compound that would be expected to react with water to produce a short chain or long chain carboxylic acid that acts as a complexing acid. For example, as described in the U.S. Pat. No. 9,273,265, which is incorporated herein by reference, acetic anhydride can be added and will react with water to form acetic acid to be used as a complexing acid. Likewise, methyl 12-hydroxystearate can be added and will react with water to form 12-hydroxystearic acid to be used as a complexing acid.

Additionally, it is desirable to have a calcium sulfonate complex grease composition and method of manufacture that results in both improved thickener yield (by requiring a smaller percentage of overbased calcium sulfonate in the final grease) and dropping point. The term "thickener yield" as used herein refers to the concentration of the highly overbased oil-soluble calcium sulfonate required to provide a grease with a specific desired consistency as measured by the standard penetration tests ASTM D217 or D1403 commonly used in lubricating grease manufacturing. The term "dropping point" as used herein refers to the value obtained by using the standard dropping point test ASTM D2265 commonly used in lubricating grease manufacturing. Many of the known prior art compositions and methodologies require an amount of overbased calcium sulfonate of least 36% (by weight of the final grease product) to achieve a suitable grease in the NLGI No. 2 category with a demonstrated dropping point of at least 575 F. The overbased oil-soluble calcium sulfonate is one of the most expensive ingredients in making calcium sulfonate grease. Therefore it is desirable to reduce the amount of this ingredient while still maintaining a desirable level of firmness in the final grease (thereby improving thickener yield).

There are several known compositions and methods that result in improved thickener yield while maintaining a sufficiently high dropping point. For example, in order to achieve a substantial reduction in the amount of overbased calcium sulfonate used, many prior art references utilize a pressure reactor. It is desirable to have an overbased calcium sulfonate grease wherein the percentage of overbased oil-soluble calcium sulfonate is less than 36% and the dropping point is consistently 575 F or higher when the consistency is within an NLGI No. 2 grade (or the worked 60 stroke penetration of the grease is between 265 and 295), without requiring a pressure reactor. Higher dropping points are considered desirable since the dropping point is the first and most easily determined guide as to the high temperature utility limitations of a lubricating grease.

Overbased calcium sulfonate greases requiring less than 36% overbased calcium sulfonate are also achieved using the compositions and methods described in U.S. Pat. Nos. 9,273,265 and 9,458,406. The '265 and '406 patents teach the use of added crystalline calcium carbonate and/or added calcium hydroxyapatite (either with or without added calcium hydroxide or calcium oxide) as calcium-containing bases for reaction with complexing acids in making complex overbased calcium sulfonate greases. Prior to these patents, the known prior art always taught the use of calcium oxide or calcium hydroxide as the sources of basic calcium for production of calcium sulfonate greases or as a required component for reacting with complexing acids to form calcium sulfonate complex greases. The known prior art also taught that the addition of calcium hydroxide or calcium oxide needs to be in an amount sufficient (when added to the amount of calcium hydroxide or calcium oxide present in the overbased oil-soluble calcium sulfonate) to provide a total level of calcium hydroxide or calcium oxide sufficient to fully react with the complexing acids. The known prior art also generally taught that the presence of calcium carbonate (as a separate ingredient or as an "impurity" in the calcium hydroxide or calcium oxide, other than that presence of the amorphous calcium carbonate dispersed in the calcium sulfonate after carbonation), should be avoided for at least two reasons. The first being that calcium carbonate is generally considered to be a weak base, unsuitable for reacting with complexing acids to form optimum grease structures. The second being that the presence of unreacted solid calcium compounds (including calcium carbonate, calcium hydroxide or calcium oxide) interferes with the conversion process, resulting in inferior greases if the unreacted solids are not removed prior to conversion or before conversion is completed. However, as described in the '265 and '406 patents, Applicant has found that the addition of calcium carbonate as a separate ingredient (in addition to the amount of calcium carbonate contained in the overbased calcium sulfonate), calcium hydroxyapatite, or a combination thereof, either with or without added calcium hydroxide or calcium oxide, as ingredients for reacting with complexing acids produces a superior grease.

In addition to the '265 and '406 patents, there are a couple of prior art references that disclose the addition of crystalline calcium carbonate as a separate ingredient (in addition to the amount of calcium carbonate contained in the overbased calcium sulfonate), but those greases have poor thickener yield (as the prior art teaches) or require nano-sized particles of calcium carbonate. For example, U.S. Pat. No. 5,126,062 discloses the addition of 5-15% calcium carbonate as a separate ingredient in forming a complex grease, but also requires the addition of calcium hydroxide to react with complexing acids. The added calcium carbonate in the '062 patent is not the sole added calcium containing base for reacting with complexing acids as it is in the '265 patent. Additionally, the resulting NLGI No. 2 grease in the '062 patent contains 36%-47.4% overbased calcium sulfonate, which is a substantial amount of this expensive ingredient. In another example, Chinese publication CN101993767, discloses the addition of nano-sized particles of calcium carbonate (sized between 5-300 nm) being added to the overbased calcium sulfonate, although the reference does not indicate that the nano-sized particles of calcium carbonate are added as a reactant, or the sole separately added calcium containing base, for reacting with complexing acids. The use of nano-sized particles would add to the thickening of the grease to keep it firm, much like the fine dispersion of crystalline calcium carbonate formed by converting the amorphous calcium carbonate contained within the overbased calcium sulfonate (which can be around 20 A to 5000 A or around 2 nm to 500 nm according to the '467 patent), but would also substantially increase the costs over larger sized particles of added calcium carbonate. This Chinese patent application greatly emphasizes the absolute necessity of the added calcium carbonate having a true nano particle size. As shown in the example greases according to the invention described in the '265 patent, superior greases may be formed by the addition of micron sized calcium carbonate (preferably 1-20 microns) without requiring the use of the very expensive nano-sized particles when using added calcium carbonate as one of or the sole added calcium containing base for reacting with complexing acids.

There are also prior art references for using tricalcium phosphate as an additive in lubricating greases. For instance, U.S. Pat. Nos. 4,787,992; 4,830,767; 4.902,435; 4,904,399; and 4,929,371 all teach using tricalcium phosphate as an additive for lubricating greases. However, it is believed that prior to the '406 patent, no prior art references taught the use of calcium hydroxyapatite, having the formula $Ca_5(PO_4)_3OH$ or a mathematically equivalent formula with a melting point of around 1100 C (or excluding mixtures of tricalcium phosphate and calcium hydroxide), as a calcium-containing base for reaction with acids to make lubricating greases, including calcium sulfonate-based greases. There are several prior art references assigned to Showa Shell Sekiyu in Japan, including U.S. Patent Application Publication No. 2009/0305920, that describe greases containing tricalcium phosphate, $Ca_3(PO_4)_2$, and reference a "hydroxyapatite" having the formula $[Ca_3(PO_4)_2]_3 \cdot Ca(OH)_2$ as a source of tricalcium phosphate. This reference to "hydroxyapatite" is disclosed as a mixture of tricalcium phosphate and calcium hydroxide, which is not the same as the calcium hydroxyapatite disclosed and claimed in the '406 patent and herein having the formula $Ca_5(PO_4)_3OH$ or a mathematically equivalent formula with a melting point of around 1100 C. Despite the misleading nomenclature, calcium hydroxyapatite, tricalcium phosphate, and calcium hydroxide are each distinct chemical compounds with different chemical formulae, structures, and melting points. When mixed together, the two distinct crystalline compounds tricalcium phosphate ($Ca_3(PO_4)_2$) and calcium hydroxide ($Ca(OH)_2$) will not react with each other or otherwise produce the different crystalline compound calcium hydroxyapatite ($Ca_5(PO_4)_3OH$). The melting point of tricalcium phosphate (having the formula $Ca_3(PO_4)_2$) is 1670 C. Calcium hydroxide does not have a melting point, but instead loses a water molecule to form calcium oxide at 580 C. The calcium oxide thus formed has a melting point of 2580 C. Calcium hydroxyapatite (having the formula $Ca_5(PO_4)_3OH$ or a mathematically equivalent formula) has a melting point of around 1100 C. Therefore, regardless of how inaccurate the nomenclature may be, calcium hydroxyapatite is not the same chemical compound as tricalcium phosphate, and it is not a simple blend of tricalcium phosphate and calcium hydroxide.

In making overbased calcium sulfonate greases, much of the known prior art using the two step method teaches the addition of all converting agents (water and conventional non-aqueous converting agents) at the same time and usually prior to heating. However, U.S. Pat. Nos. 9,976,101 and 9,976,102, which are incorporated herein by reference, disclose a method where there is a delay between the addition of water and the addition of at least part of a conventional non-aqueous converting agent that results in improved thickener yield and dropping point. Prior to the '101 and '102 patents, a few prior art references disclose a time interval (although always poorly defined or not defined at all) between the addition of water and the addition of at least part of the conventional non-aqueous converting agent(s). For example, U.S. Pat. No. 4,560,489 discloses a process (examples 1-3) where base oil and overbased calcium carbonate are heated to around 150° F., then water is added, the mixture is then heated to around 190° F. before adding acetic acid and methyl Cellosolve (a highly toxic monomethylether of ethylene glycol). The resulting grease contains greater than 38% overbased calcium sulfonate and the '489 patent points out that the ideal amount of overbased calcium sulfonate for the processes disclosed therein is around 41-45%, since according to the '489 patent using less than 38% results in a soft grease. The resulting grease of example 1 in the '489 patent has a dropping point of around only 570° F. The '489 patent does not state the duration of delay between the addition of water and the addition of the conventional non-aqueous converting agents, but indicates that the addition was immediate after a period of heating from 150 F to just 190 F. The dropping point and thickener yield in the '489 patent are not desirable.

Additionally. U.S. Pat. Nos. 5,338,467 and 5,308,514 disclose the use of a fatty acid, such as 12-hydroxystearic acid, as a converting agent used along with acetic acid and methanol, where there is no delay for the addition of the fatty acid but some interval between the addition of water and the addition of acetic acid and methanol. Example B in the '514 patent and example 1 in the '467 patent both describe a process where water and the fatty acid converting agent are added to other ingredients (including the overbased calcium sulfonate and base oil), then heated to around 140-145° F. before adding acetic acid followed by methanol. The mixture is then heated to around 150-160° F. until conversion is complete. The amount of overbased calcium sulfonate in the final grease products in both examples is 32.2, which is higher than desirable. These patents do not state the duration of delay between the addition of water and fatty acid and the addition of the acetic acid and methanol, but indicates that the addition was immediate after an unspecified period of heating. Similar processes are disclosed in example A of the '467 patent and example C of the '514 patent except all of the fatty acid was added post conversion, so the only conventional non-aqueous converting agents used were the acetic acid and methanol added after the mixture with water was heated to 140-145 F. The amount of overbased calcium sulfonate in these examples is even higher than the previous examples at 40%. In addition to not achieving ideal thickener yield results, all these processes use methanol as a converting agent, which has environmental drawbacks. The use of volatile alcohols as converting agents may result in venting these ingredients to the atmosphere as a later part of the grease-making process, which is prohibited in many parts of the world. If not vented, the alcohols must be recovered by water scrubbing or water traps, which results in hazardous material disposal costs. As such, there is a need for a process that achieves better thickener yields, preferably without requiring the use of volatile alcohols as converting agents.

Better thickener yields are achieved in example 10 of the '514 patent, but the use of excess lime is taught as a requirement to achieve those results. In that example, water and excess lime are added together with other ingredients, the mixture is heated to 180-190 F while slowly adding acetic acid during the heating period. The resulting grease contained 23% overbased calcium sulfonate. While this thickener yield is better than others, there is still room for greater improvement without requiring the use of excess lime, which the '514 patent teaches as a requirement.

The other examples in '514 and '467 patents where there are thickener yields of 23% or less either involve the use of a pressurized kettle during conversion or are like the much greater part of the other prior art where there is no "delay" between the addition of water and the conventional non-aqueous converting agents or both. These examples involve adding water and a fatty acid converting agent, mixing for 10 minutes without heating, and then adding acetic acid, either in a pressurized kettle or without pressure. Neither of these patents recognizes any benefit or advantage to the 10 minute interval for adding acetic acid, or the other heating delays in the examples discussed above, rather these patents focus the use of a fatty acid as a converting agent and the benefits of adding the fatty acid pre-conversion, post-conversion, or both as the reason for any observed yield improvements. Additionally, as discussed below, this 10 minute mixing interval without any heating is not a "converting agent delay" as that term is used herein, but is considered to be the same as adding the ingredients at the same time, recognizing that adding each ingredient takes at least some time and cannot occur instantaneously.

The addition of alkali metal hydroxides in simple calcium soap greases, such as anhydrous calcium-soap thickened greases, is also known. But prior to the disclosure in U.S. Pat. No. 9,976,102, which is incorporated herein by reference, it was not known to add an alkali metal hydroxide in a calcium sulfonate grease to provide improved thickener yield and high dropping point, because that addition would be considered unnecessary by one of ordinary skill in the art. The reason for adding an alkali metal hydroxide, such as sodium hydroxide, in simple calcium soap greases is that the usually used calcium hydroxide has poor water solubility and is a weaker base than the highly water soluble sodium hydroxide. Because of this, the small amount of sodium hydroxide dissolved in the added water is said to react quickly with the soap forming fatty acid (usually 12-hydroxystearic acid or a mixture of 12-hydroxystearic acid and a non-hydroxylated fatty acid such as oleic acid) to form the sodium soap. This quick reaction is thought to "get the ball rolling." However, the direct reaction of calcium-containing bases such as calcium hydroxide with fatty acids has never been a problem when making calcium sulfonate complex greases. The reaction occurs very easily, likely due to the high detergency/dispersancy of the large amount of calcium sulfonate present. As such, it is not known in the prior art to use an alkali metal hydroxide in a calcium sulfonate grease as a way to get the complexing acids to react with the calcium hydroxide.

Several other improvements in overbased calcium sulfonate greases have been disclosed in recent years. These include the addition of an overbased magnesium sulfonate to an overbased calcium sulfonate grease, including a delayed addition of magnesium sulfonate relative to the addition of water or one or more other reactive ingredients and/or a split addition of magnesium sulfonate, as described in U.S. Pat. No. 10,087,387; the use of a facilitating acid delay period as described in U.S. Pat. No. 10,087,388; and the exclusion of conventional non-aqueous converting agents as described in U.S. Pat. No. 10,087,391. Each of these patents is incorporated herein by reference.

All known prior art sulfonate-based greases require milling, using a mechanical mill, as one of the final steps in making the grease. Typically, before a grease is milled, it is already thickened with a grease-structure and its thickener system is dispersed in a relatively less ordered configuration throughout the continuous phase (base oil and components dissolved in it). Mechanical milling provides increased dispersion and ordered structure to the thickener, resulting in a firmer grease consistency. Most sulfonate-based greases will achieve only a moderate additional thickening effect with milling, but some calcium-magnesium sulfonate greases disclosed in the '387 patent (such as Example 27 in the '387 patent) are extremely fluid prior to milling and only take on a grease-like structure upon milling (or shearing).

It is known in the prior art to add various glycerides (glycerol derivatives), such as various vegetable oils as the fatty acid sources, in making lithium-based greases. Lithium based greases are one type of grease that uses a lithium soap thickening system, which is different from the dispersed calcite thickening system in sulfonate-based greases. In the lithium greases, the reaction of the lithium hydroxide and water hydrolyzes the vegetable oil glyceride structure, thereby forming the corresponding long-chain fatty (carboxylic) acids and glycerol. The fatty acids then react with the lithium hydroxide to form the lithium soap thickener, leaving the glycerol within the final grease. However, modern high dropping point lithium complex greases preferentially use 12-hydroxystearic acid instead of vegetable oils (such as hydrogenated castor oil). When making such lithium complex greases with 12-hydroxystearic acid, the glycerol is never formed and is therefore not included in the final grease. This is the primary difference between making lithium complex greases that use 12-hydroxystearic acid and lithium complex greases that use glycerides (glycerol derivatives). Some lithium grease prior art references, such as U.S. Pat. Nos. 3,681,242, 3,758,407, and 3,791,973, also teach that direct or indirect inclusion of a glycol is not desired in lithium-based greases since such materials can make the final grease more prone to oxidation and reduce its resistance to water. Glycols are commonly used as a conventional non-aqueous converting agent in making a sulfonate-based grease. It is noted that glycols (di-hydroxy alcohols) are not the same as glycerol (a tri-hydroxy alcohol), and glycols are not glycerol derivatives.

Similarly, calcium soap-thickened greases (which are another type of grease with a different thickening system compared to sulfonate-based greases) have also been made using various glycerides (glycerol derivatives), such as various vegetable oils as the fatty acid sources. Most calcium soap-thickened greases today use 12-hydroxystearic acid instead of such vegetable oils since this allows a much narrower range of long chain fatty (carboxylic) acids to be used. Additionally, some research has shown adverse results in using glycerols and glycols in calcium soap greases. For example, Auld, S. J. M., et.al. *Proc. 3rd World Petroleum Congress*, Vol 7, p 355, (1951) demonstrated that the intentional use of glycerol or glycols in calcium soap-thickened greases resulted in unstable grease structures unless water was also present in the final grease. In contrast, water is removed in making sulfonate-based greases. Additionally, Bondi, A., et.al. *Proc. 3rd World Petroleum Congress*, Vol 7, p 355, (1951) and Smith, G. J. *Journal Am. Oil Chem. Soc., Vol.* 24, p 353, (1947) demonstrated that all hydroxylic compounds (which includes glycerol and glycols) increases the oil solubility of soap-thickened systems (decreases thickening power), and lowers the phase transformation temperature (temperature at which the thickener melts), neither of which is beneficial to a lubricating grease.

Although it is known to add a glycerol derivative in making a lithium grease or a calcium soap grease, it has not previously been known to add a glycerol derivative in making a sulfonate-based grease. The adverse behavior due to glycols in lithium greases and due to glycerols and glycols in calcium-soap greases would lead one of ordinary skill in the art away from considering the glycerol ingredients used in lithium greases and in calcium soap greases to improve performance in other greases, like sulfonate-based greases (particularly since sulfonate-based greases commonly use glycols as conventional non-aqueous converting agents). However, Applicant unexpectedly found that glycerol derivatives provide improved thickener yield, higher dropping point, and/or can eliminate the need for milling in sulfonate-based greases.

Moreover, it has not previously been known to combine the addition of a glycerol derivative with one or more of the following in making a sulfonate-based grease: (1) the addition of an overbased magnesium sulfonate; (2) a facilitating acid delay period; (3) a delayed addition of magnesium sulfonate relative to the addition of water or one or more other reactive ingredients; (4) a split addition of magnesium sulfonate; (5) the addition of calcium hydroxyapatite and/or added crystalline calcium carbonate or a combination thereof (with or without added calcium hydroxide or calcium oxide) as calcium containing bases (also referred to as basic calcium compounds) for reaction with complexing acids; (6) the addition of an alkali metal hydroxide; (7) the delayed addition of conventional non-aqueous converting agents; or (8) any combination of these methods and ingredients. It is also not previously known to add a glycerol derivative to a sulfonate-based grease so that milling is not required.

SUMMARY OF THE INVENTION

This invention relates to sulfonate-based greases and methods for manufacturing such greases using an added glycerol derivative to produce a grease (1) having improved thickener yield, (2) having higher dropping point, and/or (3) that does not require milling. As used herein, a calcium sulfonate grease (or overbased calcium sulfonate grease) containing overbased magnesium sulfonate is sometimes referred to as a calcium magnesium sulfonate grease or an overbased calcium magnesium sulfonate grease. As used herein a "sulfonate-based grease" or an "overbased sulfonate-based grease" refers to a calcium sulfonate (or overbased calcium sulfonate) grease and/or a calcium magnesium sulfonate (or overbased calcium magnesium sulfonate) grease.

According to one preferred embodiment, a sulfonate-based grease is made by adding a glycerol derivative prior to conversion, during conversion, after conversion, or a combination thereof. According to another preferred embodiment, a sulfonate-based grease comprises added glycerol derivative and less than 37% overbased calcium sulfonate by weight of the final grease, more preferably less than 30% overbased calcium sulfonate, and most preferably less than 26% overbased calcium sulfonate.

According to another preferred embodiment, the glycerol derivative comprises one or more of hydrogenated castor oil, glyceryl mono-stearate, glyceryl mono-tallowate, and glycerol mono-oleate. According to another preferred embodiment, the glycerol derivative comprises one or more of a mono-acyl glyceride, a di-acyl glyceride, or a tri-acyl glyceride.

When a glycerol derivative is added, it is has been unexpectedly found in that mechanical or physical milling of the grease may not be required to obtain a satisfactory grease structure. Thus, when a glycerol derivative is added the typical step of mechanically milling the grease may be eliminated while still having a smooth, homogenous and sufficiently hardened grease structure. According to another preferred embodiment, a sulfonate-based grease is made with added glycerol derivative and the grease is not milled. According to another preferred embodiment, the unmilled grease has a dropping point of 580 F or higher, more preferably 630 F or higher, and most preferably 650 F or higher.

According to another preferred embodiment, milling is not required when a glycerol derivative is added and (1) a facilitating acid delay method is used or (2) a converting agent delay method is used or (3) both. According to another preferred embodiment, milling is required when a glycerol derivative is added and no facilitating acid delay method is used.

According to another preferred embodiment, the sulfonate-based grease with an added glycerol derivative has a first penetration value in an unmilled state and a second penetration value in a milled state and wherein the first and second penetration values are within 15 points of each other. According to another preferred embodiment, the sulfonate-based grease with an added glycerol derivative has a first penetration value in an unmilled state and a second penetration value in a milled state and wherein the first and second penetration values are in the same NLGI grade range. According to another preferred embodiment, the sulfonate-based grease with an added glycerol derivative has a first penetration value in an unmilled state that is lower than a second penetration value in a milled state.

According to another preferred embodiment, the sulfonate-based grease with an added glycerol derivative has an FTIR spectra having two peaks, one between 872 $cm^{-1}$ to 877 $cm^{-1}$ and the other at around 882 $cm^{-1}$. According to another preferred embodiment, the sulfonate-based grease with an added glycerol derivative has an FTIR spectra having one or more of the following: (1) a doublet where the peak between 872 $cm^{-1}$ and 877 $cm^{-1}$ is the dominant peak; (2) a doublet where the peak at around 882 $cm^{-1}$ is the dominant peak; (3) a non-eliminated shoulder at around 862 $cm^{-1}$, (4) a dominant peak at around 882 $cm^{-1}$ and a shoulder between 872 $cm^{-1}$ and 877 $cm^{-1}$, wherein the height of the shoulder is around 33%-95% of the height of the 882 $cm^{-1}$ peak; or (5) a peak between 872 $cm^{-1}$ and 877 $cm^{-1}$ with a shoulder at around 882 $cm^{-1}$.

According to another preferred embodiment, the added glycerol derivative reacts with water to preferably form a long chain fatty acid, but short chain fatty acids may also be formed, that acts as a complexing acid. A glycerol derivative may be added to replace some or all of the normally used complexing acids in making a sulfonate-based grease.

According to another preferred embodiment, the dropping point of a sulfonate-based grease is improved by the addition of a glycerol derivative compared to the same grease made without a glycerol derivative addition. According to another preferred embodiment, improved thickener yield and sufficiently high dropping points are achieved when a glycerol derivative is added to otherwise conventional, prior art sulfonate-based grease compositions and methods, even when the overbased calcium sulfonate is considered to be of "poor" quality as described and defined in the '406 patent.

According to another embodiment, all water added in making the sulfonate-based grease with added glycerol derivative is removed by heating and not present in the final grease. According to another preferred embodiment a top conversion heating temperature is 260 F. According to another preferred embodiment a top conversion heating temperature is between 190 F and 200 F. According to another preferred embodiment, a conventional non-aqueous converting agent is added immediately upon reaching the 190 F to 200 F temperature range. According to another preferred embodiment, the total time for a converting step in making a sulfonate-based grease with added glycerol derivative is less than 75 minutes, more preferably around 60 minutes or less.

According to still other preferred embodiments, the addition of a glycerol derivative is combined with one or more with one or more of the following: (1) the addition of crystalline calcium carbonate as the sole added calcium containing base (also referred to as basic calcium compound) for reaction with complexing acids; (2) the addition of calcium hydroxyapatite (with or without added calcium carbonate, added calcium hydroxide, and/or calcium oxide) as calcium containing bases for reaction with complexing acids; (3) a converting agent delay period; (4) the addition of an alkali metal hydroxide; (5) the addition of an overbased magnesium sulfonate; (6) a delayed addition of magnesium sulfonate relative to the addition of water or one or more other reactive ingredients; (7) a split addition of magnesium sulfonate; (8) a facilitating acid delay period; and/or (9) the exclusion of any conventional non-aqueous converting agents (which cannot be combined with (3)). These additional methods and ingredients are disclosed in U.S. Pat. Nos. 9,273,265, 9,458,406, 9,976,101, 9,976,102, 10,087,387, 10,087,388, and 10,087,391, which are incorporated herein by reference. For ease of reference, a delay period/method with respect to the addition of a conventional non-aqueous converting agent as described in U.S. Pat. Nos. 9,976,101 and 9,976,102 will be referred to as a converting agent delay period or converting agent delay method (or similar wording); a delay with respect to the addition of overbased magnesium sulfonate as described in U.S. Pat. No. 10,087,387 will be referred to as a magnesium sulfonate delay period or magnesium sulfonate delay method (or similar wording); and a delay with respect to a facilitating acid as described in U.S. Pat. No. 10,087,388 will be referred to as a facilitating acid delay period or facilitating acid delay method (or similar wording).

According to another preferred embodiment, when a glycerol derivative is combined with added calcium carbonate as the sole calcium containing base for reacting with complexing acids, the sulfonate-based grease comprises less than 37% overbased calcium sulfonate, more preferably less than 30% overbased calcium sulfonate, and most preferably less than 25% overbased calcium sulfonate, by weight of the final grease. According to another preferred embodiment, when a glycerol derivative is combined with added calcium carbonate as the sole calcium containing base for reacting with complexing acids, the sulfonate-based grease has a dropping point greater than 540 F, more preferably greater than 580 F and most preferably greater than 650 F. According to another preferred embodiment, when a glycerol derivative is combined with added calcium carbonate as the sole calcium containing base for reacting with complexing acids, the sulfonate-based grease has an unmilled dropping point of 540 F or higher.

According to another preferred embodiment, when a glycerol derivative is combined with calcium hydroxyapatite as one of the calcium containing bases for reacting with complexing acids, the sulfonate-based grease comprises less than 30% overbased calcium sulfonate and more preferably less than 25% overbased calcium sulfonate by weight of the final grease. According to another preferred embodiment, when a glycerol derivative is combined with calcium hydroxyapatite as one of the calcium containing bases for reacting with complexing acids, the sulfonate-based grease has a dropping point greater than 650 F.

BRIEF DESCRIPTION OF THE FIGURES

The composition and method of the invention are further described and explained in relation to the following drawings wherein.

DESCRIPTION OF THE PREFERRED EMBODIMENTS

Sulfonate-Based Grease Compositions

Figure 1:
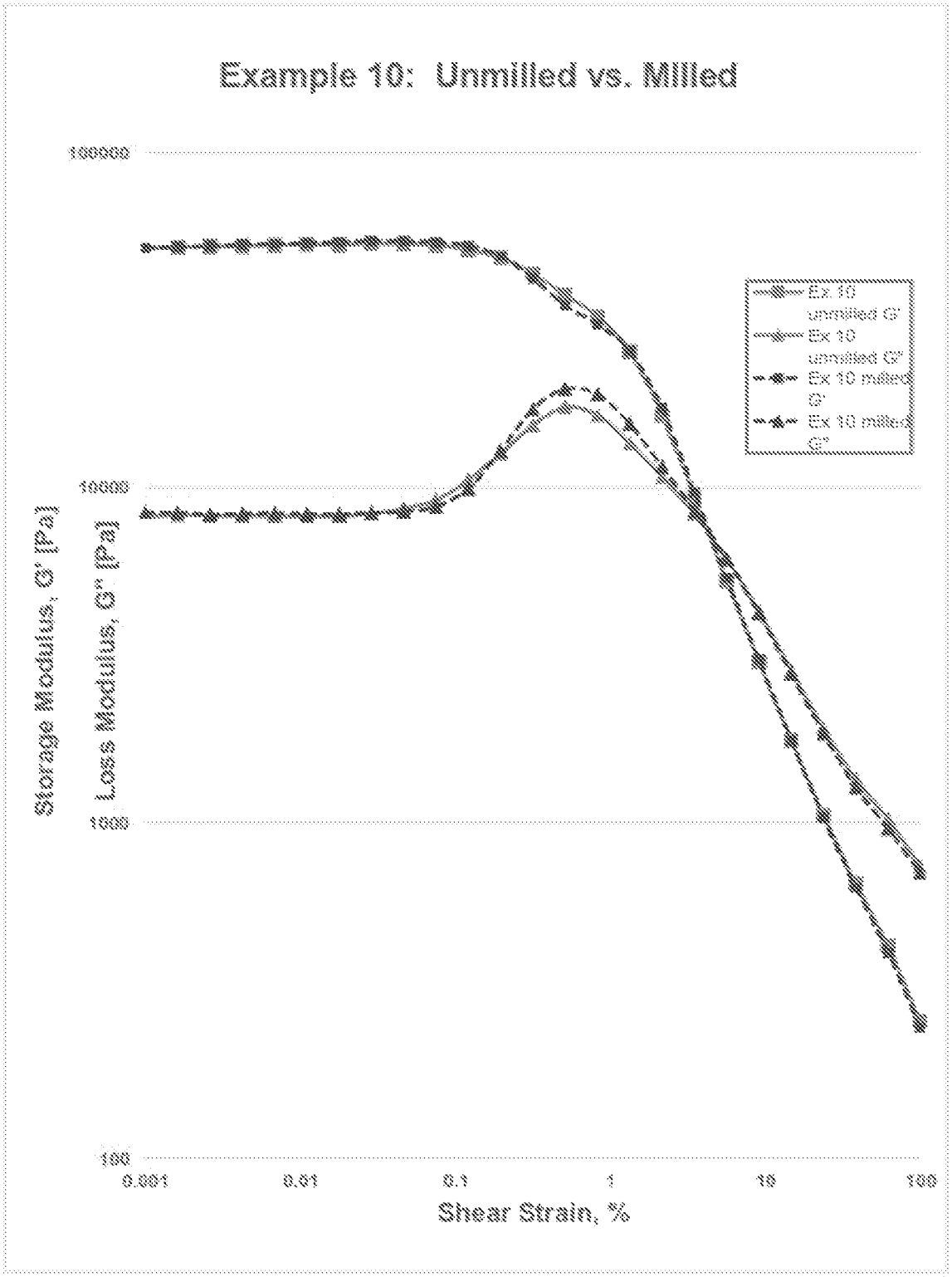
FIG. 1 is a graph showing results of an oscillatory rheometry amplitude sweep at 25 C of the Example 10 unmilled and milled greases.

According to one preferred embodiment of the invention, a simple or complex sulfonate-based grease composition comprises overbased calcium sulfonate, and one or more glycerol derivatives. Most preferably, a sulfonate-based grease also comprises one or more converting agents (preferably water and optionally one or more separately added conventional non-aqueous converting agents, which may not be needed if overbased magnesium sulfonate is one of the ingredients), one or more calcium containing bases, and one or more complexing acids (for a complex grease). Most preferably, a sulfonate-based grease composition also optionally includes overbased magnesium sulfonate, a facilitating acid, and/or base oil.

According to one preferred embodiment, the glycerol derivative aids in creating a smooth grease with well dispersed thickener so that the usual step of milling the grease is not required. According to another preferred embodiment, the glycerol derivative may act as a source of a complexing acid (by forming a complexing acid upon hydrolysis), replacing some or all of the normally used complexing acid in making a complex grease. The glycerol derivative will react with water to form in-situ a complexing acid. The glycerol derivative may be added pre-conversion, during conversion, post-conversion, or a combination thereof. Most preferably, the glycerol derivative is added pre-conversion or a portion added pre-conversion and another portion added during conversion.

According to several preferred embodiments, a calcium sulfonate grease composition or a calcium magnesium sulfonate grease composition, with a conventional non-aqueous converting agent and without a conventional non-aqueous converting agent, comprises the following ingredients by weight percent of the final grease product (although some ingredients, such as water, acids, and calcium containing bases, may not be in the final grease product or may not be in the concentrations indicated for addition):

TABLE 1A

Preferred Compositions when a Conventional Non-Aqueous Converting Agent is Used

| Ingredient name | Preferred (%) | More Preferred (%) | Most Preferred (%) |
|---|---|---|---|
| Overbased Calcium Sulfonate | 10-45 | <37 | <30 (or even more preferably <22) |
| Overbased Magnesium Sulfonate (optional) | <30 | <24 | <20 (or even more preferably <15) |
| Base Oil (total) | 30-70 | 45-70 | 50-70 |
| Water (added) | 1.5-10 | 2.0-5.0 | 2.2-4.5 |
| Conventional non-aqueous converting agent | 0.1-5 | 0.3-4.0 | 0.5-2.0 |

TABLE 1A-continued

| Preferred Compositions when a Conventional Non-Aqueous Converting Agent is Used | | | |
|---|---|---|---|
| Ingredient name | Preferred (%) | More Preferred (%) | Most Preferred (%) |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium hydroxyapatite | 0-20 | 0-15 | 0-10 |
| Calcium carbonate (added) | 0-20 | 0-15 | 0-10 |
| Calcium hydroxide (added) and/or calcium oxide (added) (total amount if both used) | 0-1.20 | 0-1.00 | 0-0.80 |
| Total complexing acids (separately added) | 1.25-18.0 | 2.2-12.0 | 3.5-8.5 |
| Short Chain acids | 0.05-2.0 | 0.1-1.0 | 0.15-0.5 |
| Long Chain Acids | 0.5-8.0 | 1.0-5.0 | 2.0-4.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

TABLE 1B

| Preferred Compositions when No Conventional Non-Aqueous Converting Agent is Used | | | |
|---|---|---|---|
| Ingredient name | Preferred (%) | More Preferred (%) | Most Preferred (%) |
| Overbased Calcium Sulfonate | 10-45 | <37 | <33 (or even more preferably <28) |
| Overbased Magnesium Sulfonate | <30 | <24 | <20 (or even more preferably <15) |
| Base Oil (total) | 30-70 | 40-70 | 45-70 |
| Water (added) | 1.5-10 | 2.0-5.0 | 2.2-4.5 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium hydroxyapatite | 0-20 | 0-15 | 0-10 |
| Calcium carbonate (added) | 0-20 | 0-15 | 0-10 |
| Calcium hydroxide (added) and/or calcium oxide (added) (total amount if both used) | 0-1.60 | 0-1.20 | 0-1.00 |
| Total complexing acids (separately added) | 1.25-20.0 | 2.2-15.0 | 3.5-9.5 |
| Short Chain acids | 0.05-2.0 | 0.1-1.0 | 0.15-0.5 |
| Long Chain Acids | 0.5-10.0 | 1.0-8.0 | 2.0-5.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

Other preferred amounts are contained in the other tables and Examples herein and in the other U.S. Patent documents incorporated herein by reference. Some or all of any particular ingredient, including converting agents, added calcium containing bases, and glycerol derivatives may not be in the final finished product due to evaporation, volatilization, or reaction with other ingredients during manufacture. These amounts are when a grease is made in an open vessel. Even smaller amounts of overbased calcium sulfonate may be used when a sulfonate-based grease is made in a pressure vessel.

Preferred glycerol derivatives are mono, di, or tri-acyl glycerides. Most preferably, the glycerol derivative is one or more of hydrogenated castor oil, glyceryl mono-stearate, glyceryl mono-tallowate, and glycerol mono-oleate. Hydrogenated castor oil is essentially the tri acyl glyceride where all three fatty acid ester groups on the glycerol backbone are 12-hydroxystearic acid groups. According to one preferred embodiment, a glycerol derivative and a conventional non-aqueous converting agent are both added prior to conversion. According to another preferred embodiment, magnesium sulfonate and a glycerol derivative are added and no conventional non-aqueous converting agent is added prior to conversion. According to another preferred embodiment, two or more different glycerol derivatives, either with or without any conventional non-aqueous converting agent, are added prior to conversion.

The optionally added glycerol derivative can replace some or all of the normally used complexing acids to react with the one or more calcium containing bases (separately added or that may be included in the overbased calcium sulfonate), to reduce ingredient costs while still maintaining good thickener yield and high dropping point. The glycerol derivative will react with water to form in-situ a complexing acid. Water may be added before, after, or substantially simultaneously with the glycerol derivative.

According to another preferred embodiment, a calcium magnesium sulfonate grease comprises overbased calcium sulfonate and overbased magnesium sulfonate as ingredients in a ratio range of 100:0.1 to 60:40, more preferably in a ratio range of 99:1 to 70/30, and most preferably in a ratio range of 90:10 to 80:20. According to another preferred embodiment, a pre-conversion sulfonate-based grease composition comprises the following ingredients: overbased calcium sulfonate, overbased magnesium sulfonate, water, optionally one or more glycerol derivatives (which may be added during conversion, pre-conversion, or both), and optional base oil, and wherein water is the sole conventional converting agent in the pre-conversion composition. In other words, water, overbased magnesium sulfonate, and optionally any dual role complexing acid-converting agents are the only converting agent ingredients added to the composition. According to another preferred embodiment, a pre-conversion sulfonate-based grease composition comprises overbased calcium sulfonate and overbased magnesium sulfonate as ingredients in a ratio range of 100:0.1 to 60:40, more preferably in a ratio range of 99:1 to 70/30, and most preferably in a ratio range of 90:10 to 80:20.

The highly overbased oil-soluble calcium sulfonate (also referred to herein as simply "calcium sulfonate" or "overbased calcium sulfonate" for brevity) used according to these embodiments of the invention to make a calcium sulfonate grease can be any typical to that documented in the prior art, such as U.S. Pat. Nos. 4,560,489; 5,126,062; 5,308,514; and 5,338,467. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400 or higher. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation. The overbased calcium sulfonate contains around 28% to 40% dispersed amorphous calcium carbonate by weight of the overbased calcium sulfonate, which is converted to crystalline calcium carbonate during the process of making the calcium sulfonate grease. The overbased calcium sulfonate also contains around 0% to 8% residual calcium oxide or calcium hydroxide by weight of the overbased calcium sulfonate. Most commercial overbased calcium sulfonates will also contain around 40% base oil as a diluent, to keep the overbased calcium sulfonate from being so thick that it is difficult to handle and process. The amount of base oil in the overbased calcium sulfonate may make it unnecessary to add additional base oil (as a separate ingredient) prior to conversion to achieve an acceptable grease.

The overbased calcium sulfonate used may be of a "good" quality or a "poor" quality as in the '406 patent and defined herein. Certain overbased oil-soluble calcium sulfonates marketed and sold for the manufacture of calcium sulfonate-based greases can provide products with unacceptably low dropping points when prior art calcium sulfonate technologies are used. Such overbased oil-soluble calcium sulfonates are referred to as "poor quality" overbased oil-soluble calcium sulfonates throughout this application. When all ingredients are the same except for the commercially available batch of overbased calcium sulfonate used, overbased oil-soluble calcium sulfonates producing greases using the calcium carbonate technology of the '265 patent having higher dropping points (above 575 F) are considered to be "good" quality calcium sulfonates for purposes of this invention and those producing greases having lower dropping points are considered to be "poor" quality for purposes of this invention. Several examples of this are provided in the '406 patent, which is incorporated by reference. Although comparative chemical analyses of good quality and poor quality overbased oil-soluble calcium sulfonates has been performed, it is believed that the precise reason for this low dropping point problem has not been proven. While many commercially available overbased calcium sulfonates are considered to be good quality, it is desirable to achieve both improved thickener yield and higher dropping points regardless of whether a good quality or a poor quality calcium sulfonate is used. It has been found that both improved thickener yield and higher dropping point may be achieved with either a good quality or a poor quality calcium sulfonate when glycerol derivative is added, particularly in combination with the delayed converting agent method and/or delayed facilitating acid delay method.

Any petroleum-based naphthenic or paraffinic mineral oils commonly used and well known in the grease making art may be used as the base oil according to the invention. Base oil is added as needed, since most commercial overbased calcium sulfonates will already contain about 40% base oil as a diluent so as to prevent the overbased sulfonate from being so thick that it cannot be easily handled. Similarly, overbased magnesium sulfonate will likely contain base oil as a diluent. With the amount of base oil in the overbased calcium sulfonate and overbased magnesium sulfoante, it may be unnecessary to add additional base oil depending on the desired consistency of the grease immediately after conversion as well as the desired consistency of the final grease. Synthetic base oils may also be used in the greases of the present invention. Such synthetic base oils include polyalphaolefins (PAO), diesters, polyol esters, polyethers, alkylated benzenes, alkylated naphthalenes, and silicone fluids. In some cases, synthetic base oils may have an adverse effect if present during the conversion process as will be understood by those of ordinary skill in the art. In such cases, those synthetic base oils should not be initially added, but added to the grease making process at a stage when the adverse effects will be eliminated or minimized, such as after conversion. Naphthenic and paraffinic mineral base oils are preferred due to their lower cost and availability. The total amount of base oil added (including that initially added and any that may be added later in the grease process to achieve the desired consistency) is preferably in the ranges indicated in Table 1 above, based on the final weight of the grease. Typically, the amount of base oil added as a separate ingredient will increase as the amount of overbased calcium sulfonate decreases. Combinations of different base oils as described above may also be used in the invention, as will be understood by those with ordinary skill in the art.

The overbased magnesium sulfonate (also referred to herein as simply "magnesium sulfonate," for brevity) used according to these embodiments of the invention for a calcium magnesium sulfonate grease can be any typical to that documented or known in the prior art. The overbased magnesium sulfonate may be made in-situ or any commercially available overbased magnesium sulfonate may be used. Overbased magnesium sulfonate will typically comprise a neutral magnesium alkylbenzene sulfonate and an amount of overbasing wherein a substantial amount of that overbasing is in the form of magnesium carbonate. The magnesium carbonate is believed to typically be in an amorphous (non-crystalline) form. There may also be a portion of the overbasing that is in the form of magnesium oxide, magnesium hydroxide, or a mixture of the oxide and hydroxide. The total base number (TBN) of the overbased magnesium sulfonates is preferably at least 400 mg KOH/gram, but lower TBN values may also be acceptable and in the same ranges as indicated for the TBN values for the overbased calcium sulfonate above.

A small amount of a facilitating acid is preferably added to the mixture prior to conversion. A facilitating acid is required when the addition of a glycerol derivative is combined with a facilitating acid delay method, but is otherwise optional. Suitable facilitating acids, such as an alkyl benzene sulfonic acid, having an alkyl chain length typically between 8 to 16 carbons, may help to facilitate efficient grease structure formation. Most preferably, this alkyl benzene sulfonic acid comprises a mixture of alkyl chain lengths that are mostly about 12 carbons in length. Such benzene sulfonic acids are typically referred to as dodecylbenzene sulfonic acid ("DDBSA"). Commercially available benzene sulfonic acids of this type include JemPak 1298 Sulfonic Acid as supplied by JemPak GK Inc., Calsoft LAS-99 as supplied by Pilot Chemical Company, and Biosoft S-101 as supplied by Stepan Chemical Company. When the alkyl benzene sulfonic acid is used in the present invention, it is added before conversion and preferably in an amount in the ranges indicated in the Tables and Examples herein. If the calcium sulfonate or magnesium sulfonate is made in situ using alkyl benzene sulfonic acid, the facilitating acid added according to this embodiment is in addition to that required to produce the calcium sulfonate or magnesium sulfonate.

Water is added to the preferred embodiments of the invention as one converting agent. One or more conventional non-aqueous converting agents is also preferably added in certain embodiments of the invention. The conventional non-aqueous converting agents include any previously known converting agent other than water, such as alcohols, ethers, glycols, glycol ethers, glycol polyethers, carboxylic acids, inorganic acids, organic nitrates, other polyhydric alcohols and their derivatives, and any other compounds that contain either active or tautomeric hydrogen that solely function as converting agents (rather than dual role complexing acids-converting agents) and are added to the composition prior to conversion. Conventional non-aqueous converting agents also include those agents that contain some water as a diluent or impurity. Such ingredients may be added after conversion, if desired, and are not considered "conventional non-aqueous converting agents" in that case since they would not be acting as converting agents after conversion is complete.

Although they may be used as conventional non-aqueous converting agents, it is preferred not to use alcohols, such as methanol or isopropyl alcohol or other low molecular weight (i.e. more volatile) alcohols, because of environmental concerns and restrictions related to venting gases during the grease manufacturing process or hazardous waste disposal of scrubbed alcohols. The total amount of water added as a converting agent, based on the final weight of the grease, is preferably in the ranges indicated in the Tables and Examples herein. Additional water may be added after conversion. Also, if the conversion takes place in an open vessel at a sufficiently high temperature so as to volatilize a significant portion of the water during conversion, additional water may be added to replace the water that was lost. The total amount of one or more conventional non-aqueous converting agents added, based on the final weight of the grease, is preferably in the ranged indicated in the Tables and Examples herein. Typically, the amount of conventional non-aqueous converting agent used will decrease as the amount of overbased calcium sulfonate decreases. Depending on the converting agents used, some or all of them may be removed by volatilization during the manufacturing process. Especially preferred are the lower molecular weight glycols such as hexylene glycol and propylene glycol. It should be noted that some converting agents may also serve as complexing acids, to produce sulfonate complex sulfonate-based grease according to one embodiment of the invention. Such materials will simultaneously provide both functions of converting and complexing.

According to another preferred embodiment, conventional non-aqueous converting agents are not used as ingredients. Conventional non-aqueous converting agents may be added after conversion is complete, if desired, within the scope of such preferred embodiments of the invention since they will not act as converting agents if added after conversion; however, it is preferred that they be omitted altogether in these preferred embodiments.

One or more calcium containing bases are also added as ingredients in preferred embodiments of sulfonate-based grease compositions according to the invention. These calcium containing bases react with complexing acids to form a complex calcium magnesium sulfonate grease. The calcium containing bases may include calcium hydroxyapatite, added calcium carbonate, added calcium hydroxide, added calcium oxide, or a combination of one or more of the foregoing. According to one preferred embodiment, added calcium carbonate may be used as the sole added calcium containing base, as described in the '265 patent. The preferred amounts of ingredients when calcium carbonate is the sole added calcium containing base, with or without any conventional non-aqueous converting agent, according to these embodiments is in the following tables. The amounts are by weight percent of the final grease product (although these bases and other ingredients will not be present in the final grease product).

TABLE 2A

Calcium Carbonate when a Conventional Non-Aqueous Converting Agent is Used

| Ingredient name | Preferred % | More Preferred % | Most Preferred % |
|---|---|---|---|
| Overbased Calcium Sulfonate | 10-45 | <37 | <30 (or even more preferably <22) |
| Overbased Magnesium Sulfonate (optional) | <30 | <24 | <20 (or even more preferably <15) |
| Base Oil (total) | 30-70 | 45-70 | 50-70 |
| Water (added) | 1.5-10 | 2.0-5.0 | 2.2-4.5 |
| Conventional non-aqueous converting agent | 0.1-5 | 0.3-4.0 | 0.5-2.0 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium carbonate (added as sole added calcium containing base) | 1.0-20 | 2.0-15 | 3.0-10 |
| Total complexing acids | 1.25-18.0 | 2.2-12.0 | 3.5-8.5 |
| Short Chain acids | 0.05-2.0 | 0.1-1.0 | 0.15-0.5 |
| Long Chain Acids | 0.5-8.0 | 1.0-5.0 | 2.0-4.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

TABLE 2B

Calcium Carbonate when No Conventional Non-Aqueous Converting Agent is Used

| Ingredient name | Preferred % | More Preferred % | Most Preferred % |
|---|---|---|---|
| Overbased Calcium Sulfonate | 10-45 | <37 | <33 (or even more preferably <28) |
| Overbase Magnesium Sulfonate | <30 | <24 | <20 (or even more preferably <15) |
| Base Oil (total) | 30-70 | 40-70 | 45-70 |
| Water (added) | 1.5-10 | 2.0-5.0 | 2.2-4.5 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium carbonate (added as sole added calcium containing base) | 1.0-20 | 2.0-15 | 3.0-10 |
| Total complexing acids | 1.25-20.0 | 2.2-15.0 | 3.5-9.5 |
| Short Chain acids | 0.05-2.0 | 0.1-1.0 | 0.15-0.5 |
| Long Chain Acids | 0.5-10.0 | 1.0-8.0 | 2.0-5.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

According to another preferred embodiment, calcium hydroxyapatite is added as a calcium containing base as described in the '406 patent. Most preferably added calcium hydroxyapatite and added calcium carbonate are used together, along with a small amount of added calcium hydroxide. The preferred amounts of ingredients when calcium hydroxyapatite is added as a calcium containing base (preferably with added calcium carbonate and added calcium hydroxide), with or without any conventional non-aqueous converting agent, according to these embodiments is in the following tables. The amounts are by weight percent of the final grease product (although these bases and other ingredients will not be present in the final grease product).

TABLE 3A

Calcium Hydroxyapatite when a Conventional Non-Aqueous Converting Agent is Used

| Ingredient name | Preferred % | More Preferred % | Most Preferred % |
|---|---|---|---|
| Overbased Calcium Sulfonate | 10-45 | <37 | <30 (or even more preferably <22) |
| Overbased Magnesium Sulfonate (optional) | <30 | <24 | <20 (or even more preferably <15) |
| Base Oil (total) | 30-70 | 45-70 | 50-70 |
| Water (added) | 1.5-10 | 2.0-5.0 | 2.2-4.5 |
| Conventional non-aqueous converting agent | 0.1-5 | 0.3-4.0 | 0.5-2.0 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium hydroxyapatite | 1.0-20 | 2.0-15 | 3.0-10 |
| Calcium carbonate (added) | 1.0-20 | 2.0-15 | 3.0-10 |
| Calcium hydroxide (added) and/or calcium oxide (added) (total amount if both used) | 0.07-1.20 | 0.15-1.00 | 0.18-0.80 |
| Total complexing acids | 1.25-18.0 | 2.2-12.0 | 3.5-8.5 |
| Short Chain acids | 0.05-2.0 | 0.1-1.0 | 0.15-0.5 |
| Long Chain Acids | 0.5-8.0 | 1.0-5.0 | 2.0-4.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

TABLE 3B

Calcium Hydroxyapatite when No Conventional Non-Aqueous Converting Agent is Used

| Ingredient name | Preferred % | More Preferred % | Most Preferred % |
|---|---|---|---|
| Overbased Calcium Sulfonate | 10-45 | <37 | <33 (or even more preferably <28) |
| Overbased Magnesium Sulfonate | <30 | <24 | <20 (or even more preferably <15) |
| Base Oil (total) | 30-70 | 40-70 | 45-70 |
| Water (added) | 1.5-10 | 2.0-5.0 | 2.2-4.5 |
| Facilitating Acid (such as Dodecylbenzene sulfonic acid) | 0.5-5.0 | 1.0-4.0 | 1.3-3.6 |
| Glycerol derivative | 0.1-6.0 | 0.2-5.0 | 0.3-4.0 |
| Calcium hydroxyapatite | 1.0-20 | 2.0-15 | 3.0-10 |
| Calcium carbonate (added) | 1.0-20 | 2.0-15 | 3.0-10 |
| Calcium hydroxide (added) and/or calcium oxide (added) (total amount if both used) | 0.07-1.60 | 0.15-1.20 | 0.18-1.00 |
| Total complexing acids | 1.25-20.0 | 2.2-15.0 | 3.5-9.5 |
| Short Chain acids | 0.05-2.0 | 0.1-1.0 | 0.15-0.5 |
| Long Chain Acids | 0.5-10.0 | 1.0-8.0 | 2.0-5.0 |
| Boric acid | 0.3-4.0 | 0.5-3.0 | 0.6-2.0 |
| Phosphoric acid | 0.4-4.0 | 0.6-3.0 | 0.8-2.0 |
| Alkali metal hydroxide (optional) | 0-0.5 | 0-0.4 | 0-0.20 |

The calcium containing base(s) for reacting with complexing acids according to preferred embodiments may be added pre-conversion, post-conversion, or a portion added pre—and a portion added post-conversion.

The added calcium carbonate used as a calcium containing base, either alone (as described in the '265 patent) or in combination with another calcium containing base or bases (such as calcium hydroxyapatite), according to these embodiments of the invention, is finely divided with a mean particle size of around 1 to 20 microns, preferably around 1 to 10 microns, most preferably around 1 to 5 microns. Furthermore, the added calcium carbonate is preferably crystalline calcium carbonate (most preferably calcite) of sufficient purity so as to have abrasive contaminants such as silica and alumina at a level low enough to not significantly impact the anti-wear properties of the resulting grease. Ideally, for best results, the calcium carbonate should be either food grade or U.S. Pharmacopeia grade. The amount of added calcium carbonate added is preferably in the ranges indicated in Tables and Examples herein, particularly Tables 2A and 2B. These amounts are added as a separate ingredient in addition to the amount of dispersed calcium carbonate contained in the overbased calcium sulfonate. According to another preferred embodiment of the invention, the added calcium carbonate is added prior to conversion as the sole added calcium-containing base ingredient for reacting with complexing acids. Additional calcium carbonate may be added to either the simple or complex grease embodiments of the invention after conversion, and after all reaction with complexing acids is complete in the case of a complex grease. However, references to added calcium carbonate herein refer to the calcium carbonate as one of, or the sole, added calcium-containing base(s) for reaction with complexing acids when making a complex grease according to the invention.

The calcium hydroxyapatite added according to preferred embodiments is most preferably finely divided with a mean particle size of around 1 to 20 microns, preferably around 1 to 10 microns, most preferably around 1 to 5 microns. Furthermore, the calcium hydroxyapatite will be of sufficient purity so as to have abrasive contaminants such as silica and alumina at a level low enough to not significantly impact the anti-wear properties of the resulting grease. Ideally, for best results, the calcium hydroxyapatite should be either food grade or U.S. Pharmacopeia grade. The amount of calcium hydroxyapatite added will preferably be in the ranges indicated in Tables and Examples herein, particularly Tables 3A and 3B, although more can be added, if desired, after conversion and all reaction with complexing acids is complete.

According to another preferred embodiment of the invention, calcium hydroxyapatite may be added in an amount that is stoichiometrically insufficient to fully react with the complexing acids. In this embodiment, finely divided calcium carbonate as an oil-insoluble, solid, added calcium-containing base may be added, preferably before conversion, in an amount sufficient to fully react with and neutralize the portion of any subsequently added complexing acids not neutralized by the calcium hydroxyapatite. Alternatively, in this embodiment, finely divided calcium hydroxide and/or calcium oxide as an oil-insoluble solid calcium-containing base may be added, preferably before conversion, in an amount sufficient to fully react with and neutralize the portion of any subsequently added complexing acids not neutralized by the co-added calcium hydroxyapatite. According to yet another preferred embodiment, a combination of added calcium carbonate and added calcium hydroxide (or calcium oxide) are used when the amount of calcium hydroxyapatite is stoichiometrically insufficient.

According to yet another preferred embodiment, when calcium hydroxyapatite is used in combination with added calcium hydroxide as calcium containing bases for reacting with complexing acids to make a calcium magnesium sulfonate grease, a smaller amount of calcium hydroxyapatite is needed compared to the calcium sulfonate greases described in the '406 patent. In the '406 patent, the added calcium hydroxide and/or calcium oxide are preferably present in an amount not more than 75% of the hydroxide equivalent basicity provided by the total of the added calcium hydroxide and/or calcium oxide and the calcium hydroxyapatite. In other words, the calcium hydroxyapatite contributes preferably at least 25% of the total added hydroxide equivalents (from both calcium hydroxyapatite and added calcium hydroxide and/or added calcium oxide) in the calcium sulfonate greases described in the '406 patent, particularly when a poor quality overbased calcium sulfonate is used. If less than that amount of calcium hydroxyapatite is used, the dropping point of the final calcium sulfonate grease may suffer. However, with the addition of overbased magnesium sulfonate to the composition according to various embodiments of this invention, less calcium hydroxyapatite may be used while still maintaining sufficiently high dropping points. The amount of calcium hydroxyapatite used according to preferred embodiments of this invention may be less than 25%, and even less than 10% of the hydroxide equivalent basicity, even when a poor quality overbased calcium sulfonate is used. This is one indication that the presence of overbased magnesium sulfonate in the finished grease has resulted in an unexpected changed and improved chemical structure. Since calcium hydroxyapatite is typically much more costly compared to added calcium hydroxide, this results in a further potential cost reduction for the final grease without any significant reduction in dropping point.

In another embodiment, calcium carbonate may also be added with the calcium hydroxyapatite, calcium hydroxide and/or calcium oxide, with the calcium carbonate being added either before or after reacting with complexing acids, or added both before and after reacting with complexing acids. When the amounts of calcium hydroxyapatite, calcium hydroxide, and/or calcium oxide are not sufficient to neutralize the complexing acid or acids added, calcium carbonate is preferably added in an amount that is more than sufficient to neutralize any remaining complexing acid or acids.

The added calcium hydroxide and/or added calcium oxide added pre-conversion or post-conversion according to another embodiment is most preferably finely divided with a mean particle size of around 1 to 20 microns, preferably around 1 to 10 microns, most preferably around 1 to 5 microns. Furthermore, the calcium hydroxide and calcium oxide will be of sufficient purity so as to have abrasive contaminants such as silica and alumina at a level low enough to not significantly impact the anti-wear properties of the resulting grease. Ideally, for best results, the calcium hydroxide and calcium oxide should be either food grade or U.S. Pharmacopeia grade. The total amount of calcium hydroxide and/or calcium oxide will preferably be in the ranges indicated in Tables and Examples herein, particularly Tables 3A and 3B. These amounts are added as separate ingredients in addition to the amount of residual calcium hydroxide or calcium oxide contained in the overbased calcium sulfonate. Most preferably, an excess amount of calcium hydroxide relative to the total amount of complexing acids used is not added prior to conversion. According to yet another embodiment, it is not necessary to add any calcium hydroxide or calcium oxide for reacting with complexing acids and either added calcium carbonate or calcium hydroxyapatite (or both) may be used as the sole added calcium containing base(s) for such reaction or may be used in combination for such reaction.

One or more alkali metal hydroxides are also optionally added as ingredients in a preferred embodiment of sulfonate-based grease compositions according to the invention. The optional added alkali metal hydroxides comprise sodium hydroxide, lithium hydroxide, potassium hydroxide, or a combination thereof. Most preferably, sodium hydroxide is the alkali hydroxide used with the sulfonate-based greases according to one embodiment of the invention. The total amount of alkali metal hydroxide added is preferably in the ranges indicated in the Tables and Examples herein. As with the calcium-containing bases, the alkali metal hydroxide reacts with complexing acids resulting in an alkali metal salt of a complexing acid present in the final grease product. The preferred amounts indicated in the Tables and Examples herein are amounts added as raw ingredients relative to the weight of the final grease product, even though no alkali metal hydroxide will be present in the final grease.

According to one preferred embodiment of a method for making an overbased calcium magnesium sulfonate grease, the alkali metal hydroxide is dissolved in the water prior to being added to other ingredients. The water used to dissolve the alkali metal hydroxide may be water used as a converting agent or water added post-conversion. It is most preferred to dissolve the alkali metal hydroxide in water prior to adding it to the other ingredients, but it may also be directly added to the other ingredients without first dissolving it in water.

One or more complexing acids, such as long chain carboxylic acids, short chain carboxylic acids, boric acid, and phosphoric acid are also preferably separately added according to some preferred embodiments of the invention when a complex calcium magnesium sulfonate grease is desired. Most preferably, the complexing acids comprise 12-hydroxystearic acid, acetic acid, phosphoric acid, boric acid, or a combination thereof. Preferred range of total separately added complexing acids and preferred amounts for specific types of separately added complexing acids as ingredients by weight percent of the final grease product (although these acids will react with bases and will not be present in the final grease product) are in the Tables and Examples herein.

The amount of short or long chain fatty acids added may be reduced or eliminated when one or more glycerol derivatives are added according to one preferred embodiment of the invention. As used herein, references to "separately added complexing acids" or similar wording refers to complexing acids that are added as separate ingredients or formed in-situ by a reaction of ingredients other than a reaction of an added glycerol derivative and water.

The long chain carboxylic acids suitable for use in accordance with the invention comprise aliphatic carboxylic acids with at least 12 carbon atoms. Preferably, the long chain carboxylic acids comprise aliphatic carboxylic acids with at least 16 carbon atoms. Most preferably, the long chain carboxylic acid is 12-hydroxystearic acid.

Short chain carboxylic acids suitable for use in accordance with the invention comprise aliphatic carboxylic acids with no more than 8 carbon atoms, and preferably no more than 4 atoms. Most preferably, the short chain carboxylic acid is acetic acid. Any compound that can be expected to react with water or other components used in producing a grease in accordance with this invention with such reaction generating a long chain or short chain carboxylic acid are also suitable for use. For instance, using acetic anhydride would, by reaction with water present in the mixture, form the acetic acid to be used as a complexing acid. Likewise, using methyl 12-hydroxystearate would, by reaction with water present in the mixture, form the 12-hydroxystearic acid to be used as a complexing acid. Alternatively, additional water may be added to the mixture for reaction with such components to form the necessary complexing acid if sufficient water is not already present in the mixture. Additionally, acetic acid and other carboxylic acids may be used as a converting agent or complexing acid or both, depending on when it is added. Similarly, some complexing acids (such as the 12-hydroxystearic acid in the '514 and '467 patents) may also be used as converting agents.

If boric acid is used as a complexing acid according to this embodiment, the boric acid may be added after first being dissolved or slurried in water, or it can be added without water. Preferably, the boric acid will be added during the manufacturing process such that water is still present. Alternatively, any of the well-known inorganic boric acid salts may be used instead of boric acid. Likewise, any of the established borated organic compounds such as borated amines, borated amides, borated esters, borated alcohols, borated glycols, borated ethers, borated epoxides, borated ureas, borated carboxylic acids, borated sulfonic acids, borated epoxides, borated peroxides and the like may be used instead of boric acid.

The percentages of various complexing acids described herein refer to pure, active compounds. If any of these complexing acids are available in a diluted form, they may still be suitable for use in the present invention. However, the percentages of such diluted complexing acids will need to be adjusted so as to take into account the dilution factor and bring the actual active material into the specified percentage ranges.

Other additives commonly recognized within the grease making art may also be added to either the simple grease embodiment or the complex grease embodiment of the invention. Such additives can include rust and corrosion inhibitors, metal deactivators, metal passivators, antioxidants, extreme pressure additives, antiwear additives, chelating agents, polymers, tackifiers, dyes, chemical markers, fragrance imparters, and evaporative solvents. The latter category can be particularly useful when making open gear lubricants and braided wire rope lubricants. The inclusion of any such additives is to be understood as still within the scope of the present invention. All percentages of ingredients are based on the final weight of the finished grease unless otherwise indicated, even though that amount of the ingredient may not be in the final grease product due to reaction or volatilization.

The complex sulfonate-based greases according to these preferred embodiments are most preferably an NLGI No. 2 grade grease having a dropping point of at least 575 F more preferably of 650 F or greater, but greases with other NLGI grades from No. 000 to No. 3 may also be made according to these embodiments with modifications as will be understood by those of ordinary skill in the art. The use of the preferred methods and ingredients according to the invention appear to improve thickener yield and dropping point compared to sulfonate-based greases made without an added glycerol derivative.

Methods of Making Sulfonate-Based Greases

Preferred sulfonate-based grease compositions are made according to preferred methods of the invention described herein and in the references incorporated herein by reference. In one preferred embodiment, the method comprises: (1) mixing overbased calcium sulfonate and a optionally base oil; (2) optionally adding and mixing overbased magnesium sulfonate; (3) adding and mixing one or more glycerol derivatives; (4) adding and mixing one or more converting agents (water and optionally one or more conventional non-aqueous converting agents); (5) heating some combination of these ingredients until conversion has occurred; and (6) mixing and heating to a temperature sufficiently high to insure removal of water. Most preferably, the method also comprises: (7) optionally adding and mixing one or more facilitating acids: (8) adding and mixing one or more calcium containing bases: (9) adding and mixing one or more complexing acids; and (10) optionally adding and mixing an alkali metal hydroxide, preferably sodium hydroxide pre-dissolved in water prior to adding to the other ingredients. Most preferably, the method also comprises a facilitating acid delay method and/or a converting agent delay method. Additional optional steps comprises: (11) optionally mixing additional base oil, as needed, after conversion; (12) mixing and heating to a temperature sufficiently high to insure removal of any volatile reaction byproducts and optimize final product quality: (13) cooling the grease while adding additional base oil as needed; and (14) adding remaining desired additives as are well known in the art.

Typically, one of the final steps in manufacturing a sulfonate-based grease is to mill the grease to obtain a final smooth homogenous product. According to a preferred embodiment, milling the grease is not required when a glycerol derivative is added, as milling imparts little or no further improvement in thickening determined by penetration value (and corresponding thickener yield) or smoothness of structure. According to another preferred embodiment, the grease is milled even when a glycerol derivative is added.

Any of the above steps may be modified by or use with any one or more of the following additional steps or ingredients: (a) by adding overbased magnesium sulfonate all at once prior to conversion; (b) adding magnesium sulfonate using a split addition method; (c) using a magnesium sulfonate delay period; (d) using a combination of split addition and magnesium sulfonate delay period(s); (e) using one or more facilitating acid delay periods; (f) excluding the addition of any conventional non-aqueous converting agents prior to conversion; (g) the addition of calcium hydroxyapatite and/or added calcium carbonate as calcium-containing bases for reacting with complexing acids, either with or without separately adding added calcium hydroxide and/or added calcium oxide as calcium containing bases; or (h) the delayed addition of conventional non-aqueous converting agents (a converting agent delay method). These additional methods and ingredients are disclosed in U.S. Pat. Nos. 9,273,265, 9,458,406, 9,976, 101, 9,976,102, 10,087,387, 10,087,388, and 10,087,391), which are incorporated herein by reference.

The temperature for conversion heating in step (5) is preferably 190 F-200 F. In some embodiments, it may be preferred to heat to a temperature around 260 F during step (5). The converting agents in step (4) may include one or more conventional non-aqueous converting agents, water, or any combination thereof. Water, if added prior to conversion, can act as a converting agent. If overbased magnesium sulfonate is added in step (2), it is not necessary to add any conventional non-aqueous converting agent in step (6) (unless a converting agent delay method is used), but a conventional a non-aqueous converting agent may still be added (with or without a converting agent delay method). The complexing acids in step (9) may be separately added complexing acids or may be a complexing acid formed in situ by reaction of an added glycerol derivative and water. All or a portion of one or more glycerol derivatives may be added prior to conversion or after conversion or any combination thereof. Most preferably, at least a portion of a glycerol derivative is added prior to conversion.

The glycerol derivative in step (3) may be added pre-conversion, during conversion, post-conversion, or a combination thereof. Most preferably at least some glycerol derivative is added pre-conversion. Each of the ingredients in steps (8-calcium containing bases), (9-complexing acids) and (10-alkali metal hydroxide) can be added prior to conversion, after conversion, or a portion added prior and another portion added after conversion. Any facilitating acid added in step (7) is preferably added prior to conversion. If a facilitating acid and alkali metal hydroxide are used, the facilitating acid is preferable added to the mixture before the alkali metal hydroxide is added. Most preferably, the specific ingredients and amounts used in the methods of the invention are according to the preferred embodiments of the compositions described herein. Although some ingredients are preferably added prior to other ingredients, the order of addition of ingredients relative to other ingredients in the preferred embodiments of the invention is not critical (other than water being added prior to a conventional non-aqueous converting agent if a converting agent delay method is used).

Although the order and timing of step (6) and final steps 11-14 is not critical, it is preferred that water be removed quickly after conversion. Generally, the grease is heated to remove the water that was initially added as a converting agent, as well as any water formed by chemical reactions during the formation of the grease. Having water in the grease batch for prolonged periods of time during manufacture may result in degradation of thickener yield, dropping point, or both, and such adverse effects may be avoided by removing the water quickly. If polymeric additives are added to the grease, they should preferably not be added until the grease temperature reaches 300 F. Polymeric additives can, if added in sufficient concentration, hinder the effective volatilization of water. Therefore, polymeric additives should preferably be added to the grease only after all water has been removed. If during manufacture it can be determined that all water has been removed before the temperature of the grease reaches the preferred 300 F value, then any polymer additives may preferably be added at any time thereafter.

The preferred embodiments of the methods herein may occur in either an open or closed kettle as is commonly used for grease manufacturing. The conversion process can be achieved at normal atmospheric pressure or under pressure in a closed kettle. Manufacturing in open kettles (vessels not under pressure) is preferred since such grease manufacturing equipment is commonly available. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium magnesium sulfonate greases, as will be understood by those with ordinary skill in the art. Manufacturing in pressurized kettles may also be used and may result in even greater improvement in thickener yield, but the pressurized processes may be more complicated and difficult to control. Additionally, manufacturing calcium magnesium sulfonate greases in pressurized kettles may result in productivity issues. The use of pressurized reactions can be important for certain types of greases (such as polyurea greases) and most grease plants will only have a limited number of pressurized kettles available. Using a pressurized kettle to make calcium magnesium sulfonate greases, where pressurized reactions are not as important, may limit a plant's ability to make other greases where those reactions are important. These issues are avoided with open vessels.

A converting agent delay used in some preferred embodiments is a period of time between the initial pre-conversion addition of water and pre-conversion addition of at least a portion of a non-aqueous converting agent. A converting agent delay period may be a converting agent temperature adjustment delay period or a converting agent holding delay period or both. If additional water is added pre-conversion to make up for evaporation losses during the manufacturing process, those additions are not used in re-starting or determining converting agent delay periods, and only the first addition of water is used as the starting point in determining converting agent delay periods. A converting agent temperature adjustment delay period is the amount of time after the initial water is added that it takes to heat the mixture to a temperature or range of temperatures. A converting agent holding delay period is the amount of time the mixture is held at a temperature (including ambient temperature) before being heated or cooled to another temperature or before adding at least a portion of a non-aqueous converting agent. There may be multiple converting agent temperature adjustment delay periods and multiple converting agent holding delay periods or a combination thereof. For example, the mixture comprising the initial water may be held at ambient temperature for 30 minutes prior to adding one non-aqueous converting agent (a first holding delay period) and may continue to be held at ambient temperature for another hour prior to adding the same or a different non-aqueous converting agent (a second holding delay period). Additionally, the mixture comprising the initial water may be heated or cooled to a first temperature after which a non-aqueous converting agent is added (a first temperature adjustment period) and then the mixture is heated or cooled to a second temperature after which the same or a different non-aqueous converting agent is added (a second temperature adjustment period, without any interim holding period). Although a converting agent delay period may involve a holding delay period that does not involve heating, a short period of time of less than 15 minutes between the addition of the initial water as a converting agent and the addition of all of the non-aqueous converting agent(s) without any heating during that time period is not a "converting agent delay" or "converting agent delay period" as used herein. A delay for the addition of any or all of the non-aqueous converting agent(s) without heating during the delay period should be at least about 20 minutes and more preferably at least about 30 minutes.

A facilitating acid delay period used in some preferred embodiments is a period of time between the addition of a facilitating acid and (1) the next subsequently added ingredient or (2) a subsequently added reactive ingredient (overbased magnesium sulfonate), even if it is not the next added ingredient (one or more other ingredients is added between the facilitating acid and the reactive ingredient) if there is heating between the additions. A facilitating acid delay may be a facilitating acid temperature adjustment delay period or a facilitating acid holding delay period or both, similar to the converting agent delays previously described. A facilitating acid delay may follow the addition of all of the facilitating acid or a facilitating acid delay may follow the addition of a portion of a facilitating acid. For example, a facilitating acid temperature adjustment delay period is the amount of time after one or more facilitating acids is added and prior to the addition of the next ingredient (or portion thereof) that it takes to heat the mixture to a temperature or range of temperatures. A facilitating acid holding delay period is the amount of time the mixture is held at a temperature (which may be ambient temperature) before being heated or cooled to another temperature or before adding the next ingredient or next portion of a facilitating acid. A delay between the addition of a facilitating acid and the next ingredient of 30 minutes or more, preferably 40 minutes or more, is a facilitating acid delay, regardless of which ingredient is the next added ingredient. A delay may be shorter than 30 minutes if there is a temperature adjustment between the addition of the facilitating acid and the next added ingredient. Additionally, if the next added ingredient is reactive with the facilitating acid (such as overbased magnesium sulfonate), then a facilitating acid delay period may be less than 30 minutes, such as around 20 minutes, even without any heating. If a reactive ingredient is added after the facilitating acid and there is a temperature adjustment between the addition of the facilitating acid and the reactive ingredient, then there is a facilitating acid delay period even if the reactive ingredient is not the immediately next added ingredient (that is the reactive ingredient is added as the second, third, fourth, etc. ingredient added after the facilitating acid) and even if there is no delay period between the facilitating acid and the next added ingredient (the ingredient first added after the facilitating acid) because it is added less than 30 minutes after the facilitating acid without any interim temperature adjustment. If the reactive ingredient is overbased magnesium sulfonate, then there is also a magnesium sulfonate delay period as described below.

All facilitating acid delay periods end upon the addition of the next added ingredient, unless an ingredient reactive to the facilitating acid (such as magnesium sulfonate) is to be added at a later point in the process (as the second, third, etc. ingredient added after the facilitating acid), then the facilitating acid delay continues until the addition of that reactive ingredient (such as overbased magnesium sulfonate). In that case, the facilitating acid delay or delays are determined by whether there is a temperature adjustment or the time held at a temperature between the addition of the facilitating acid and the magnesium sulfonate. For example, if you add the facilitating acid and then immediately add three other ingredients without a temperature change and then add overbased magnesium sulfonate, there is a single facilitating acid holding delay, which is the amount of time between the addition of the facilitating acid and the magnesium sulfonate, even though the magnesium sulfonate was the fourth added ingredient. When magnesium sulfonate is the later added reactive ingredient, there will also be a magnesium sulfonate delay (as discussed further below), that overlaps the facilitating acid delay period.

A magnesium sulfonate delay period used in some preferred embodiments is a period of time between the addition of water or other reactive ingredients (such as acids, bases, or non-aqueous converting agents) and the subsequent addition of at least a portion of the overbased magnesium sulfonate. The magnesium sulfonate delay periods may be a magnesium sulfonate temperature adjustment delay period or a magnesium sulfonate holding delay period or both, similar to the converting agent delays and facilitating acid delays. If there is a temperature adjust delay or a holding delay between the addition of a facilitating acid and the subsequent addition of overbased magnesium sulfonate, then the delay is a facilitating acid delay and a magnesium sulfonate delay.

According to another preferred embodiment, a sulfonate-based grease made with a glycerol derivative has final (converted) FTIR spectra that is different from FTIR spectra for prior art sulfonate-based greases. As previously described, prior art overbased calcium sulfonate greases having varying FTIR spectra during the course of conversion. An FTIR spectrum showing a peak at 862 $cm^{-1}$ indicates the amorphous calcium carbonate contained in the overbased calcium sulfonate that will be converted to dispersed crystalline calcium carbonate. An intermediate peak at around 874 $cm^{-1}$ is commonly observed during the conversion process of calcium sulfonate-based greases. Depending on minor variations in the grease being made, this intermediate peak can be observed within the range of about 872 $cm^{-1}$ to 877 $cm^{-1}$. Complete conversion to the desirable dispersion of crystalline calcium carbonate (calcite) is typically evidenced by the elimination of both the original amorphous calcium carbonate peak at 862 $cm^{-1}$ and the intermediate peak (as formed during, but before the completion of, the conversion process) and the establishment of a new single peak at about 882 $cm^{-1}$.

When added powdered calcium carbonate is used according to the '265 patent or in an amount that is in excess of what would react with the complexing acid(s), a slightly different final (converted) FTIR spectra is observed. In the sulfonate-based greases comprising added calcium carbonate, complete conversion will be evidenced by an FTIR spectra showing a single peak at about 882 $cm^{-1}$ with a small shoulder at about 874 $cm^{-1}$. This is because unreacted micron-sized dispersed crystalline calcium carbonate (calcite) has its characteristic FTIR peak at around 874 $cm^{-1}$ instead of around 882 $cm^{-1}$ (the much smaller calcium carbonate particles formed from the conversion of the amorphous calcium carbonate).

When adding a glycerol derivative is added according to preferred embodiments of the invention, new final (converted) FTIR spectra were observed comprising one or more of: (1) two distinct peaks (also referred to herein as a doublet) one between 872 $cm^{-1}$ and 877 $cm^{-1}$ and one at around 882 $cm^{-1}$, where the peak between 872 $cm^{-1}$ and 877 $cm^{-1}$ is the dominant peak, (2) a doublet where the peak at round 882 $cm^{-1}$ is the dominant peak, (3) a non-eliminated shoulder at around 862 $cm^{-1}$, (4) a dominant peak at around 882 $cm^{-1}$ and a shoulder between 872 $cm^{-1}$ and 877 $cm^{-1}$, wherein the height of the shoulder is around 33%-95% of the height of the 882 $cm^{-1}$ peak, or (5) a peak between 872 $cm^{-1}$ and 877 $cm^{-1}$ with a shoulder at around 882 $cm^{-1}$ The sulfonate-based grease compositions and methods for making such compositions according to various embodiments the invention are further described and explained in relation to the following examples. Examples 1-6 are baseline examples that do not include a glycerol derivative addition according to preferred embodiments of the invention. Examples 1-16 use added crystalline calcium carbonate as the sole added calcium containing base for reacting with complexing acids, as described in U.S. Pat. No. 9,273,265 (and further described in the '101, '102, '387, '388, and '391 patents). Examples 17-23 use calcium hydroxyapatite, added calcium carbonate, and added calcium hydroxide as calcium containing bases for reacting with complexing acids as described in U.S. Pat. No. 9,458,406 (and further described in the '101, '102, '387, '388, and '391 patents). The calcium carbonate technology was selected for Examples 7 and 9-16 according to preferred embodiments of the invention as a threshold for the beneficial results that may be achieved by adding a glycerol derivative.

Example 1—This Example is the same as Example 27 of U.S. Pat. No. 10,087,387 and uses added calcium carbonate as described in U.S. Pat. No. 9,273,265. The ratio of overbased calcium sulfonate to overbased magnesium sulfonate was about 90/10. The delayed non-aqueous converting agent technique was used. No facilitating acid delay method was used. All the overbased magnesium sulfonate was added at the beginning.

The grease was made as follows: 310.14 grams of 400 TBN overbased oil-soluble calcium sulfonate were added to an open mixing vessel followed by 345.89 grams of a solvent neutral group 1 paraffinic base oil having a viscosity of about 600 SUS at 100 F. The 400 TBN overbased oil-soluble calcium sulfonate was a good quality calcium sulfonate as defined by our recently issued U.S. Pat. No. 9,458,406. Mixing without heat began using a planetary mixing paddle. Then 31.60 grams of overbased magnesium sulfonate A was added and allowed to mix in for 15 minutes. This overbased magnesium sulfonate A is the one described in U.S. Pat. No. 10,087,387. Then 31.20 grams of a primarily C12 alkylbenzene sulfonic acid (facilitating acid) were added. After mixing for 20 minutes, 75.12 grams of finely divided calcium carbonate with a mean particle size below 5 microns were added and allowed to mix in for 20 minutes. Then 0.84 grams of glacial acetic acid and 8.18 grams of 12-hydroxystearic acid were added. The mixture was stirred for 10 minutes. Then 40.08 grams water were added, and the mixture was heated with continued mixing to a temperature of 190 F to 200 F. This represents a temperature adjustment delay. The mixture was mixed at this temperature range for 30 minutes. This represents a holding delay. During that time, significant thickening had occurred, with a grease structure having formed. Fourier Transform Infrared (FTIR) spectroscopy indicated that water was being lost due to evaporation. Another 70 ml water were added. FTIR spectroscopy also indicated that conversion had partially occurred even though no hexylene glycol (non-aqueous converting agent) had yet been added. After the 30 minutes holding delay at 190 to 200 F, 15.76 grams of hexylene glycol were added. Shortly after this, FTIR spectroscopy indicating that the conversion of the amorphous calcium carbonate to crystalline calcium carbonate (calcite) had occurred. However, the batch seemed to soften somewhat after the glycol was added. Another 20 ml water were added followed by 2.57 grams of glacial acetic acid and 16.36 grams of 12-hydroxystearic acid. These two complexing acids were allowed to react for 10 minutes. Then 16.60 grams of a 75% solution of phosphoric acid in water were slowly added and allowed to mix in and react.

The grease was then heated to 390 to 400 F. As the mixture was heated, the grease continued to become increasingly thin and fluid. The heating mantle was removed from the mixer and the grease was allowed to cool while continuing to be mixed. The mixture was very thin and had no significant grease texture. When the temperature was below 170 F, a sample was removed from the mixer and given passes through a three-roll mill. The milled grease had an unworked penetration of 189. This result was extremely surprising and indicated that a very unusual and highly rheopectic structure had formed. Three more portions of the same base oil totaling 116.02 grams were added. The grease was then removed from the mixer and given three passes through a three-roll mill to achieve a final smooth homogenous texture. The grease had a worked 60 stroke penetration of 290. The percent overbased oil-soluble calcium sulfonate in the final grease was 31.96%. The dropping point was 617 F.

Example 2—This Example is the same as Example 13 of U.S. Pat. No. 10,087,388 and was made similar to the previous Example 1 grease herein. Like the Example 1 grease, the ratio of overbased calcium sulfonate to overbased magnesium sulfonate was about 90/10, and all the overbased magnesium sulfonate was added before conversion, and the delayed non-aqueous converting agent technique was used. However, there were several significant changes concerning other aspects of this grease compared to the Example 1 grease. The overbased magnesium sulfonate was added not at the very beginning, but after the primarily C12 alkylbenzene sulfonic acid (facilitating acid) was added and mixed in for an intentional 20 minute delay. This represents a facilitating acid delay method. It also represents a delayed overbased magnesium sulfonate addition method relative to the facilitating acid. It also illustrates that the delayed overbased magnesium sulfonate addition technique does not need to always be relative to the addition of water, but can be relative to any other reactive component. In this case, it is relative to the addition of the facilitating acid. A second portion of powdered calcium carbonate was added after conversion but before the second portion of complexing acids was added. Also, this grease used a higher post-conversion level of 12-hydroxystearic acid. Finally, phosphoric acid was not used as a post-conversion complexing acid. Instead, boric acid was used.

The grease was made as follows: 310.79 grams of 400 TBN overbased oil-soluble calcium sulfonate were added to an open mixing vessel followed by 310.47 grams of a solvent neutral group 1 paraffinic base oil having a viscosity of about 600 SUS at 100 F. The 400 TBN overbased oil-soluble calcium sulfonate was a good quality calcium sulfonate as defined by our recently issued U.S. Pat. No. 9,458,406. This overbased calcium sulfonate was also the same one used in the previous Example 1. Mixing without heat began using a planetary mixing paddle. Then 31.53 grams of a primarily C12 alkylbenzene sulfonic acid were added and allowed to mix in for 20 minutes. Then 31.24 grams of overbased magnesium sulfonate A was added and allowed to mix in. After mixing for 20 minutes, 75.08 grams of finely divided calcium carbonate with a mean particle size below 5 microns were added and allowed to mix in for 20 minutes. Then 0.91 grams of glacial acetic acid and 8.09 grams of 12-hydroxystearic acid were added. The mixture was stirred for 10 minutes. Then 40.51 grams water were added, and the mixture was heated with continued mixing to a temperature of 190 F to 200 F. This represents a temperature adjustment delay. The mixture was mixed at this temperature range for 30 minutes. This represents a holding delay. During that time, significant thickening had occurred, with a grease structure having formed. Fourier Transform Infrared (FTIR) spectroscopy indicated that conversion had partially occurred even though no hexylene glycol (non-aqueous converting agent) had yet been added. After the 30 minutes holding delay at 190 to 200 F, 30 ml water and 15.50 grams of hexylene glycol were added. Shortly after this, FTIR spectroscopy indicating that the conversion of the amorphous calcium carbonate to crystalline calcium carbonate (calcite) had occurred. The batch was stirred for 45 minutes. During that time the batch did not soften but actually became somewhat harder. Another 40 ml water were added followed by another 25.02 grams of the same calcium carbonate. After mixing for 20 minutes, 1.57 grams of glacial acetic acid, 31.94 grams of 12-hydroxystearic acid, and 10 ml water were added. These two complexing acids were allowed to react for 10 minutes. Then 25.0 grams of boric acid in 50 ml of hot water were slowly added and allowed to mix in and react.

The grease was then heated to 340 F. As the mixture was heated, the grease did not significantly soften. The heating mantle was removed from the mixer and the grease was allowed to cool while continuing to be mixed. The batch retained a grease texture as it was cooled. This was an obvious difference in behavior between this grease and the previous Example 1 grease. When the grease was cooled to 200 F. 2.20 grams of an aryl amine antioxidant was added. When the temperature was below 170 F, a sample was removed from the mixer and given passes through a three-roll mill. The milled grease had an unworked penetration of 219. Again, this result was extremely surprising when compared to the behavior of the previous Example 1 grease. Even though the previous Example 1 grease was very fluid at this point in the procedure (no significant grease texture), it exhibited unexpected rheopectic properties in that it milled to a much harder consistency. This indicates that the structure of this Example 2 grease is significantly less rheopectic than the structure of the Example 1 grease. Four more portions of the same base oil totaling 133.53 grams were added. The grease was then removed from the mixer and given three passes through a three-roll mill to achieve a final smooth homogenous texture. The grease had a worked 60 stroke penetration of 283. The percent overbased oil-soluble calcium sulfonate in the final grease was 30.27%. The dropping point was >650 F. Using the customary inverse linear relationship between worked penetration and percent overbased calcium sulfonate concentration, this example grease would have had a percent overbased calcium sulfonate concentration of 29.5% if additional base oil had been added to bring the worked penetration to the same value as the previous Example 1 grease. As can be seen, this grease had an improved thickener yield compared to the previous grease of Example 1.

Example 3—This Example is the same as Example 14 of U.S. Pat. No. 10,087,388 and Example 2 of U.S. Pat. No. 10,087,391), and was made similar to the previous Example 1 grease herein. However, there were some differences. First, this grease used the poor quality overbased calcium sulfonate used in most of the examples of U.S. Pat. No. 10,087,387. Second, the overbased magnesium sulfonate was intentionally not added until the initial base oil, overbased calcium sulfonate, and facilitating acid had been added and mixed for 20 minutes without any applied heat. This represents a facilitating acid delay period, like that employed in the previous Example 2 grease. Also like Example 2, this is also considered a delayed overbased magnesium sulfonate addition method with a holding delay and without a temperature adjustment delay. Normally, such short holding delays (20 minutes) are not considered a true holding delay. However, since the facilitating acid will react even at ambient temperature with either an overbased calcium or magnesium sulfonate, such a delay is considered to be a magnesium sulfonate delay period herein. Note again that this same delayed overbased magnesium sulfonate addition technique was done in the previous Example 2 grease. However, in a manner similar to Example 1, this grease used a 16.52 gram addition of a 75% solution of phosphoric acid in water instead of the addition of boric acid in water (as was used in Example 2). The final milled Example 3 grease had a worked 60 stroke penetration of 293. The percent overbased oil-soluble calcium sulfonate in the final grease was 26.78%. However, the dropping point was 520 F. It should be noted that, except for the inclusion of overbased magnesium sulfonate, this grease had a composition that was essentially the same as the greases of Examples 6-9 of U.S. Pat. No. 9,458,406. Those four greases also used the same poor quality overbased calcium sulfonate. The dropping points of those four greases were 496, 483, 490, and 509; the average value was 495 F. Although the dropping point of this Example 3 grease was low, it was somewhat higher than those four greases from U.S. Pat. No. 9,458,406. A summary of Examples 1-3 is provided below in Table 4.

TABLE 4

Summary of Examples 1-3

| | Example Number | | |
|---|---|---|---|
| | 1 | 2 | 3 |
| Overbased Calcium Sulfonate Quality | Good | Good | Poor |
| Overbased Magnesium Sulfonate used | A | A | A |
| Overbased Ca Sulfonate, % (wt) | 31.96 | 30.27 | 26.78 |
| Split Overbased Magnesium Sulfonate Addition Technique Used? | No | No | No |
| % (wt) Mg sulfonate added inititally relative to total Mg Sulfonate | 100 | 100 | 100 |
| Ratio of Overbased Ca Sulfonate to Overbased Mg Sulfonate in Pre-Conversion Grease | 90/10 | 90/10 | 90/10 |
| Ratio of Overbased Ca Sulfonate to Overbased Mg Sulfonate in Final Grease | 90/10 | 90/10 | 90/10 |
| Facilitating Acid Delay Method Used? | No | Yes | Yes |
| Reactive component present when DDBSA added | Overbased Ca Sulfonate; overbased Mg Sulfonate | Overbased Ca Sulfonate | Overbased Ca Sulfonate |
| Facilitating Acid Temp. Adj. Delay Used? | No | No | No |
| Facilitating Acid Holding delay Used? | Yes, 20 minutes | Yes, 20 minutes | Yes, 20 minutes |
| Holding Delay temperature, F. | 77 (ambient) | 77 (ambient) | 77 (ambient) |
| First delayed reactive component added after DDBSA | N/A | Overbased Mg Sulfonate | Overbased Mg Sulfonate |
| Non-aqueous converting agent Delayed Addition Method Used? | Yes | Yes | Yes |
| Holding Delay temperature, F. | 190-200 | 190-200 | 190-200 |
| Holding Delay time, minutes | 30 | 30 | 30 |
| Did partial conversion occur before non-aqueous converting agent added? | Yes | Yes | Yes |
| Worked 60 Stroke Penetration | 290 | 283 | 293 |
| Dropping Point, F. | 617 | >650 | 520 |

Example 4—This Example is the same as Example 3 of U.S. Pat. No. 10,087,391 and was made similar to the previous Example 1 grease herein. Like the Example 1 grease, this grease had a ratio of overbased calcium sulfonate to overbased magnesium sulfonate that was about 90/10. No facilitating acid delay method was used. All the overbased magnesium sulfonate was added at the beginning along with the overbased calcium sulfonate, before the facilitating acid was added. This Example 4 grease used the same good quality overbased calcium sulfonate as the Example 1 grease.

The only significant difference between this grease and the Example 1 grease was that this grease did not have any conventional non-aqueous converting agent added. Water was added as required to replace any water lost due to evaporation during the conversion process. Conversion was monitored by FTIR spectra and took 2 hours to complete. The conversion took place due only to water, the overbased magnesium sulfonate, and any effects due to the initial amounts of the pre-conversion complexing acids that were added. As the grease was heated to its top temperature, it significantly softened in a manner similar to the Example 1 grease. The grease texture was recovered upon milling, just as was observed in the Example 1 grease. This extreme rheopectic property has the same potential utility as mentioned in Example 1

Example 5—This Example is the same as Example 4 of U.S. Pat. No. 10,087,391 and was made similar to previous Example 4 grease herein. The only significant difference was that a poor quality overbased calcium sulfonate was used. The poor quality overbased calcium sulfonate was the same one used in previous Example 3 grease. Conversion was monitored by FTIR spectra and took 7 hours to complete.

Example 6—This Example is the same as Example 5 of U.S. Pat. No. 10,087,391 and was made similar to previous Example 5 grease herein. The only significant difference was that only about half the amount of overbased magnesium sulfonate was used. This grease used the same poor quality overbased calcium sulfonate as was used in previous examples of this document. Conversion was monitored by FTIR spectra and took 10.5 hours to complete. A summary of Examples 4-6 is provided below in Table 5.

TABLE 5

Summary of Example 4-6

| | Example Number | | |
|---|---|---|---|
| | 4 | 5 | 6 |
| Quality of Overbased Ca Sulfonate | Good | Poor | Poor |
| Overbased Magnesium Sulfonate used | A | A | A |
| Overbased Ca Sulfonate, % (wt) | 32.77 | 37.05 | 34.49 |
| Overbased Mg Sulfonate, % (wt) | 3.47 | 3.72 | 1.68 |
| Ratio of Overbased Ca Sulfonate to Overbased Mg Sulfonate in Final Grease | 90/10 | 90/10 | 95/5 |
| Ratio of Overbased Ca Sulfonate to Overbased Mg Sulfonate in Pre-Conversion Grease | 90/10 | 90/10 | 95/5 |
| Time to convert all amorphous CaCO3 to non-amorphous form, hours | 2 | 7 | 10.5 |
| Unworked Penetration | 280 | 289 | 267 |
| Worked 60 Stroke Penetration | 292 | 295 | 295 |
| Dropping Point, F. | >650 | 558 | 562 |
| Four Ball EP, Weld Load, kg | 500 | 500 | ND |
| Four Ball Wear | 0.37 | 0.37 | 0.38 |
| Roll Stability at 25 C., 2 hrs | | | |
| Initial worked 60 stroke penetration | 269 | 295 | 295 |
| Final worked 60 stroke penetration | 267 | 317 | 303 |
| % Change | −0.7 | 7.5 | 2.7 |
| Dropping Point after test, F. | 633 | 520 | 552 |

TABLE 5-continued

Summary of Example 4-6

| | Example Number | | |
|---|---|---|---|
| | 4 | 5 | 6 |
| Roll Stability at 150 C., 2 hrs | | | |
| Initial worked 60 stroke penetration | 269 | 295 | 295 |
| Final worked 60 stroke penetration | 281 | 301 | 291 |
| % Change | 4.5 | 2.0 | −1.4 |
| Dropping Point after test, F. | >650 | 583 | 574 |

Except for the inclusion of overbased magnesium sulfonate, the Example 4-6 greases herein had essentially the same composition as the greases of Examples 6-9 of U.S. Pat. No. 9,458,406. The Example 6-9 greases of U.S. Pat. No. 9,458,406 used the same poor quality overbased calcium sulfonate as the Example 5 and 6 greases. The only compositional difference was that the Example 4-6 greases herein contained overbased magnesium sulfonate. Although the dropping points of the Example 5 and 6 greases herein (which contained the poor quality overbased calcium sulfonate) were rather low, they were much improved over the Examples 6-9 greases of U.S. Pat. No. 9,458,406 (which also contained the same poor quality overbased calcium sulfonate). This again demonstrates the dropping point improvement that is due to the inclusion of an overbased magnesium sulfonate. It was apparent that the conversion process took much longer when poor instead of good quality overbased calcium sulfonate was used. However, the beneficial effect of the overbased magnesium sulfonate on conversion was apparent by comparing the required conversion times for Example 5 and 6 herein. When the concentration of overbased magnesium sulfonate was significantly reduced, the conversion time significantly increased. This shows that the overbased magnesium sulfonate is having a positive effect on conversion. Also, the dropping point of both Example 5 and 6 greases herein improved after being sheared at 150 C, as indicated by the roll stability test data. This again shows the potential beneficial effect of overbased magnesium sulfonate on improving high temperature structural stability when used at higher temperatures.

Another important observation is made by comparing the dropping point of the Example 3 grease (520 F) with the Example 5 (558 F) and 6 (562 F) greases. All three greases were compositionally similar. They all contained the same poor quality overbased calcium sulfonate and the same overbased magnesium sulfonate. They also contained the same complexing acids added in a similar way. There was only one significant compositional difference: the Example 3 grease contained a conventional non-aqueous converting agent whereas the Example 5 and 6 greases did not. Yet, the dropping points of the Example 5 and 6 greases were significantly higher than that of the Example 3 grease. This demonstrates that when a calcium/magnesium sulfonate complex grease is made using certain process techniques without a conventional converting agent, a higher dropping point is unexpectedly possible compared to a similar grease made with a conventional converting agent.

Example 7—Another calcium magnesium sulfonate grease was made similar to the previous Example 5 grease herein, using the calcium carbonate as described in U.S. Pat. No. 9,273,265, a ratio of overbased calcium sulfonate to overbased magnesium sulfonate of about 90/10, and adding all the overbased magnesium sulfonate at the beginning. However, there were two significant differences. First, no 12-hydroxystearic acid was added. Instead, hydrogenated castor oil (HCO) was added in a total amount that provided a molar equivalent amount of 12-hydroxystearic acid groups, assuming that the tri-acyl glyceride structure of HCO was composed entirely of 12-hydroxystearate groups. The amount of HCO added before conversion was 33% of the total amount of HCO added, with the remaining amount added after conversion but before heating to top temperature. Second, a small amount of sodium hydroxide was dissolved in the water that was added to the grease after the conversion process. The concentration of sodium hydroxide (on an unreacted basis) in the final grease was 0.05%. This is a form of the technique described in U.S. Pat. No. 9,976,102. Note that the alkali hydroxide addition method was not used in any of the previous example greases. Additionally, the batch size of this grease was about 50% larger than that of the previous examples.

Like, the Example 5 grease herein, this grease did not use any hexylene glycol as a conventional non-aqueous converting agent. Also like the Example 5 grease, this grease had the overbased calcium sulfonate and overbased magnesium sulfonate added with an initial amount of the base oil. Then the primary C12 alkylbenzene sulfonic acid (facilitating acid) was added.

The grease was made as follows: 465.7 grams of 400 TBN overbased oil-soluble calcium sulfonate were added to an open mixing vessel. Then 47.9 grams of overbased magnesium sulfonate A were added and allowed to mix in for 15 minutes followed by 521.0 grams of a solvent neutral group 1 paraffinic base oil having a viscosity of about 600 SUS at 100 F. Note that the order of addition of the overbased magnesium sulfonate and base oil was reversed from the previous examples. This variation will have no effect on the final grease since only non-reactive mixing should occur at this point in the procedure. The 400 TBN overbased oil-soluble calcium sulfonate was a poor quality calcium sulfonate as defined by our recently issued U.S. Pat. No. 9,458,406. Mixing without heat began using a planetary mixing paddle. Then 46.3 grams of a primarily C12 alkylbenzene sulfonic acid (facilitating acid) were added. After mixing for 20 minutes, 114.6 grams of finely divided calcium carbonate with a mean particle size below 5 microns were added and allowed to mix in for 20 minutes. Then 12.64 grams of hydrogenated castor oil (HCO) were added followed by 1.26 grams of glacial acetic acid. Then 65.0 grams water was added and the batch was heated to 190 F to 200 F. Almost as soon as the heating began, the batch noticeably thickened. However, it thinned out by the time the temperature had reached 150 F. Once the batch temperature had reached 190 F, during the next approximately 5.5 hours, nine portions of water totaling 214 grams were added to the batch as FTIR spectroscopy indicated that water was being depleted due to evaporation.

During this time, FTIR indicated that conversion was slowly occurring, but was not complete. When the batch had first reached 190 F, the FTIR spectrum showed that a dominant peak at about 874 $cm^{-1}$ with a distinct shoulder at 862 $cm^{-1}$ and the beginnings of a shoulder at 882 $cm^{-1}$. After the 5.5 hours of mixing at 190-200 F. the shoulder at 882 $cm^{-1}$ had grown to be the primary peak. The peak at 874 cm 1 had decreased significantly and was only barely resolved. The shoulder at 862 $cm^{-1}$ (representing the original amorphous calcium carbonate) was slight, indicating that most of the amorphous calcium carbonate had converted to crystalline calcium carbonate.

The intermediate peak at 874 $cm^{-1}$ is commonly observed during the conversion process of calcium sulfonate-based greases. Depending on minor variations in the grease being made, this intermediate peak can be observed within the range of about 872 $cm^{-1}$ to 877 $cm^{-1}$. For ease of documentation, this intermediate peak will hereafter be assigned a value of 874 $cm^{-1}$ with the understanding that the aforementioned variation is normal within calcium sulfonate-based grease batches. Complete conversion to the desirable dispersion of crystalline calcium carbonate (calcite) is typically evidenced by the elimination of the original amorphous calcium carbonate peak at 862 $cm^{-1}$, and the establishment of a new single peak at about 882 $cm^{-1}$. The intermediate peak at about 874 $cm^{-1}$ that occurs during the conversion process is typically first formed and then eliminated when conversion is complete. However, added powdered calcium carbonate such as is used in these examples will form a peak at about 874 $cm^{-1}$ in calcium sulfonate-based greases. Thus, when powdered calcium carbonate is added before conversion, complete conversion will be evidenced by an FTIR spectra showing a single peak at about 882 $cm^{-1}$ with a small shoulder at about 874 $cm^{-1}$. The heat was removed and the batch was cooled to 160 F. Then mixing was stopped, and the batch remained undisturbed for about 16 hours.

The next morning the batch was heated again to 190 F to 200 F with mixing. When the target temperature range had been reached, the FTIR spectra had not changed. In an effort to drive conversion as shown by FTRI spectra to completion, another 25.53 grams of HCO were added followed by 60.0 grams water to which 0.6 grams sodium hydroxide had been dissolved. After about 2 hours and 45 minutes of mixing at 190 F to 200 F, FTIR spectroscopy indicated that only a modest progress in conversion had occurred. The primary peak at 882 $cm^{-1}$ and the small and barely resolved peak at 872 $cm^{-1}$ were still present and appeared unchanged from the previous FTIR. However, most of the remaining amorphous calcium carbonate was gone. This was evidenced by fact that the shoulder at 862 $cm^{-1}$ was almost gone. The total time to bring the conversion process to this point was about 9 hours and 12 minutes.

Despite the conflicting FTIR results, the decision was made to proceed with the next step in making this grease. Accordingly, 2.46 grams of glacial acetic acid were added and allowed to mix into the grease for 30 minutes. Then 24.61 grams of a 75% solution of phosphoric acid in water were slowly added and allowed to mix in and react. The grease was then heated to 390 to 400 F. During this time, the batch did not thin out but retained a distinct grease texture. In this regard, this Example 7 grease was unlike the previous examples that had the observed and unexpected rheopectic property. When the grease reached the target top temperature, the heating mantle was removed from the mixer and the grease was allowed to cool while continuing to be mixed. When the temperature was about 160 F, a portion of the batch was removed and allowed to cool undisturbed. The unworked penetration of this unmilled sample was 265. The remaining batch was allowed to cool without mixing until the next morning. Then the batch was heated to about 160 F and then given a single pass through a laboratory-scale colloid mill with the gap set at 0.005 inches. Once the milled grease had cooled, the unworked and worked 60 stroke penetrations were measured. The milled grease had unworked penetration of 255 and a worked 60 stroke penetration of 279. The dropping points of the unmilled and milled grease were 581 and 580, respectively. The percent overbased oil-soluble calcium sulfonate in the final grease was 36.88%.

Three things are to be noted concerning this example grease. First, although the thickener yield was not as good as any of the previous examples, the dropping point was significantly improved over those greases for which the same poor quality overbased calcium sulfonate was used. As already discussed concerning the Example 6 grease, the use of overbased magnesium sulfonate can improve dropping point in greases where poor quality overbased calcium sulfonate is used and where the complexing acids are those use in that grease (12-hydroxystearic acid, acetic acid, and phosphoric acid). The Example 7 grease herein used the same poor quality overbased calcium sulfonate and used the same complexing acids as the Example 6 grease. However, this Example 7 grease demonstrates that even further dropping point improvement can be obtained when HCO is incorporated into the grease in the manner described.

A second thing to be noted is that the rheopectic property previously observed was not observed in this Example 7 grease. Instead, the unmilled and milled grease had similar penetration consistencies, indicating minimal effect of milling. This can be considered to be the opposite effect as what was observed in the greases of Examples 1, 3, 4, 5, and 6. In those examples, the unmilled grease had little or no significant grease texture, but became a very firm grease when milled. The milling had a profound effect on the penetration consistency of those greases. Even in typical prior art sulfonate based greases (where the unexpected rheopectic property is not found), milling is typically required to achieve a smooth grease finish and imparts some increase in thickening as evidenced by penetration value. However, that was not the case with Example 7, which did not benefit from milling. Thus, the use of a glycerol derivative (HCO in this example) provides the potential advantage of imparting an optimally dispersed thickener system in the grease without the milling process step typically required.

The third thing to be noted is that FTIR spectra during the making of this grease, as well as the FTIR spectra of the final grease, indicated that most of the HCO had hydrolyzed with the resulting 12-hydroxystearic acid reacting with calcium carbonate to form the corresponding calcium salt thickener component.

Example 8—Another calcium/magnesium sulfonate complex grease was made similar to the previous Example 5 grease herein. However, there were two significant differences. First, no 12-hydroxystearic acid was added. Instead, glycerol mono-oleate (GMO) was added in a total amount that provided oleic acid groups in an amount that was the molar equivalent of the 12-hydroxystearic groups in the Example 5 grease. The amount of GMO added before conversion was 33% of the total amount of GMO added, with the remaining amount added after conversion but before heating to top temperature. Second, a small amount of sodium hydroxide was dissolved in the water that was added to the grease after the conversion process. The concentration of sodium hydroxide (on an unreacted basis) in the final grease was 0.04%. This is a form of the alkali metal hydroxide addition method described in U.S. Pat. No. 9,976,102, which was also used in the Example 7 grease, but not in the making of the Example 1-6 greases herein.

Additionally, the batch size of this grease was about twice that of the previous Example 1-6 greases. Like, the Example 5 and 7 greases, this grease did not use any hexylene glycol as a conventional non-aqueous converting agent. Also like the Example 5 and 7 greases, this grease had the overbased calcium sulfonate and overbased magnesium sulfonate added with an initial amount of the base oil. Then the primary C12 alkylbenzene sulfonic acid (facilitating acid) was added.

The grease was made as follows: 618.6 grams of 400 TBN overbased oil-soluble calcium sulfonate were added to an open mixing vessel. Then 61.26 grams of overbased magnesium sulfonate A were added and allowed to mix in for 15 minutes followed by 680.1 grams of a solvent neutral group 1 paraffinic base oil having a viscosity of about 600 SUS at 100 F. Note that the order of addition of the overbased magnesium sulfonate and base oil was reversed from the previous examples. This variation will have no effect on the final grease since only non-reactive mixing should occur at this point in the procedure. The 400 TBN overbased oil-soluble calcium sulfonate was a poor quality calcium sulfonate as defined by our recently issued U.S. Pat. No. 9,458,406. Mixing without heat began using a planetary mixing paddle. Then 62.52 grams of a primarily C12 alkylbenzene sulfonic acid (facilitating acid) were added. After mixing for 20 minutes, 151.51 grams of finely divided calcium carbonate with a mean particle size below 5 microns were added and allowed to mix in for 20 minutes. Then 17.12 grams of glycerol mono-oleate (GMO) were added followed by 1.81 grams of glacial acetic acid. Then 81.49 grams water was added and the batch was heated to 190 F to 200 F. As the heating began, the batch quickly thickened. However it quickly thinned out as the temperature reached 160 F. Another 10.0 grams of water was added during the time it was being heated to 190 to 200 F. By the time the batch had reached the target temperature range, it had become very thin with no significant grease texture. By the time the batch had reached the target temperature range, it had become very thin with no significant grease texture.

During the next approximately two hours, four portions of water totaling 44 grams were added to the batch as FTIR spectroscopy indicated that water was being depleted due to evaporation. During this time, FTIR indicated that conversion was slowly occurring. However, only minor thickening was evident. The batch was bubbling in a way that had not been observed in the previous Example 7 grease. After the two hours of mixing at 190-200 F, the FTIR spectra was no longer progressing towards conversion. The FTIR peak at 882 $cm^{-1}$ was dominant. However, there was a smaller but distinct peak at about 874 $cm^{-1}$. Also, a small amount of the original peak at 862 $cm^{-1}$ (due to amorphous calcium carbonate) was still present as a noticeable shoulder. Another 36.24 grams of GMO were added followed by 57.8 grams water in which 0.68 grams sodium hydroxide had been dissolved. After almost one hour, FTIR indicated that the conversion process had significantly progressed but was still not complete. The peaks at 874 $cm^{-1}$ and 862 $cm^{-1}$ were smaller, but were not being eliminated with additional mixing. The appearance of the batch had also improved, with a significant grease structure now apparent. Since the conversion process had appeared to stall with no further progress being made, 2.77 grams of acetic acid was added and allowed to react for 30 minutes. Then 33.96 grams of a 75% solution of phosphoric acid in water were slowly added and allowed to mix in and react. The grease was then heated to 390 to 400 F. During this time, the batch had thinned out by the time it had reached 300 F. After reaching the top temperature range, the batch was cooled to about 160 F. The batch was still very thin with almost all grease structure gone. The batch was given a single pass through a laboratory-scale colloid mill with the gap set at 0.005 inches. The final batch had an unworked penetration of 453, indicating virtually no grease structure was present.

As with the previous Example 7 grease, the FTIR spectra during the making of this grease as well as the FTIR spectra of the final product indicated that most of the GMO had hydrolyzed with the resulting oleic acid reacting with calcium carbonate to form the corresponding calcium salt thickener component.

Example 9—Since the previous Example 8 failed to provide an acceptable grease structure, another calcium/magnesium sulfonate complex grease was made similar to the previous Example 8 grease. Like the Example 8 grease, no 12-hydroxystearic acid was added. Instead, glycerol mono-oleate (GMO) was added. Also like the Example 8 grease, this grease had the overbased calcium sulfonate and overbased magnesium sulfonate added with an initial amount of the base oil. Then the primary C12 alkylbenzene sulfonic acid (facilitating acid) was added.

However, there were several differences between this grease and the previous Example 8 grease. First, sodium hydroxide was not used in this grease. Second, after the conversion process had stalled, hexylene glycol was added as a non-aqueous converting agent. Third, the heating steps during conversion were different, allowing for some higher temperatures for part of the overall conversion process. Finally, only the initial, pre-conversion portion of GMO was added. No second portion of GMO was added after conversion.

The grease was made as follows: 622.7 grams of 400 TBN overbased oil-soluble calcium sulfonate were added to an open mixing vessel. Then 62.27 grams of overbased magnesium sulfonate A were added and allowed to mix in for 15 minutes followed by 689.0 grams of a solvent neutral group 1 paraffinic base oil having a viscosity of about 600 SUS at 100 F. The 400 TBN overbased oil-soluble calcium sulfonate was a poor quality calcium sulfonate as defined by our recently issued U.S. Pat. No. 9,458,406. Mixing without heat began using a planetary mixing paddle. Then 62.59 grams of a primarily C12 alkylbenzene sulfonic acid (facilitating acid) were added. After mixing for 20 minutes, 152.86 grams of finely divided calcium carbonate with a mean particle size below 5 microns were added and allowed to mix in for 20 minutes. Then 18.54 grams of Glycerol mono-oleate (GMO) were added followed by 2.04 grams of glacial acetic acid. Then 88.25 grams water was added and the batch was heated to 190 F to 200 F. As the heating began, the batch quickly thickened. However it quickly thinned out as the temperature reached 165 F. By the time the batch had reached the target temperature range, it had become very thin with no significant grease texture. FTIR showed that the dominant conversion-related peak was at 874 $cm^{-1}$ with most of the original 862 $cm^{-1}$ peak still present as a pronounced shoulder. This behavior was similar to the previous Example 8 grease. During the next approximately 5 hours, six portions of water totaling 267 grams were added to the batch as FTIR spectroscopy indicated that water was being depleted due to evaporation. During this time, FTIR indicated that conversion was slowly occurring. After about 45 minutes at 190-200 F, a peak at about 882 $cm^{-1}$ began to appear. After about 2 of the 5 hours of mixing at the target temperature range, the FTIR peak at 882 $cm^{-1}$ became larger than the intermediate peak at 874 $cm^{-1}$. The batch became progressively thicker during this 5 hours of mixing. However, there was still a smaller but resolved peak at 874 $cm^{-1}$. After the 5 hours of mixing at 190-200 F, the batch was heated to 260 F. During this heating step, the batch evidenced bubbling due to the boiling off of the water. Then two additions of water totaling 107 grams were added. The peak at 874 $cm^{-1}$ only was slightly reduced. The batch was stirred and the heating mantle was removed to allow cooling to occur. Mixing was stopped, and the batch was allowed to sit undisturbed for 16 hours.

Then the batch was heated back to 230 F and 20 grams water was added. The temperature of the batch was lowered to about 200 F. After 90 minutes, another 61.3 grams of water was added. An FTIR spectra indicated no further significant progress had been made in the conversion process. A 29.65 gram portion of hexylene glycol was added to the batch. Within a few minutes, the batch had noticeably thickened. An FTIR spectra showed that almost all the conversion-related peaks except the 882 $cm^{-1}$ peak were gone. Only a noticeable shoulder at 874 $cm^{-1}$ was present. After adding another 41.89 grams of water and stirring for about 30 minutes, FTIR spectra indicated conversion to be complete. The total time to bring the conversion process to this point was about 7 hours and 50 minutes.

Then 3.19 grams of acetic acid was added followed by 32.95 grams 12-hydroxystearic acid. The batch was allowed to mix at 190 F to 200 F for 30 minutes. Then 34.09 grams of a 75% solution of phosphoric acid in water were slowly added and allowed to mix in and react. The grease was then heated to 390 to 400 F. During this time, the batch did not thin out like the previous Example 8 batch. After reaching the top temperature range, the batch was cooled to about 160 F. The batch was given a single pass through a laboratory-scale colloid mill with the gap set at 0.005 inches. The final batch had an unworked penetration of 295 and a worked 60 stroke penetration of 315. The dropping point was 550 F. The percent overbased calcium sulfonate in the final grease was 36.42%.

As with the previous Example 8, the FTIR spectra during the making of this grease as well as the FTIR spectra of the final product indicated that most of the GMO had hydrolyzed with the resulting oleic acid reacting with calcium carbonate to form the corresponding calcium salt thickener component. As can be seen, this Example 9 grease had a much greater thickener yield than the previous Example 8. In fact, the thickener yield was essentially the same as the Example 7 grease that used HCO instead of GMO.

Example 10—Another calcium/magnesium sulfonate complex grease was made similar to the previous Example 9 grease herein. However, there were several important differences. First, glycerol monostearate (GMS) was used instead of glycerol mono-oleate. Second, 12-hydroxystearate and acetic acid were both added before and after conversion in the same way as was done with the Example 1-6 greases. In making this change, the primary complexing acids both pre and post-conversion were 12-hydroxystearic acid and acetic acid. Any complexing acid formed during the hydrolysis of the GMS (to form stearic acid) was considered to be additional complexing acid instead of a substitute for the 12-hydroxystearic acid. Like the previous Example 9 grease, hexylene glycol was added as the primary converting agent only after the conversion process had proceeded to the point where no further progress was being made.

The grease was made as follows: 620.18 grams of 400 TBN overbased oil-soluble calcium sulfonate were added to an open mixing vessel. Then 62.26 grams of overbased magnesium sulfonate A were added and allowed to mix in for 15 minutes followed by 689.9 grams of a solvent neutral group 1 paraffinic base oil having a viscosity of about 600 SUS at 100 F. The 400 TBN overbased oil-soluble calcium sulfonate was a poor quality calcium sulfonate as defined by our recently issued U.S. Pat. No. 9,458,406. Mixing without heat began using a planetary mixing paddle. Then 70.61 grams of a primarily C12 alkylbenzene sulfonic acid (facilitating acid) were added. After mixing for 20 minutes, 155.38 grams of finely divided calcium carbonate with a mean particle size below 5 microns were added and allowed to mix in for 20 minutes. Then 17.48 grams of glycerol monostearate (GMS) were added. This was followed by the addition of 16.63 grams of 12-hydroxystearic acid and 1.74 grams of glacial acetic acid. Then 80.4 grams water was added and the batch was heated to 190 F to 200 F. As the heating began, the batch quickly thickened. However it had thinned out as the temperature reached 195 F. As the batch continue to mix at the target temperature range, it began to thicken. Over the next 3.5 hours, five portions of water totaling 100.0 grams was added. At the end of this time, FTIR spectra showed that conversion was mostly complete. However, there was a small but distinct peak at 874 $cm^{-1}$ that had not yet been eliminated. Also, a small but distinct shoulder at 662 $cm^{-1}$ indicated that some of the amorphous calcium carbonate had not yet been converted. A 30.0 gram portion of water and a 28.40 gram portion of hexylene glycol were added to the batch. Within a few minutes, the batch had further thickened. Within 30 minutes, an FTIR spectra showed that conversion was essentially complete. The total time to bring the conversion process to this point was about 4 hours and 34 minutes. The batch was cooled and mixing was stopped.

After 16 hours, the batch was heated back to 190 F to 200 F. Then 32.46 grams 12-hydroxystearic acid and 61.25 grams water were added to the batch and allowed to mix in. Then 3.22 grams of acetic acid were added. The batch was mixed for 30 minutes. Then 32.66 grams of a 75% solution of phosphoric acid in water were slowly added and allowed to mix in and react. The grease was then heated to 390 to 400 F and then cooled to 160 F. During this time, the batch did not thin out. Instead as the batch cooled it became very heavy. Two portions of the same paraffinic bases oil totaling 181.68 grams were added to the batch. A portion of the batch was given a single pass through a laboratory-scale colloid mill with the gap set at 0.005 inches. The final unmilled grease had an unworked penetration of 235 and a worked 60 stroke penetration of 235. The dropping point was 587 F. The milled grease had an unworked penetration of 221 and a worked 60 stroke penetration of 247. The dropping point was 587 F. The percent overbased calcium sulfonate in the final grease was 32.4%. Using the customary inverse linear relationship between penetration and percent overbased calcium sulfonate concentration, this unmilled Example 10 grease would have had a percent overbased calcium sulfonate concentration of 28.7% if its penetration values were the same as the previous Example 7 grease. Similarly, this milled Example 10 grease would have had the same percent overbased calcium sulfonate concentration of 28.7% if its worked penetration value was the same as the Example 7 grease.

As with the previous Example 7-9 greases, the FTIR spectra during the making of this grease as well as the FTIR spectra of the final product indicated that most of the added glycerol derivative had hydrolyzed with the resulting long chain fatty acid reacting with calcium carbonate to form the corresponding calcium salt thickener component.

Three things are to be noted regarding the results of this grease. First, on an equal penetration basis, GMS appears to be much more effective than GMO with regard to thickener yield. Second, milling has little or no effect on the actual thickener yield as evidenced by the similar penetrations of the unmilled and milled greases. In fact, using the Example 7 grease as the basis for comparison, the unmilled and milled Example 10 grease have exactly the same thickener yield. This is similar to what was observed in Example 7. Finally, once again the dropping point is higher than what has been typically observed when calcium carbonate-based calcium sulfonate complex greases are made with poor quality overbased calcium sulfonates and with 12-hydroxystearic acid, acetic acid, and phosphoric acid as the complexing acids. These three observations are surprising and unexpected.

The ability of the glycerol derivative (GMS) to disperse the thickener to the extent that milling provides no further significant thickening can also be observed using oscillatory rheometry. FIG. 1 provides results of an oscillatory rheometry amplitude sweep at 25 C of the Example 10 unmilled and milled greases. The storage modulus (G') curves represent the structural effect of the dispersed phase (thickener system) of the grease during the test. The loss modulus (G") curves represent the structural effect of the non-dispersed, continuous phase (base oil system) of the grease during the test. As can be seen, the G' and G" curves for the unmilled grease overlay the G' and G" curves of the milled grease. Furthermore, the crossover points for the G' and G" curves, which is a measure of the mechanical stability of the grease structure, are the same for both the unmilled and milled greases. This information supports the observation that the glycerol derivative has imparted a milling effect on the grease without the actual use of a mechanical mill.

Example 11—So as to further determine the role of the conventional non-aqueous converting agent on the final grease properties, another batch was made identical to the previous Example 10 grease except for one thing: this grease used only half the amount of hexylene glycol. The total time to bring the conversion process to its final point was 4 hours and 46 minutes. The final unmilled grease had an unworked penetration of 255 and a worked 60 stroke penetration of 257. The dropping point was 540 F. The milled grease had an unworked penetration of 225 and a worked 60 stroke penetration of 247. The dropping point was 567 F. The percent overbased calcium sulfonate in the final grease was 32.82%. Comparing the penetration values of this grease to the previous Example 10 grease, it can be seen that halving the concentration of the non-aqueous converting agent somewhat reduced the thickener yield of the unmilled grease but had no significant effect on the thickener yield of the milled grease.

Example 12—Another calcium/magnesium sulfonate grease was made similar to the previous Example 10 grease herein. However, there were several important differences. First, the facilitating acid was added after the initial base oil and overbased calcium sulfonate but before the overbased magnesium sulfonate. This is a form of the facilitating acid delay method described in U.S. Pat. No. 10,087,388. Note that this technique was also used in the previous baseline Examples 2 and 3, but was not used in Examples 7-11 herein. Second, twice the total amount of powdered calcium carbonate was added. The pre-conversion amount was about the same as Example 10. However, a second equal portion was added post-conversion. Finally, the total amount of 12-hydroxystearic acid was correspondingly increased.

The grease was made as follows: 616.66 grams of 400 TBN overbased oil-soluble calcium sulfonate were added to an open mixing vessel followed by 506.64 grams of a solvent neutral group 1 paraffinic base oil having a viscosity of about 600 SUS at 100 F. The 400 TBN overbased oil-soluble calcium sulfonate was a poor quality calcium sulfonate as defined by our recently issued U.S. Pat. No. 9,458,406. Mixing without heat began using a planetary mixing paddle. Then 61.63 grams of a primarily C12 alkylbenzene sulfonic acid (facilitating acid) were added. After mixing for 20 minutes, 61.39 grams of overbased magnesium sulfonate A were added and allowed to mix in for 15 minutes. Then 149.27 grams of finely divided calcium carbonate with a mean particle size below 5 microns were added and allowed to mix in for 20 minutes. Then 17.68 grams of glycerol monostearate (GMS) were added. This was followed by the addition of 54.05 grams of 12-hydroxystearic acid and 1.66 grams of glacial acetic acid. Then 81.70 grams water was added and the batch was heated to 190 F to 200 F. As the heating began, the batch quickly thickened. However by the time the batch had reached the target temperature range, it had thinned out.

Over the next 3 hours and 39 minutes, seven portions of water totaling 262.8 grams were added. During this mixing time the batch progressively became thicker until it was very thick. However, the FTIR scans had shown that the conversion process had stalled. The FTIR spectra at the end of the 3 hour and 39 minute mixing time showed only a small peak at 882 $cm^{-1}$ (representing full conversion). A larger peak at 874 $cm^{-1}$ had a large and wide shoulder centered at the original 862 $cm^{-1}$ peak (amorphous calcium carbonate). This FTIR spectra typically indicates only a small amount of conversion with almost no visible grease structure. However, the batch was very thick with a well-developed grease structure. This behavior had never been observed before in any of the example greases represented by any of the U.S. Patent applications or their issued patent counterparts mentioned in this document. Since conversion as represented by FTIR appeared to be stalled, a 30.1 gram portion of water and a 31.68 gram portion of hexylene glycol were added to the batch. Within a few minutes, the batch had further thickened. Because the batch became so heavy, an additional 67.86 grams of the same paraffinic base oil was added. However, after 30 minutes, an FTIR spectra showed no further change. Because of this, the conversion process was determined to have proceeded as far as it was likely to go. The total time to get to this extent of conversion was 4 hours and 22 minutes. The batch was cooled and mixing was stopped.

After 16 hours, the batch was heated back to 190 F to 200 F. Because the batch was so heavy, 80.06 grams of the same paraffinic base oil was added. Then 154.56 grams of the same powdered calcium carbonate was added and allowed to mix in for 20 minutes. Then 107.15 grams 12-hydroxystearic acid and 2.87 grams of acetic acid were added to the batch and allowed to mix in until no further thickening was observed. During this time, two portions of the same paraffinic base oil totaling 194.03 grams were added. Then 32.95 grams of a 75% solution of phosphoric acid in water were slowly added and allowed to mix in and react. The grease was then heated to 390 to 400 F. During this time, the batch thinned out somewhat, but retained a grease consistency. As soon as the batch temperature reached 390 F, the heating mantle was removed, and the batch was cooled to 160 F. As the batch cooled, it became heavy again. An 82.41 gram portion of the same paraffinic base oil was added. When the batch reached 160 F. a portion of the batch was given a single pass through a laboratory-scale colloid mill with the gap set at 0.005 inches. The rest of the batch was stored without milling. The final unmilled grease had an unworked penetration of 225 and a worked 60 stroke penetration of 267. The dropping point was 567 F. The milled grease had an unworked penetration of 235 and a worked 60 stroke penetration of 273. The dropping point was 541 F. The percent overbased calcium sulfonate in the final grease was 27.75%. The conversion-related FTIR peaks of the final grease were the same as what had been observed when conversion had been considered to have gone as far as possible.

As with the previous Example 7-11 greases herein, the FTIR spectra during the making of this grease as well as the FTIR spectra of the final product indicated that most of the added glycerol derivative had hydrolyzed with the resulting long chain fatty acid reacting with calcium carbonate to form the corresponding calcium salt thickener component.

Four things are to be noted regarding the results of this grease. First, this grease had a superior thickener yield compared to all the previous Example greases when compared on an equal worked penetration basis. Second, milling once again had little or no effect on the actual thickener yield as evidenced by the similar penetrations of the unmilled and milled greases. This is similar to what was observed in Examples 7, 10, and 11. Third, the good thickener yield occurred despite an FTIR spectra that would normally be interpreted as evidence of poor conversion by anyone with ordinary skill in the art. Finally, once again the dropping point is higher than what has been typically observed when calcium carbonate-based calcium sulfonate complex greases are made with poor quality overbased calcium sulfonates and with 12-hydroxystearic acid, acetic acid, and phosphoric acid as the complexing acids. In fact, the unmilled grease had a higher dropping point than the milled grease. These four observations are surprising and unexpected.

Figure 2:
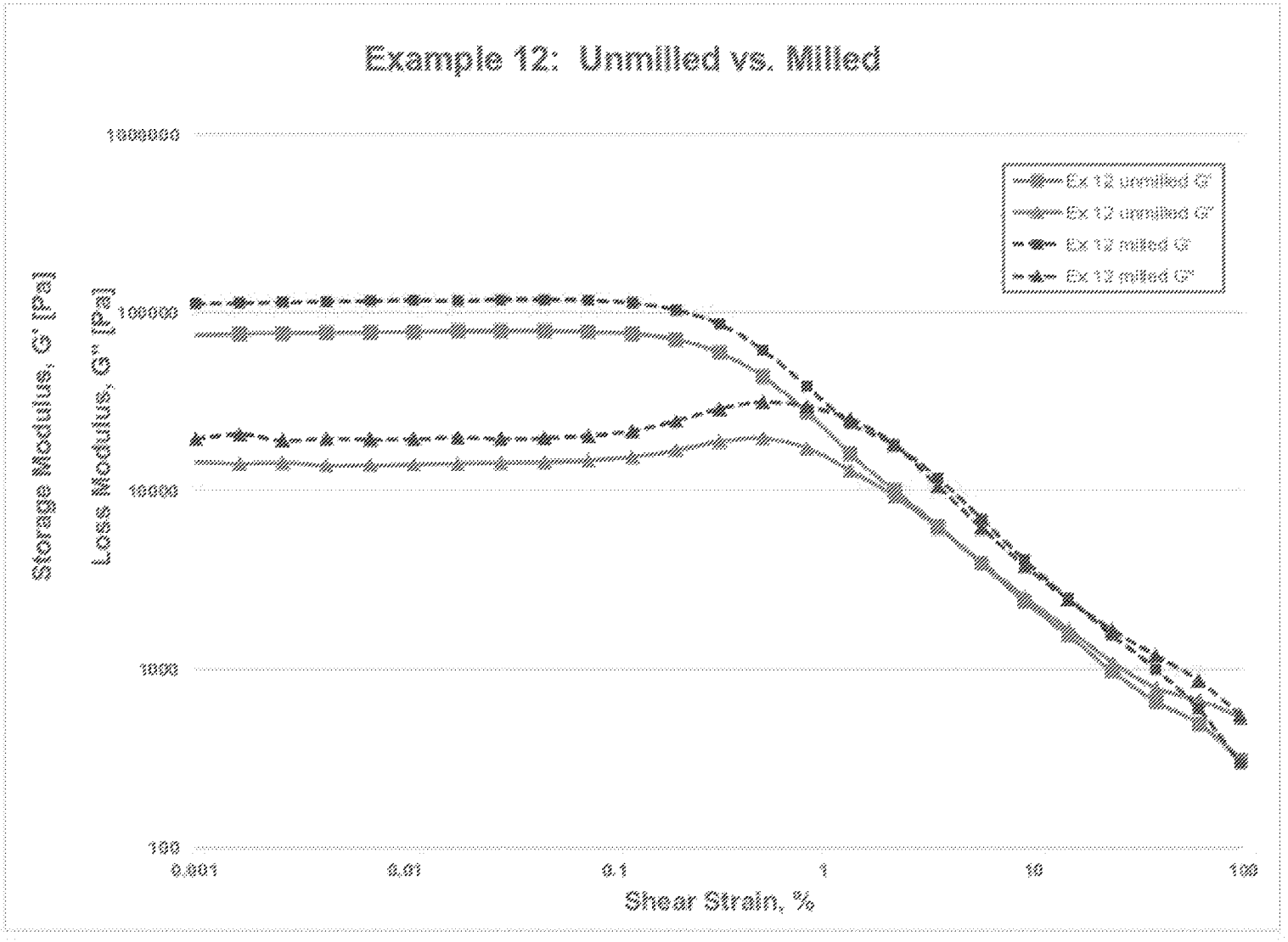
FIG. 2 is a graph showing results of an oscillatory rheometry amplitude sweep at 25 C of the Example 12 unmilled and milled greases.

Additional information concerning the effect of the glycerol derivative (GMS) on the thickener dispersion of the grease can be observed using oscillatory rheometry. An amplitude sweep was run at 25 C. Results as provided in FIG. 2. The G' and G" curves for the unmilled and milled grease do not exactly overlay each, but they are close to each other. This corresponds to the penetration values of the two greases where the milled grease was slightly harder than the unmilled grease. However, the crossover point of the G' and G" curves for the unmilled and milled greases are at almost the same relative shear strain value, indicating that the structural stability of both greases are similar.

Example 13—Another calcium/magnesium sulfonate complex grease was made similar to the previous Example 12 grease herein. There was only one difference: the delay in facilitating acid technique used in the previous Example 12 grease was not employed. Instead, the facilitating acid was added after the overbased calcium sulfonate, overbased magnesium sulfonate, and initial base oil had been added and mixed.

It should also be noted that pre-conversion, this Example 13 grease is essentially the same as the pre-conversion Example 10 grease except for one factor: this Example 13 grease had a much higher pre-conversion concentration of 12-HSA compared to the Example 10 grease.

The grease was made as follows: 625.5 grams of 400 TBN overbased oil-soluble calcium sulfonate were added to an open mixing vessel followed by 505.7 grams of a solvent neutral group 1 paraffinic base oil having a viscosity of about 600 SUS at 100 F. The 400 TBN overbased oil-soluble calcium sulfonate was a poor quality calcium sulfonate as defined by our recently issued U.S. Pat. No. 9,458,406. Mixing without heat began using a planetary mixing paddle. Then 62.4 grams of overbased magnesium sulfonate A were added and allowed to mix in for 15 minutes. Then 61.2 grams of a primarily C12 alkylbenzene sulfonic acid (facilitating acid) were added. After mixing for 20 minutes, 150.9 grams of finely divided calcium carbonate with a mean particle size below 5 microns were added and allowed to mix in for 20 minutes. Then 17.43 grams of glycerol monostearate (GMS) were added. This was followed by the addition of 52.80 grams of 12-hydroxystearic acid and 1.45 grams of glacial acetic acid. Then 82.10 grams water was added and the batch was heated to 190 F to 200 F. As the heating began, the batch quickly thickened. However by the time the batch had reached the target temperature range, it had thinned out.

Over the next approximately 6 hours, nine portions of water totaling 270 grams were added. During this mixing time the batch progressively became thicker. However, the FTIR scans had shown that the conversion process had stalled. The FTIR spectra at the end of the nearly 6 hour mixing time showed only a small peak at 882 $cm^{-1}$ (representing full conversion). A larger peak at 874 $cm^{-1}$ had a large and wide shoulder centered at the original 862 $cm^{-1}$ peak (amorphous calcium carbonate). This FTIR spectra typically indicates only a small amount of conversion with almost no visible grease structure. However, the batch was very thick with a well-developed grease structure. This is the same thickening and FTIR spectral behavior observed in the previous Example 12 grease. However, as already mentioned, this behavior had never been observed before in any of the example greases represented by any of the U.S. Patent applications or their issued patent counterparts mentioned in this document. The heating mantle was removed from the mixer, and the batch was allowed to mix for about 25 minutes. Then the mixing was stopped, and the batch remained undisturbed for 16 hours. The batch was then heated with mixing to 190 F to 200 F. Since conversion as represented by FTIR appeared to be stalled, an 80 gram portion of water and a 31.3 gram portion of hexylene glycol were added to the batch. Within a few minutes, the batch had further thickened by an excessive amount. Because the batch became so heavy, three portions of the same paraffinic base oil totaling 456.87 grams was added. After one hour, an FTIR spectra showed conversion to be virtually complete. The original amorphous calcium carbonate peak at 862 $cm^{-1}$ was gone. Only a discernable shoulder at 874 $cm^{-1}$ remained. The total conversion time at 190-200 F up to this point was 8 hours and 18 minutes.

After allowing the batch to mix for about one more hour, 42.02 grams of water and 149.39 grams of the same powdered calcium carbonate were added and allowed to mix in for 20 minutes. Then 107.39 grams 12-hydroxystearic acid and 3.93 grams of acetic acid were added to the batch and allowed to mix in until no further thickening was observed. Then 34.61 grams of a 75% solution of phosphoric acid in water were slowly added and allowed to mix in and react. The grease was then heated to 390 to 400 F and then cooled. As the batch cooled, it appeared to become heavier. Three portions of the same paraffinic base oil totaling 212.02 grams were added and allowed to mix into the grease. When the batch reached 160 F, a portion of the batch was given a single pass through a laboratory-scale colloid mill with the gap set at 0.005 inches. The final unmilled grease had an unworked penetration of 289 and a worked 60 stroke penetration of 293. The dropping point was 640 F. The milled grease had an unworked penetration of 161 and a worked 60 stroke penetration of 213. The dropping point was 642 F. The percent overbased calcium sulfonate in the final grease was 25.29%. Interestingly, the conversion-related peaks of the final milled grease showed that the shoulder at 874 $cm^{-1}$ had grown to a slightly resolved peak about half as high as the dominant 882 $cm^{-1}$ peak.

As with the previous Example 7-12 greases, the FTIR spectra during the making of this grease as well as the FTIR spectra of the final product indicated that most of the added glycerol derivative had hydrolyzed with the resulting long chain fatty acid reacting with calcium carbonate to form the corresponding calcium salt thickener component.

Several things are to be noted regarding the results of this grease. First, the behavior during conversion was the same as the previous Example 12 grease until the conventional non-aqueous converting agent (hexylene glycol) was added. However, when the hexylene glycol was added, this Example 13 grease rapidly advanced the conversion process, at least as indicated by FTIR spectra, to an almost complete state. By contrast, the FTIR spectra of the previous Example 12 grease did not significantly change after the addition of the non-aqueous converting agent. Second, this grease had a thickener yield significantly superior to the previous Example 12 grease. This was true for both the unmilled and the milled grease. In fact, using the customary inverse linear relationship between worked penetration and percent overbased calcium sulfonate concentration, the milled Example 13 grease would have had a percent overbased calcium sulfonate concentration of 19.2% if additional base oil had been added to bring the worked penetration to a value of 280 (a mid-range penetration vale for a Grade 2 grease). This value is superior (lower) than any other value of any calcium carbonate-based calcium sulfonate grease documented in any of the previously mentioned applications and their issued patent counterparts. This includes all greases in those applications regardless of whether or not they used overbased magnesium sulfonate or a conventional non-aqueous converting agent. Third, the thickener yield of the milled Example 13 grease was much better than the corresponding unmilled grease. While this is normal behavior for prior art sulfonate based-greases, it is not what has been observed in the previous Example 7-12 greases using an added glycerol derivative. Finally, the dropping points for both unmilled and milled Example 13 were very high. These are the highest dropping point values for any calcium carbonate-based calcium sulfonate grease documented in any of the previously mentioned applications and their issued patent counterparts when a poor quality overbased calcium sulfonate was used and when the complexing acids were 12-hydroxystearic acid, acetic acid, and phosphoric acid. This includes all such previously documented greases whether or not they used overbased magnesium sulfonate or a conventional non-aqueous converting agent.

The only manufacturing process difference between this Example 13 grease and the previous Example 12 grease was the relative order of the addition of the overbased magnesium sulfonate and the facilitating acid, i.e. whether or not the delay after addition of facilitating acid technique described in U.S. Pat. No. 10,087,388 was employed. Therefore, all the above differences between these two greases has to be due to whether or not that process technique was employed. The reason why this is so has not yet been determined. Certainly, these differences as pertaining to the improvements in thickener yield, FTIR spectra behavior, dropping point, and optimal thickener dispersion without milling (when present) are surprising and would not have been expected by one of ordinary skill in the art.

Example 14—Since the milled grease of the previous Example 13 had a very hard consistency, a 759.3 gram portion of it was returned the mixer after it had been cleaned. The milled grease was stirred and heated to about 160 F. Then two portions of the same paraffinic base oil totaling 85.1 grams were added and allowed to mix into the grease for 45 minutes. Once complete mixing had occurred, the grease was removed and allowed to cool until the next day. The grease had an unworked penetration of 299. Its worked 60 stroke penetration was also 299. The dropping point was 638 F. The percent overbased calcium sulfonate was 22.8%. Using the customary inverse linear relationship between worked penetration and percent overbased calcium sulfonate concentration, the Example 14 grease would have had a percent overbased calcium sulfonate concentration of 24.3% if less base oil had been added so as to bring the worked penetration to a value of 280 (a mid-range penetration vale for a Grade 2 grease, which was used as a comparison value in Example 13). While this value is not as good a thickener yield as the 19.2% estimate calculated in the previous Example 13 (which may be due to some softening that occurred in the milled Example 13 grease during the stirring when the additional base oil was added), the final thickener yield of this Example 14 grease is one of the best values reported for any calcium carbonate-based calcium sulfonate grease documented in any of the previously mentioned applications and their issued patent counterparts. This includes all greases in those applications regardless of whether or not they used overbased magnesium sulfonate or a conventional non-aqueous converting agent.

Example 15—Another grease was made similar to the previous Example 12 herein. There were only three significant differences between this grease and the previous Example 12 grease. First, when this grease was heated to 190 F to 200 F, the conversion process was not continued until it stalled (or appeared stalled by FTIR spectra) before adding the hexylene glycol (primary non-aqueous converting agent). Instead, the hexylene glycol was immediately added when the temperature reached 190 F. Second, when this grease was made, only the first portion of powdered calcium carbonate was added before conversion. A second portion of powdered calcium carbonate was not added after conversion. Third, boric acid was also added as a post-conversion complexing acid in this grease. Boric acid was not used in the previous Example 12 grease.

The grease was made as follows: 618.2 grams of 400 TBN overbased oil-soluble calcium sulfonate were added to an open mixing vessel followed by 505.48 grams of a solvent neutral group 1 paraffinic base oil having a viscosity of about 600 SUS at 100 F. The 400 TBN overbased oil-soluble calcium sulfonate was a poor quality calcium sulfonate as defined by our recently issued U.S. Pat. No. 9,458,406. Mixing without heat began using a planetary mixing paddle. Then 62.90 grams of a primarily C12 alkylbenzene sulfonic acid (facilitating acid) were added. After mixing for 20 minutes, 63.20 grams of overbased magnesium sulfonate A were added and allowed to mix in for 15 minutes. Then 150.53 grams of finely divided calcium carbonate with a mean particle size below 5 microns were added and allowed to mix in for 20 minutes. Then 17.42 grams of glycerol monostearate (GMS) were added. This was followed by the addition of 52.84 grams of 12-hydroxystearic acid and 1.66 grams of glacial acetic acid. Then 79.81 grams water were added and the batch was heated to 190 F to 200 F. As the heating began, by the time the temperature had reached 98 F. a noticeable grease structure was evident. This grease structure continued to thicken as the temperature increased to 140 F. As the temperature continued to increase beyond 140 F, the batch began to become thinner. By the time the temperature reached 190 F, no significant grease structure was visible.

As soon as the batch reached 190 F, a 30.1 gram portion of hexylene glycol was added to the batch. FTIR spectra indicated that the batch still had plenty of water, so no additional water was added. The batch began to noticeably thicken within a few minutes. After 20 minutes, the batch was extremely heavy. The FTIR spectra showed a dominant peak at 882 $cm^{-1}$ (representing full conversion) and a very small but resolved peak at 874 $cm^{-1}$ with the original 862 $cm^{-1}$ peak (amorphous calcium carbonate) gone. An additional 42 grams water was added to replace water apparently lost due to heating. Then two portions of the same paraffinic base oil totaling 116.96 grams were added due to the extreme thickness of the grease. After about 45 minutes, the FTIR spectra indicated no further change except that no water was apparent. The total conversion time at 190-200 F up to this point was 62 minutes.

A 42.1 gram portion of water was added followed by 107.37 grams of 12-hydroxystearic acid and 3.26 grams of acetic acid. After no further reaction or thickening from these two complexing acids were apparent, 17.04 grams of boric acid slurried in 50 grams hot water were added and allowed to react. Due to increased thickness of the batch, another 70.96 grams of the same paraffinic base oil was added. Then 32.93 grams of a 75% solution of phosphoric acid in water were slowly added and allowed to mix in and react. The mixture was then heated while continuing to stir. When the grease reached 300 F, 39.99 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 100.04 grams of food grade anhydrous calcium sulfate having a mean particle size below 5 microns were added. When the temperature of the grease cooled to 200 F, 3.84 grams of an aryl amine antioxidant were added. Then three portions of the same paraffinic base oil totaling 248.41 grams were added. Immediately after this, 19.57 grams of PAO were added and allowed to mix into the batch. The PAO had a viscosity of about 4 cSt at 100 C. The heating mantle was removed and stirring was stopped. The batch cooled and remained undisturbed for 16 hours.

The next morning, the batch was heated to about 150 F with stirring. Then four portions of the same paraffinic base oil totaling 235.45 grams were added and allowed to mix into the batch. A portion of the batch was removed without milling and stored in a steel can. The remaining portion of the batch was given a single pass through a laboratory-scale colloid mill with the gap set at 0.005 inches. The milled grease was then replaced into the now clean mixing vessel and stirred at 150 F for about 40 minutes. Then the milled and stirred grease was removed and stored in a steel can. The final unmilled grease had an unworked penetration of 245 and a worked 60 stroke penetration of 259. The dropping point was greater than 650 F. The milled and stirred grease had an unworked penetration of 259 and a worked 60 stroke penetration of 271. The dropping point was greater than 650 F. The percent overbased calcium sulfonate in both grease samples was 24.75%.

As with previous examples, the FTIR spectra during the making of this grease as well as the FTIR spectra of the final product indicated that most of the added glycerol derivative had hydrolyzed with the resulting long chain fatty acid reacting with calcium carbonate to form the corresponding calcium salt thickener component.

Four things are to be noted regarding the results of this grease. First, this grease had a superior thickener yield compared to all previous Example greases except for the previous Example 14 grease when compared on an equal worked penetration basis. More specifically, this Example 15 grease had a significantly superior thickener yield compared to the Example 12 grease. As mentioned at the beginning of this example, a primary difference between Examples 12 and 15 is that in Example 15 the hexylene glycol was immediately added upon reaching 190 F. In the Example 12 grease, the hexylene glycol was not added until the conversion process at 190-200 F had stalled according to FTIR spectra after being heat for more than 3 hours. The immediate addition of the primary converting agent, hexylene glycol, is the likely reason for the improved yield. Second, the FTIR spectra of this Example 15 grease after the conversion process was significantly different from the FTIR spectra of the Example 12 grease. The Example 15 FTIR spectra indicated a more complete conversion as evidenced by only a minor peak at 874 $cm^{-1}$ remaining. This is in agreement with the improved yield of Example 15 compared to Example 12. Third, milling once again has little effect on the actual thickener yield as evidenced by the similar worked 60 stroke penetrations of the unmilled and milled greases. This is similar to what was observed in Examples 7, 10, 11, and 12. In fact, the unmilled Example 15 grease had penetration values somewhat harder than the milled Example 15 grease. Finally, high dropping points were obtained regardless of whether the grease was milled or not.

Figure 3:
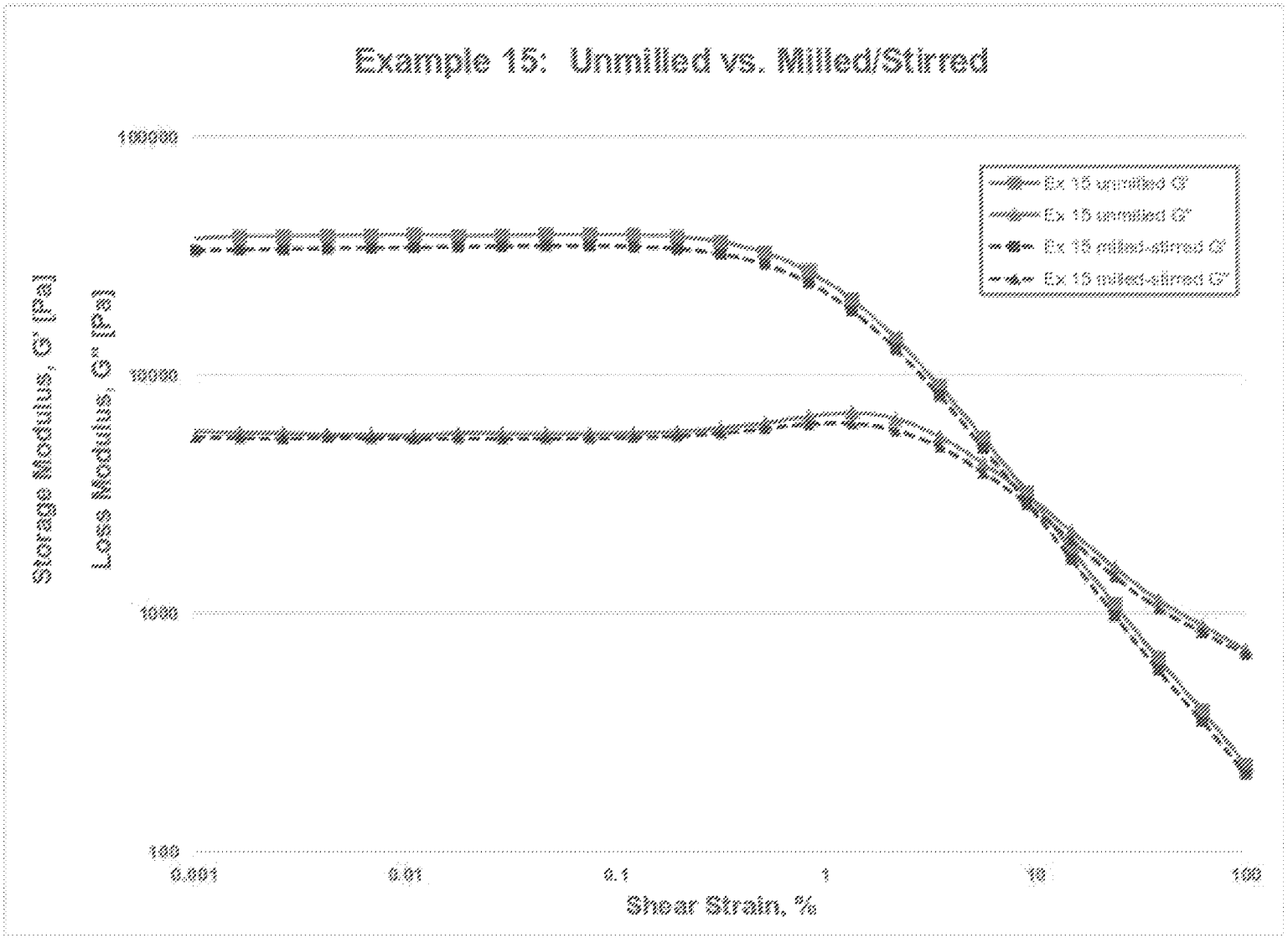
FIG. 3 is a graph showing results of an oscillatory rheometry amplitude sweep at 25 C of the Example 15 unmilled and milled/stirred greases.

Once again the ability of the glycerol derivative (GMS) to disperse the thickener to the extent that milling provides no further significant thickening can also be observed using oscillatory rheometry. FIG. 3 provides results of an oscillatory rheometry amplitude sweep at 25 C of the Example 15 unmilled and milled/stirred greases. As can be seen, the G' and G" curves for the unmilled grease almost exactly overlay the G' and G" curves of the milled grease. Furthermore, the crossover points for the G' and G" curves are the same for both the unmilled and milled greases. This information supports the observation that the glycerol derivative has imparted a milling effect on the grease without the actual use of a mechanical mill.

Example 16—Another grease was made similar to the previous Example 15 grease, with a couple of notable exceptions. First, hydrogenated castor oil (HCO) was used instead of glycerol monostearate (GMO). The HCO was the same material used in the previous Example 7 grease. It was added at a level that provided approximately the same 12-hydroxystearic acid equivalence as the GMS that was added in Example 15. Second, a first portion of calcium carbonate was added before conversion and a second portion was added after conversion, rather than all of the calcium carbonate being added before conversion as it was in Example 15.

The grease was made as follows: 618.4 grams of 400 TBN overbased oil-soluble calcium sulfonate were added to an open mixing vessel followed by 500.02 grams of a solvent neutral group 1 paraffinic base oil having a viscosity of about 600 SUS at 100 F. The 400 TBN overbased oil-soluble calcium sulfonate was a poor quality calcium sulfonate as defined by our recently issued U.S. Pat. No. 9,458,406. Mixing without heat began using a planetary mixing paddle. Then 61.73 grams of a primarily C12 alkylbenzene sulfonic acid (facilitating acid) were added. After mixing for 20 minutes, 63.53 grams of overbased magnesium sulfonate A were added and allowed to mix in for 15 minutes. Then 150.00 grams of finely divided calcium carbonate with a mean particle size below 5 microns were added and allowed to mix in for 20 minutes. Then 20.33 grams of hydrogenated castor oil (HCO) were added. This was followed by the addition of 52.78 grams of 12-hydroxystearic acid and 1.54 grams of glacial acetic acid. Then 81.00 grams water were added and the batch was heated to 190 F to 200 F. As the heating began, by the time the temperature had reached 99 F, a noticeable gelatinous structure had formed. As the batch temperature reached 145 F, this gelatinous structure began to thin out. By the time the temperature reached 160 F, the batch was very thin with no noticeable gel or grease structure evident.

As soon as the batch reached 190 F, the FTIR spectra indicated that the original 862 $cm^{-1}$ peak had diminished and that a larger peak at 874 $cm^{-1}$ had already formed. A 30.3 gram portion of hexylene glycol was added to the batch. After 10 minutes, a visible grease structure had formed. After another 36 minutes, the FTIR spectra showed a dominant peak at 882 $cm^{-1}$ (representing full conversion) and a smaller but resolved peak at 874 $cm^{-1}$ with the original 862 $cm^{-1}$ peak (amorphous calcium carbonate) gone. Then four portions of the same paraffinic base oil totaling 242.12 grams were added due to the extreme thickness of the grease. Another 42 grams water were also added to replace what had been lost due to evaporation. The batch became noticeably thicker, so another 27.94 grams of the same paraffinic base oil was added. After another 10 minutes, two more portions of the same paraffinic base oil totaling 69.13 grams were added along with 61 grams water. The batch was heated to 220 F, then 80 grams of water were added. After 5 minutes, the FTIR spectra indicated that no further changes occurring. All of the original 862 cm 1 peak (amorphous calcium carbonate) was gone. The dominant peak was at 882 $cm^{-1}$ (representing full conversion), and a smaller but resolved peak at 874 $cm^{-1}$ was still present. Total time at 190-200 F before adding the second portion of powdered calcium carbonate was 1 hour and 53 minutes. However, the FTIR conversion-related peaks reached their final state after only about 67 minutes. Therefore, the total conversion time was no more than 67 minutes.

A 149.84 gram portion of the same powdered calcium carbonate was added and allowed to mix into the grease. Due to the continued heaviness of the batch, another 48.08 grams of the same paraffinic base oil was added. Then 107.27 grams of 12-hydroxystearic acid and 3.12 grams of acetic acid were added. Significant additional thickening occurred, so 39.44 grams of the same paraffinic mineral oil was added. After no further reaction or thickening from these two complexing acids were apparent, 16.92 grams of boric acid slurried in 50 grams hot water were added and allowed to react. Then 32.17 grams of a 75% solution of phosphoric acid in water were slowly added and allowed to mix in and react. The mixture was then heated while continuing to stir. When the grease reached 300 F, 40.05 grams of a styrene-alkylene copolymer were added as a crumb-formed solid. The grease was further heated to about 390 F at which time all the polymer was melted and fully dissolved in the grease mixture. The heating mantle was removed and the grease was allowed to cool by continuing to stir in open air. When the grease cooled to 300 F, 100.59 grams of food grade anhydrous calcium sulfate having a mean particle size below 5 microns were added. Then 19.35 grams of a PAO was added. The PAO had a viscosity of about 4 cSt at 100 C. When the temperature of the grease cooled to about 200 F, 4.08 grams of an aryl amine antioxidant were added. Then three portions of the same paraffinic base oil totaling 153.61 grams were added and allowed to mix into the grease. The heating mantle was removed and stirring was stopped. The batch cooled and remained undisturbed for 16 hours.

The next morning, the batch was heated to about 150 F with stirring. Then four portions of the same paraffinic base oil totaling 204.17 grams were added and allowed to mix into the batch. A portion of the batch was removed without milling and stored in a steel can. The remaining portion of the batch was given a single pass through a laboratory-scale colloid mill with the gap set at 0.005 inches. The milled grease was then replaced into the now clean mixing vessel and stirred at 150 F for about 45 minutes. Then the milled and stirred grease was removed and stored in a steel can. The final unmilled grease had an unworked penetration of 247 and a worked 60 stroke penetration of 263. The dropping point was greater than 650 F. The milled and stirred grease had an unworked penetration of 255 and a worked 60 stroke penetration of 263. The dropping point was greater than 650 F. The percent overbased calcium sulfonate in both grease samples was 22.44%.

As with previous examples, the FTIR spectra during the making of this grease as well as the FTIR spectra of the final product indicated that most of the added glycerol derivative (HCO) had hydrolyzed with the resulting long chain fatty acid reacting with calcium carbonate to form the corresponding calcium salt thickener component.

Four things are to be noted regarding the results of this grease. First, this grease had a superior thickener yield compared to all the previous Example greases including the previous Example 14 milled grease when compared on an equal worked penetration basis. Comparing this Example 16 grease specifically to Example 14, the Example 16 grease had a worked penetration that was more than 30 points harder than the milled Example 14 grease even though the percent overbased calcium sulfonate in both greases was essentially the same value. This is even more remarkable since this is true for the unmilled Example 16 grease. Second, the FTIR spectra of this Example 16 grease after the conversion process was similar to the Example 15 grease. Both the excellent yield and unusual doublet conversion peak were features of the Example 15 grease (using GMS) and Example 16 (using HCO). Third, milling once again had no effect on the actual thickener yield as evidenced by the similar worked 60 stroke penetrations of the unmilled and milled greases. This is similar to what was observed in Examples 7, 9, 10, 11, 12, and 15. Finally, high dropping points were obtained regardless of whether the grease was milled or not.

Figure 4:
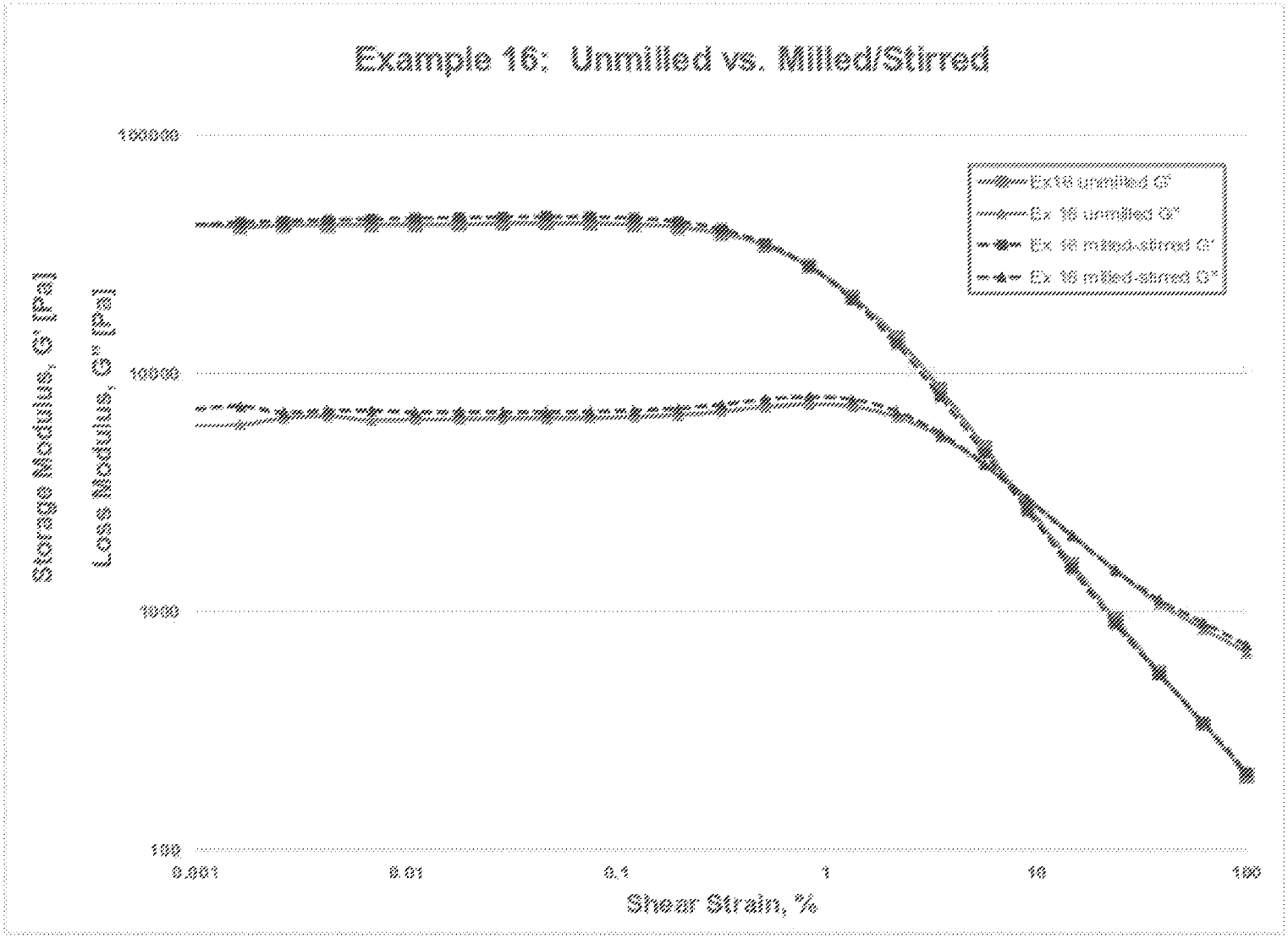
FIG. 4 is a graph showing results of an oscillatory rheometry amplitude sweep at 25 C of the Example 16 unmilled and milled/stirred greases.

Once again the ability of the glycerol derivative (GMS) to disperse the thickener to the extent that milling provides no further significant thickening can also be observed using oscillatory rheometry. FIG. 4 provides results of an oscillatory rheometry amplitude sweep at 25 C of the Example 16 unmilled and milled/stirred greases. As can be seen, the G' and G" curves for the unmilled grease overlay the G' and G" curves of the milled grease. Furthermore, the crossover points for the G' and G" curves are the same for both the unmilled and milled greases. This information continues to support the observation that the glycerol derivative has imparted a milling effect on the grease without the actual use of a mechanical mill.

A summary of the greases of Examples 7-16 is provided below in Tables 6-10. Table 6 provides a summary of compositional information, Table 7 a summary of processing methods used, Table 8 a summary of FTIR conversion behavior and data, and Table 9 a summary of penetration values and dropping points of each example prior to milling (unmilled) and after milling, both when the grease was initially made and after a storage period. Additional testing was performed on the greases of Examples 12-16. The results of that testing are provided below in Table 10.

TABLE 6

Compositional Information for Examples 7-16

| Example Number | 7 | 8 | 9 | 10 | 11 | 12 | 13 | 14 | 15 | 16 |
|---|---|---|---|---|---|---|---|---|---|---|
| Overbased Calcium Sulfonate Quality | Poor | Poor | Poor | Poor | Poor | Poor | Poor | Poor | Poor | Poor |
| Overbased Ca Sulfonate, % (wt) (Thickener yield) | 36.88 | 37.12 | 36.42 | 32.43 | 32.82 | 27.75 | 25.29 | 22.75 | 24.75 | 22.44 |
| Overbased Magnesium Sulfonate Used | A | A | A | A | A | A | A | A | A | A |
| Overbased Mg Sulfonate, % (wt) | 3.79 | 3.68 | 3.64 | 3.26 | 3.29 | 2.76 | 2.52 | 2.27 | 2.53 | 2.27 |
| Ratio of Overbased Ca Sulfonate to Overbased Mg Sulfonate in Pre-Conversion Grease (approximate) | 90/10 | 90/10 | 90/10 | 90/10 | 90/10 | 90/10 | 90/10 | 90/10 | 90/10 | 90/10 |
| Ratio of Overbased Ca Sulfonate to Overbased Mg Sulfonate in Final Grease (approximate) | 90/10 | 90/10 | 90/10 | 90/10 | 90/10 | 90/10 | 90/10 | 90/10 | 90/10 | 90/10 |
| % (wt) Mg sulfonate added inititally relative to total Mg Sulfonate in final grease | 100 | 100 | 100 | 100 | 100 | 100 | 100 | 100 | 100 | 100 |
| Complexing acids added pre-conversion | Acetic | Acetic | Acetic | 12-HSA, Acetic | 12-HSA, Acetic | 12-HSA, Acetic | 12-HSA, Acetic | 12-HSA, Acetic | 12-HSA, Acetic | 12-HSA, Acetic |
| Pre-conversion 12-HSA concentration, % (wt) | 0.00 | 0.00 | 0.00 | 1.00 | 0.99 | 3.53 | 3.53 | 3.53 | 3.53 | 3.53 |
| Complexing acids added post-conversion | Acetic, Phosphoric | Acetic, Phosphoric | 12-HSA, Acetic, Phosphoric | 12-HSA, Acetic, Phosphoric | 12-HSA, Acetic, Phosphoric | 12-HSA, Acetic, Phosphoric | 12-HSA, Acetic, Phosphoric | 12-HSA, Acetic, Phosphoric | 12-HSA, Acetic, Boric, Phosphoric | 12-HSA, Acetic, Boric, Phosphoric |

TABLE 6-continued

| Compositional Information for Examples 7-16 | | | | | | | | | | |
|---|---|---|---|---|---|---|---|---|---|---|
| Example Number | 7 | 8 | 9 | 10 | 11 | 12 | 13 | 14 | 15 | 16 |
| Conventional non-aq. converting agent used | None | None | Hexylene Glycol | Hexylene Glycol | Hexylene Glycol | Hexylene Glycol | Hexylene Glycol | Hexylene Glycol | Hexylene Glycol | Hexylene Glycol |
| Conventional non-aq. converting agent, % (wt) | Not Applicable | Not Applicable | 1.73 | 1.48 | 0.85 | 1.43 | 1.27 | 1.14 | 1.2 | 1.1 |
| Glycerol Derivative Used | HCO | GMO | GMO | GMS | GMS | GMS | GMS | GMS | GMS | HCO |
| Total Glycerol Derivative, % (wt) | 3.02 | 3.20 | 1.08 | 0.91 | 0.94 | 0.80 | 0.70 | 0.63 | 0.70 | 0.74 |

TABLE 7

| Method Information for Examples 7-16 | | | | | | | | | | |
|---|---|---|---|---|---|---|---|---|---|---|
| Example Number | 7 | 8 | 9 | 10 | 11 | 12 | 13 | 14 | 15 | 16 |
| When Glycerol Derivative is Added: Pre-, During, or Post-Conversion | Pre, During | Pre, During | Pre | Pre | Pre | Pre | Pre | Pre | Pre | Pre |
| % (wt) glycerol derivative added initially relative to total glycerol derivative in final grease | 33 | 32 | 100 | 100 | 100 | 100 | 100 | 100 | 100 | 100 |
| Facilitating Acid Delay Method Used? | No | No | No | No | No | Yes | No | No | Yes | Yes |
| Reactive component present when DDBSA added | Ca Sulfonate, Mg Sulfonate | Ca Sulfonate, Mg Sulfonate | Ca Sulfonate, Mg Sulfonate | Ca Sulfonate, Mg Sulfonate | Ca Sulfonate, Mg Sulfonate | Ca Sulfonate Sulfonate | Ca Sulfonate, Mg Sulfonate | Ca Sulfonate, Mg | Ca Sulfonate | Ca Sulfonate |
| First delayed reactive component added after DDBSA | Not Applicable | Not Applicable | Not Applicable | Not Applicable | Not Applicable | Mg Sulfonate | Not Applicable | Not Applicable | Mg Sulfonate | Mg Sulfonate |
| Facilitating Acid Temp. Adj. delay used? | No | No | No | No | No | No | No | No | No | No |
| Holding delay? | No | No | No | No | No | No | No | No | No | No |
| Conventional Non-Aqueous Converting Agent Delay Method Used? | No | No | Yes | Yes | Yes | Yes | Yes | Yes | Yes | Yes |
| Holding Delay temperature, F. | Not Applicable | Not Applicable | 190-200 F. | 190-200 F. | 190-200 F. | 190-200 F. | 190-200 F. | 190-200 F. | 190-200 F. | 190-200 F. |
| Holding Delay time, minutes | Not Applicable | Not Applicable | 461 | 212 | 195 | 219 | 370 | 370 | 0 | 0 |
| Alkali Metal Hydroxide Addition Method Used? | Yes (sodium hydroxide) | Yes (sodium hydroxide) | No | No | No | No | No | No | No | No |
| When was sodium hydroxide added: Pre-, During, or Post-Conversion | during | during | Not Applicable | Not Applicable | Not Applicable | Not Applicable | Not Applicable | Not Applicable | Not Applicable | Not Applicable |

TABLE 8

| FTIR Conversion Behavior for Examples 7-16 | | | | | | | | | | |
|---|---|---|---|---|---|---|---|---|---|---|
| Example Number | 7 | 8 | 9 | 10 | 11 | 12 | 13 | 14 | 15 | 16 |
| Conversion-related peak wave numbers present when 190 F. first reached | 882(sh), **874**, 862(sh) | 882, **874**, 862(sh) | 882(sh), **874**, 862(sh) | 882(sh), **874**, 862(sh) | 882(sh), **874**, 862(sh) | **874**, 862(sh) | **874**, 862(sh) | 874, 862(sh) | **874**, 862(sh) | **874**, 862(sh) |
| First measured conversion time (at 190-200 F.) when 882 peak became dominant, minutes | 89 | 22 | 124 | 50 | 135 | Never | 370-498 | 370-498 | 20 | 46 |
| Conversion-related peak wave numbers present when conventional non-aq. converting agent added | Not Applicable | Not Applicable | **882**, 874, 862(sh) | **882**, 874, 862(sh) | **882**, 874, 862(sh) | 882, **874**, 862(sh) | 882, **874**, 862(sh) | 882, 874, 862(sh) | **874**, 862(sh) | **874**, 862(sh) |

TABLE 8-continued

| FTIR Conversion Behavior for Examples 7-16 | | | | | | | | | | |
|---|---|---|---|---|---|---|---|---|---|---|
| Example Number | 7 | 8 | 9 | 10 | 11 | 12 | 13 | 14 | 15 | 16 |
| Conversion time (at 190-200 F.) when conventional non-aq. converting agent added, minutes | Not Applicable | Not Applicable | 461 | 212 | 195 | 219 | 370 | 370 | 0 | 0 |
| Conversion-related peak wave numbers present when final extent of conversion was achieved | **882**, 874(sh), 862(sh) | **882**, 874, 862(sh) | **882**, 874(sh) | **882**, 874(sh) | **882**, 874(sh), 862(sh) | 882, **874**, 862(sh) | **882**, 874(sh), | **882**, 874(sh), | **882**, 874 | **882**, 874 |
| Final relative peak height for 882 to 874 peaks, approximate | 2/1 | 2/1 | 3/1 | 3/1 | 2/1 | 2/3 | 2/1 | 2/1 | 2/1 | 2/1 |
| Total Conversion Time | 9 hr, 12 min | 2 hr, 56 min | 7 hr, 50 min | 4 hr, 34 min | 4 hr, 46 min | 4 hr, 22 min | 8 hr, 18 min | 8 hr, 18 min | 1 hr, 2 min | 1 hr, 7 minutes |

The bolded numbers represent the dominant peak.
"sh" means there was a shoulder present at the indicated wave numbers.

TABLE 9

| Testing Data for Examples 7-16 | | | | | | | | | | |
|---|---|---|---|---|---|---|---|---|---|---|
| Example Number | 7 | 8 | 9 | 10 | 11 | 12 | 13 | 14 | 15* | 16* |
| Overbased Ca Sulfonate, % (wt) (Thickener yield) | 36.88 | 37.12 | 36.42 | 32.43 | 32.82 | 27.75 | 25.29 | 22.75 | 24.75 | 22.44 |
| (Unmilled) Initial Unworked Penetration | 265 | 453 | ND | 235 | 255 | 225 | 289 | ND | 245 | 247 |
| (Unmilled) Initial Worked 60 Stroke Penetration | ND | ND | ND | 235 | 257 | 267 | 293 | ND | 259 | 263 |
| (Unmilled) Initial Dropping Point, F. | 581 | ND | ND | 587 | 540 | 567 | 640 | ND | >650 | >650 |
| (Unmilled) Storage Period, months | 3.5 | Not Applicable | Not Applicable | 3 | 4 | 3 | 3 | Not Applicable | 4 | 3.5 |
| (Unmilled) Storage Unworked Penetration | 279 | ND | ND | 231 | 247 | 277 | 315 | ND | 251 | 253 |
| (Unmilled) Storage Worked 60 Stroke Penetration | 280 | ND | ND | 257 | 253 | 323 | 333 | ND | 259 | 263 |
| (Unmilled) Storage Dropping Point, F. | 580 | ND | ND | 599 | ND | ND | ND | ND | >650 | >650 |
| (Milled) Initial Unworked Penetration | 255 | ND | 295 | 221 | 225 | 235 | 161 | 299 | 259 | 255 |
| (Milled) Initial Worked 60 Stroke Penetration | 279 | ND | 315 | 247 | 247 | 273 | 213 | 299 | 271* | 263 |
| (Milled) Initial Dropping Point, F. | 580 | ND | 550 | 587 | 567 | 541 | 642 | 638 | >650 | >650 |
| (Milled) Storage Period, months | 3.5 | Not Applicable | 3.5 | 3 | 4 | 3 | 3 | 2.5 | 4 | 3.5 |
| (Milled) Storage Unworked Penetration | 255 | ND | 289 | 191 | 245 | 205 | ND | 305 | 245 | 241 |
| (Milled) Storage Worked 60 Stroke Penetration | 287 | ND | 303 | 263 | 265 | 275 | ND | 307 | 273 | 265 |
| (Milled) Storage Dropping Point, F. | 579 | ND | 609 | 590 | ND | ND | ND | ND | 637 | >650 |

ND in the above table means not determined.
*Milled Grease results for Examples 15 and 16 were after milling and stirring.

TABLE 10

| Additional Testing Data Examples 12-16 | | | | | | | | | |
|---|---|---|---|---|---|---|---|---|---|
| Example Number | 12 | 12 | 13 | 13 | 14 | 15 | 15 | 16 | 16 |
| Unmilled or Milled | Unmilled | Milled | Unmilled | Milled | Milled | Unmilled | Milled | Unmilled | Milled |
| Quality of Overbased Ca Sulfonate | Poor | Poor | Poor | Poor | Poor | Poor | Poor | Poor | Poor |
| Overbased Magnesium Sulfonate used | A | A | A | A | A | A | A | A | A |
| Overbased Ca Sulfonate, % (wt) | 27.75 | 27.75 | 25.29 | 25.29 | 22.75 | 24.75 | 24.75 | 22.44 | 22.44 |
| Overbased Mg Sulfonate, % (wt) | 2.76 | 2.76 | 2.52 | 2.52 | 2.27 | 2.53 | 2.53 | 2.27 | 2.27 |
| Unworked Penetration | 225 | 235 | 289 | 161 | 299 | 245 | 259 | 247 | 255 |
| Worked 60 Stroke Penetration | 267 | 273 | 293 | 213 | 299 | 259 | 271 | 263 | 263 |

TABLE 10-continued

| Additional Testing Data Examples 12-16 | | | | | | | | | |
|---|---|---|---|---|---|---|---|---|---|
| Example Number | 12 | 12 | 13 | 13 | 14 | 15 | 15 | 16 | 16 |
| Dropping Point, F. | 567 | 541 | 640 | 642 | 638 | >650 | >650 | >650 | >650 |
| Four Ball EP, Weld Load, kg | ND | ND | ND | ND | ND | 620 | 620 | 500 | 620 |
| Four Ball Wear | ND | ND | ND | ND | ND | 0.43 | 0.41 | 0.39 | 0.40 |
| Roll Stability at 25 C., 2 hrs | | | | | | | | | |
| Initial worked penetration | 293 | 275 | 307 | ND | 307 | 269 | 275 | 273 | 271 |
| Final worked penetration | 337 | 325 | 257 | ND | 303 | 255 | 265 | 261 | 269 |
| % Change | 15.0 | 18.2 | −16.3 | ND | −1.3 | −5.2 | −3.6 | −4.4 | −0.7 |
| Dropping Point after test, F. | 570 | 610 | 639 | ND | 637 | >643 | >640 | >641 | >643 |
| Roll Stability at 150 C., 2 hrs | | | | | | | | | |
| Initial worked penetration | 293 | 275 | 307 | ND | 307 | ND | 275 | ND | ND |
| Final worked penetration | 241 | 235 | 181 | ND | 211 | ND | 267 | ND | ND |
| % Change | −17.7 | −14.5 | −41.0 | ND | −31.3 | ND | −2.9 | ND | ND |
| Dropping Point after test, F | 548 | 553 | 582 | ND | >650 | ND | 560 | ND | ND |
| Oil Separation, 24 hr, 100 C., % (wt) | 2.9 | 1.8 | 1.1 | ND | 1.1 | 1.3 | 0.50 | 0.28 | 0.81 |
| Oil Separation, 24 hr, 150 C., % (wt) | 9.5 | 16.6 | 5.7 | ND | 19.6 | 2.1 | 1.2 | 2.5 | 1.03 |

As can be seen from the data in Tables 6-10, certain embodiments of the various compositional and process variables of the subject invention provide better performance and structural stability characteristics than others. The greases of Examples 15 and 16 are noteworthy in this regard, as those with ordinary skill in the art will recognize.

Examples 17 is another baseline example that does not include a glycerol derivative addition according to preferred embodiments of the invention. Examples 17-23 use added calcium hydroxyapatite as a calcium containing based for reacting with complexing acids, as described in U.S. Pat. No. 9,458,406 (and further described in the '101, '102, '387, '388, and '391 patents).

Example 17—A grease was made based on the calcium hydroxyapatite technology of U.S. Pat. No. 9,458,406. This grease serves as a baseline for comparison. This grease did not use any added glycerol derivative. Also, this grease did not use any overbased magnesium sulfonate. Only overbased calcium sulfonate was used. The converting agent delayed addition method was not used. A different commercially available overbased calcium sulfonate was used for this grease compared to the previous examples. Also, a different commercially available base oil was used. A different non-aqueous converting agent (propylene glycol) was used. Boric acid was not used. Much less of the styrene-alkylene co-polymer was used. The grease was heated to a top temperature of only 340 F. Finally, an amine phosphate additive and a different antioxidant were added near the end of the manufacturing procedure.

The grease was made as follows: 544.0 grams of 400 TBN overbased oil-soluble calcium sulfonate were added to an open mixing vessel with 661.7 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by the '406 patent. Mixing without heat began using a planetary mixing paddle. Then 48.91 grams of a primarily C12 alkylbenzene sulfonic acid were added. After mixing for 20 minutes, 91.98 grams of calcium hydroxyapatite with a mean particle size below 5 microns and 7.44 grams of food grade purity calcium hydroxide having a mean particle size below 5 microns were added and allowed to mix in for about 30 minutes. Then 1.73 grams of glacial acetic acid and 21.76 grams of 12-hydroxystearic acid were added and allowed to mix in for 10 minutes. Then 100.56 grams of finely divided calcium carbonate with a mean particle size below 5 microns were added and allowed to mix in for about 5 minutes. Then, 70.6 grams water and 27.05 grams of propylene glycol were added. The mixture was heated until the temperature reached 190 to 200 F. Visible thickening began when the temperature reached about 166 F. An FTIR spectra taken at that time showed a dominant peak at 882 $cm^{-1}$ (representing full conversion) and a smaller but resolved peak at 874 $cm^{-1}$ with a very pronounced shoulder at 862 $cm^{-1}$ (representing the original amorphous calcium carbonate).

When the temperature reached 195 F, the FTIR spectra showed that the dominant peak at 882 $cm^{-1}$ (representing full conversion) had increased. The peak at 874 $cm^{-1}$ was still resolved but had decreased. The shoulder at 862 $cm^{-1}$ (representing the original amorphous calcium carbonate) had also decreased. For the next four hours the temperature was held at 190 to 200 F. During this time seven more portions of water totaling 243 grams were added to replace water lost due to evaporation. The FTIR spectra continued to progress during this time until the shoulder at 862 $cm^{-1}$ was gone, indicating that conversion of the amorphous calcium carbonate to crystalline calcium carbonate (calcite) had occurred. However, as the final amount of this amorphous calcium carbonate was eliminated, the intermediate peak at 874 $cm^{-1}$ increased until it was almost as large as the peak at 882 $cm^{-1}$. These two peaks appeared as a barely resolved doublet. Since this FTIR spectra had not changed during the final 20 minutes, the conversion process was considered finished. The total conversion time, based on the mixing time at 190-200 F, was 3 hours and 14 minutes.

Then 32.2 grams of water and 15.14 grams of the same calcium hydroxide were added and allowed to mix in for 10 minutes. Then 55.45 grams of 12-hydroxystearic acid were added and allowed to react. Due to significant thickening, two portions of the same paraffinic base oil totaling 191.22 grams were added and allowed to mix in. Then 3.22 grams of acetic acid were added. After these two complexing acids had reacted, 38.00 grams of a 75% solution of phosphoric acid in water were slowly added and allowed to mix in and react. The mixture was then heated with an electric heating mantle while continuing to stir. When the grease reached 300 F, 40.13 grams of a styrene-alkylene copolymer were added as a crumb-formed solid. The grease was further heated to about 340 F at which time all the polymer was melted and fully dissolved in the grease mixture. The heating mantle was removed and the grease was allowed to cool by continuing to stir in open air. When the grease cooled to 300 F, 59.61 grams of food grade anhydrous calcium sulfate having a mean particle size below 5 microns were added. As the grease continued to cool, it became increasing heavy. An additional 112.13 grams of the same paraffinic base oil was added. When the temperature of the grease cooled to 200 F, 11.11 grams of a mixture of aryl amine and high molecular weight phenolic antioxidants and 11.67 grams of an amine phosphate antioxidant/anti-rust additive were added. Two portions of the same base oil totaling 63.62 grams were added. Mixing continued until the grease reached a temperature of 150 F.

A portion of the batch was removed without milling and stored in a steel can. A portion of this unmilled grease was spread on a clean steel sheet and allowed to air cool to about 77 F. This portion of the unmilled grease had an unworked penetration of 269 and a worked 60 stroke penetration of 287. The remaining portion of the batch that was still in the mixer was given a single pass through a laboratory-scale colloid mill with the gap set at 0.005 inches. A portion of this milled grease was spread on a clean steel sheet and allowed to air cool to about 77 F. This portion of the milled grease had an unworked penetration of 253 and a worked 60 stroke penetration of 267. The remaining milled grease was then replaced into the now clean mixing vessel and stirred at 150 F for about 45 minutes. A portion of this milled and stirred grease was spread on a clean steel sheet and allowed to air cool to about 77 F. This portion of the milled and stirred grease had an unworked penetration of 261 and a worked 60 stroke penetration of 281. The remaining portion of the milled and stirred grease was removed and stored in a steel can. About 24 hours later, both cans of grease (unmilled and milled/stirred) were re-evaluated for penetration. The final unmilled grease had an unworked penetration of 245 and a worked 60 stroke penetration of 285. The dropping point was greater than 650 F. The milled and stirred grease had an unworked penetration of 267 and a worked 60 stroke penetration of 279. The dropping point was greater than 650 F. The percent overbased calcium sulfonate in both grease samples was 25.85%.

It should be noted that the FTIR doublet peak observed at the end of the conversion process of this grease was retained in the final grease. Compared to other greases made using this specific batch of overbased calcium sulfonate in previous tests, this is unusual behavior; however, it is believed to be due to the age of the overbased calcium sulfonate used. At the time of these tests, the batch of overbased calcium sulfonate was about 3 years old (it was new at the time of the previous tests).

Example 18—Another calcium sulfonate complex grease was made similar to the previous Example 17 baseline grease. There were only two significant differences: HCO was added pre-conversion in a manner similar to Example 16; and a second portion of propylene glycol (non-aqueous converting agent) was added about 53 minutes after the target conversion temperature range was reached.

The grease was made as follows: 541.6 grams of 400 TBN overbased oil-soluble calcium sulfonate were added to an open mixing vessel with 662.5 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by our recently issued U.S. Pat. No. 9,458,406. Mixing without heat began using a planetary mixing paddle. Then 49.11 grams of a primarily C12 alkylbenzene sulfonic acid were added. After mixing for 20 minutes, 92.03 grams of calcium hydroxyapatite with a mean particle size below 5 microns and 7.32 grams of food grade purity calcium hydroxide having a mean particle size below 5 microns were added and allowed to mix in for about 30 minutes. Then 2.00 grams of glacial acetic acid and 21.61 grams of 12-hydroxystearic acid were added and allowed to mix in for 10 minutes. Then 100.11 grams of finely divided calcium carbonate with a mean particle size below 5 microns were added and allowed to mix in for about 5 minutes. Then 20.14 grams of hydrogenated castor oil (HCO) were added and allowed to mix into the batch. Then, 72.4 grams water and 26.22 grams of propylene glycol were added. The heating mantle was applied and the heating process began. An initial FTIR spectra was taken within the first two minutes. The spectra indicated that the conversion process had already begun with a large peak at about 874 $cm^{-1}$. The original peak at 862 $cm^{-1}$ (representing the original amorphous calcium carbonate) appeared as a large, wide shoulder almost as high at the 874 $cm^{-1}$ peak. The 874 $cm^{-1}$ peak had a very slight beginning of a shoulder at about 882 $cm^{-1}$.

The mixture was heated until the temperature reached 190 to 200 F. When the batch temperature had reached 190 F, another FTIR spectra was taken. Results showed a dominant peak at 882 $cm^{-1}$ (representing full conversion) and a smaller but resolved peak at 874 cm 1 with a very pronounced shoulder at 862 $cm^{-1}$ (representing the original amorphous calcium carbonate). This FTIR spectra looked very similar to the FTIR spectra of the previous baseline grease at this point in the manufacturing process. During the next 53 minutes of mixing two portions of water totaling 64.3 grams were added to replace water lost due to evaporation. The FTIR spectra had not changed. Accordingly, another 15.92 grams of propylene glycol were added. About one hour after the second addition of propylene glycol, and after another 43 gram addition of water, the FTIR spectra began to change. The intermediate peak at 874 $cm^{-1}$ began to increase, and the shoulder at 862 $cm^{-1}$ began to decrease. When the batch had been mixed at 190-200 F for another 6 hours after the second addition of propylene glycol, and after another eleven additions of water totaling about 536 grams, the FTIR spectra indicated that conversion had reached its final state. The original amorphous calcium carbonate peak was gone. A barely resolved doublet peak at about 882 $cm^{-1}$ and 874 $cm^{-1}$ remained. The peak at 874 $cm^{-1}$ was almost as high as the peak at 882 $cm^{-1}$. During this 6 hours of mixing, nine portions of the same paraffinic base oil totaling 284.24 grams were added due to the progressively increasing thickness of the batch. The total conversion time, based on the mixing time at 190-200 F, was just under 7 hours.

Then 20.26 grams of water and 15.04 grams of the same calcium hydroxide were added and allowed to mix in for about 10 minutes. Then 55.52 grams of 12-hydroxystearic acid were added and allowed to react. Due to significant thickening, three portions of the same paraffinic base oil totaling 110.59 grams were added and allowed to mix in. Then 3.00 grams of acetic acid were added. Due to further thickening, another 38.23 grams of the same paraffinic base oil was added and allowed to mix in. After these two complexing acids had reacted, 37.31 grams of a 75% solution of phosphoric acid in water were slowly added and allowed to mix in and react. The mixture was then heated with an electric heating mantle while continuing to stir. When the grease reached 300 F. 4.99 grams of a styrene-alkylene copolymer were added as a crumb-formed solid. The grease was further heated to about 340 F at which time all the polymer was melted and fully dissolved in the grease mixture. The heating mantle was removed and the grease was allowed to cool by continuing to stir in open air. When the grease cooled to 300 F, 60.00 grams of food grade anhydrous calcium sulfate having a mean particle size below 5 microns were added. When the temperature of the grease cooled to about 200 F, 9.65 grams of a mixture of aryl amine and high molecular weight phenolic antioxidants and 10.04 grams of an amine phosphate antioxidant/anti-rust additive were added. Two portions of the same base oil totaling 143.83 grams were added. Mixing continued until the grease reached a temperature of 150 F. Two portions of the same base oil totaling 46.45 grams were added and allowed to mix into the batch. The heating mantle was removed and stirring was stopped. The batch cooled and remained undisturbed for 16 hours.

The next morning, the batch was heated to about 150 F with stirring. Since the batch was still too heavy, another two portions of the same base oil totaling 66.8 grams were added and allowed to mix into the batch. A portion of the batch was removed without milling and stored in a steel can. A portion of this unmilled grease was spread on a clean steel sheet and allowed to air cool to about 77 F. This portion of the unmilled grease had an unworked penetration of 273 and a worked 60 stroke penetration of 281. The remaining portion of the batch that was still in the mixer was given a single pass through a laboratory-scale colloid mill with the gap set at 0.005 inches. The total amount of this milled grease that was collected was 997.5 grams. A portion of this milled grease was spread on a clean steel sheet and allowed to air cool to about 77 F. This portion of the milled grease had an unworked penetration of 255 and a worked 60 stroke penetration of 263. This air cooled sample was returned to the mixing bowl with the rest of the collected milled grease. An additional 57.62 grams of the same paraffinic base oil was added and allowed to mix in at 150 F for 45 minutes. A portion of this milled and stirred grease was spread on a clean steel sheet and allowed to air cool to about 77 F. This portion of the milled and stirred grease had an unworked penetration of 291 and a worked 60 stroke penetration of 299. The remaining portion of the milled and stirred grease was removed and stored in a steel can.

About 24 hours later, both cans of grease (unmilled and milled/stirred) were re-evaluated for penetration. The final unmilled grease had an unworked penetration of 263 and a worked 60 stroke penetration of 285. The dropping point was 621 F. The milled and stirred grease had an unworked penetration of 279 and a worked 60 stroke penetration of 291. The dropping point was 621 F. The percent overbased calcium sulfonate in the unmilled grease was 22.49%. The percent overbased calcium sulfonate in the milled grease was 21.26%.

The FTIR spectra of the final product indicated that only a very small amount of non-hydrolyzed glycerol derivative (HCO) was still present.

Two things are noteworthy concerning this Example 18 grease when compared to the previous Example 17 baseline grease. First, just as with the previous Example 17 grease, the FTIR doublet peak observed at the end of the conversion process of this grease was retained in the final grease. Again, this is unusual behavior for such calcium sulfonate complex greases made with this specific overbased calcium sulfonate, but is believed to be due to the age of the overbased calcium sulfonate. Second, the conversion time for this grease was much longer that for the Example 17 baseline grease.

Figure 5:
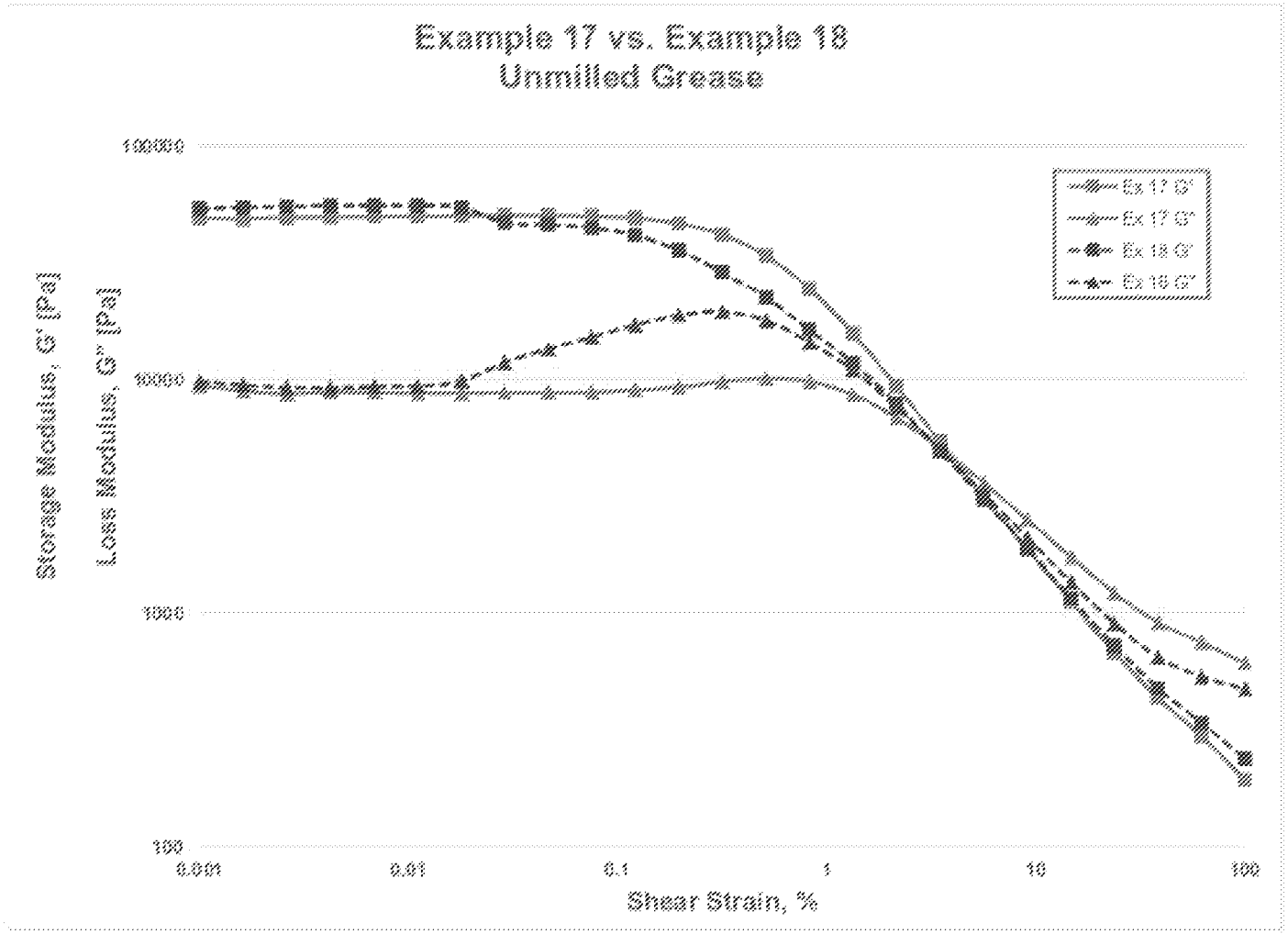
FIG. 5 is a graph showing results of an oscillatory rheometry amplitude sweep at 25 C of the unmilled Example 17 and 18 greases.

Additional information concerning the Example 17 and 18 greases can be provided by oscillatory rheometry. FIG. 5 shows the results of an amplitude sweep of the unmilled Example 17 and 18 greases. The effect of the glycerol derivative (HCO) in the Example 18 grease can be seen in several ways. First, the initial values of G' and G" for both unmilled greases are almost identical even though the Example 18 grease had significantly less thickener (better yield). This parallels the identical worked penetration values for these two greases. Also, the crossover points of the G' and G" curves for both unmilled greases occur at nearly the same relative shear strain. However, there appears to be more structure building in the base oil portion (G") of the Example 18 grease compared to the Example 17 grease as shear strain increases. This is a likely effect of the HCO in this grease.

Figure 6:
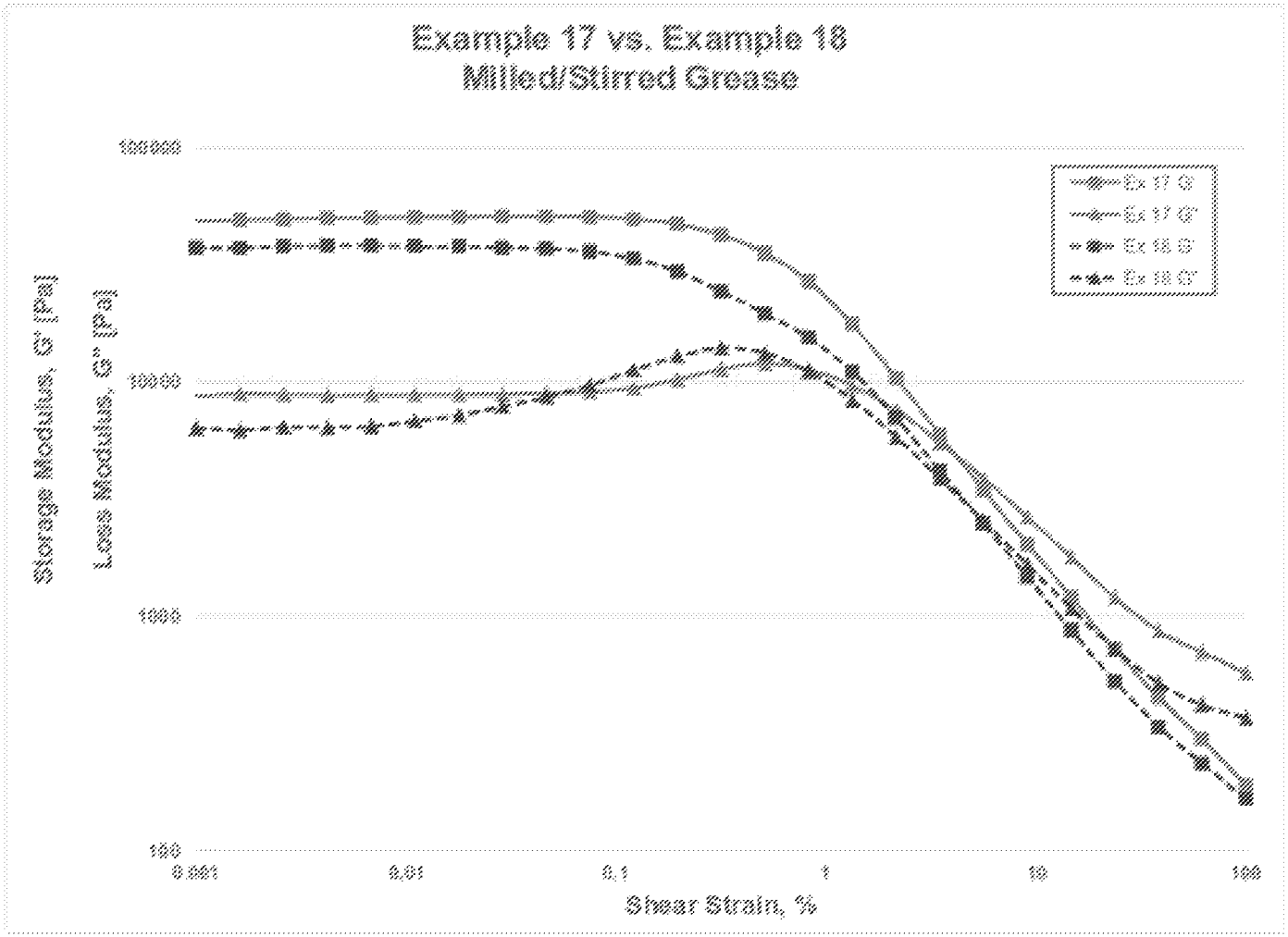
FIG. 6 is a graph showing results of an oscillatory rheometry amplitude sweep at 25 C of the milled Example 17 and 18 greases.

FIG. 6 shows the results of an amplitude sweep of the milled Example 17 and 18 greases. Once again, the effect of the glycerol derivative (HCO) in the Example 18 grease can be seen in several ways. First, the initial values of G' and G" for both milled greases reflect the small difference in their penetration values. Also, the crossover points of the G' and G" curves for both milled greases occur at nearly the same relative shear strain. Finally, the structure building in the base oil portion (G") of the Example 18 grease is much less than what was observed in the unmilled grease.

Example 19—Another calcium sulfonate complex grease was made similar to the previous Example 18 grease. There was only one significant difference: only 25% of the total required HCO was added at pre-conversion. The remaining HCO was added immediately when the conversion process was considered complete.

The grease was made as follows: 545.0 grams of 400 TBN overbased oil-soluble calcium sulfonate were added to an open mixing vessel with 663.1 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by our recently issued U.S. Pat. No. 9,458,406. Mixing without heat began using a planetary mixing paddle. Then 49.34 grams of a primarily C12 alkylbenzene sulfonic acid were added. After mixing for 20 minutes, 92.11 grams of calcium hydroxyapatite with a mean particle size below 5 microns and 7.36 grams of food grade purity calcium hydroxide having a mean particle size below 5 microns were added and allowed to mix in for about 30 minutes. Then 1.66 grams of glacial acetic acid and 21.66 grams of 12-hydroxystearic acid were added and allowed to mix in for 10 minutes. Then 100.75 grams of finely divided calcium carbonate with a mean particle size below 5 microns were added and allowed to mix in for about 5 minutes. Then 5.00 grams of hydrogenated castor oil (HCO) were added and allowed to mix into the batch. Then, 71.47 grams water and 26.59 grams of propylene glycol were added. The heating mantle was applied and the heating process began. During the heating to 190 F, the FTIR behavior was virtually identical to the previous Example 18 batch.

When the batch temperature had reached 190 F, another FTIR spectra was taken. Results showed a dominant peak at 882 $cm^{-1}$ (representing full conversion) and a smaller but resolved peak at 874 cm 1 with a very pronounced shoulder at 862 $cm^{-1}$ (representing the original amorphous calcium carbonate). This FTIR spectra looked essentially identical to the FTIR spectra of the previous Example 18 grease at this point in the manufacturing process. During the next about 2 hours and 40 minutes ten portions of water totaling about 486 grams were added to replace water that was being lost due to evaporation as the grease was being stirred at about 190 F. During that time, four portions was the same paraffinic base oil totaling 188.46 grams were also added as the batch continued to thicken. After 4 hours and 4 minutes at about 190 F; the conversion process was considered complete to the point that no further changes in the FTIR spectra were occurring. The FTIR at this point was similar to the previous Example 18 grease at this same point—a barely resolved doublet.

The remaining amount of required HCO, 15.04 grams, were added and allowed melt and mix into the batch. Then 30.0 grams of water and 15.00 grams of the same calcium hydroxide were added and allowed to mix in for about 10 minutes. Then 55.84 grams of 12-hydroxystearic acid were added and allowed to react. Due to significant thickening. 64.25 grams of the same paraffinic base oil were added and allowed to mix in. Then 3.20 grams of acetic acid were added. After these two complexing acids had reacted, 37.13 grams of a 75% solution of phosphoric acid in water were slowly added and allowed to mix in and react. The mixture was then heated with an electric heating mantle while continuing to stir. When the grease reached 300 F, 5.32 grams of a styrene-alkylene copolymer were added as a crumb-formed solid. The grease was further heated to about 340 F at which time all the polymer was melted and fully dissolved in the grease mixture. The heating mantle was removed and the grease was allowed to cool by continuing to stir in open air. When the grease cooled to 300 F. 60.68 grams of food grade anhydrous calcium sulfate having a mean particle size below 5 microns were added. When the temperature of the grease cooled to about 200 F, 10.14 grams of a mixture of aryl amine and high molecular weight phenolic antioxidants and 9.51 grams of an amine phosphate antioxidant/anti-rust additive were added.

The batch was cooled and remained undisturbed for 16 hours. The next morning it was stirred and heated to about 130 F. Three portions of the same paraffinic base oil totaling 189.03 grams were added and allowed to mix into the batch for about 45 minutes. A portion of the batch was removed without milling and stored in a steel can. The remaining portion of the batch that was still in the mixer was given a single pass through a laboratory-scale colloid mill with the gap set at 0.005 inches. The milled grease was returned to the mixer and mixed at about 130 F for 45 minutes. Then it was stored in a steel can.

About 24 hours later, both cans of grease (unmilled and milled/stirred) were evaluated for penetration and dropping point. The final unmilled grease had an unworked penetration of 243 and a worked 60 stroke penetration of 275. The dropping point was >650 F. The milled and stirred grease had an unworked penetration of 233 and a worked 60 stroke penetration of 259. The dropping point was 646 F. The percent overbased calcium sulfonate in both grease samples was 25.16%.

The FTIR spectra of the final product indicated that only a very small amount of non-hydrolyzed glycerol derivative (HCO) was still present.

Two things are noteworthy concerning this Example 19 grease. First, the FTIR behavior was almost identical to the previous Examples 17 and 18 greases. Second, the conversion time was significantly shortened for this grease compared to the previous Example 18 grease. By comparing the conversion times of the Example 17-19 greases, it appears that the pre-conversion presence of HCO slows the conversion process. When less HCO is added before the conversion process begins (Example 19), conversion occurs in a shorter time. When more HCO is added before the conversion process begins (Example 18), conversion takes longer. However, when the full amount of HCO is added before conversion, the thickener yield is significantly improved compared to adding only 25% of the full amount of HCO before conversion (Example 18 compared to Example 17). Also, when the full amount of HCO was added before conversion (Example 18), a second portion of the non-aqueous converting agent was required. This was not the case when only 25% of the total HCO was added before conversion (Example 19).

A summary of the greases of Examples 17-19 is provided below in Table 11.

TABLE 11

Summary of Examples 17-19

| Example Number | 17 | 17 | 17 | 18 | 18 | 18 | 19 | 19 |
|---|---|---|---|---|---|---|---|---|
| Unmilled or Milled | Unmilled | Milled | Milled and Stirred | Unmilled | Milled | Milled and Stirred | Unmilled | Milled and Stirred |
| Quality of Overbased Ca Sulfonate | Good | Good | Good | Good | Good | Good | Good | Good |
| Overbased Ca Sulfonate, % (wt) | 25.85 | 25.85 | 25.85 | 22.49 | 22.49 | 21.26 | 25.16 | 25.16 |
| Which Glycerol Derivative Used | None | None | None | HCO | HCO | HCO | HCO | HCO |
| Time to convert all amorphous CaCO3 to non-amorphous form, hours | 1.23 | 1.23 | 1.23 | 6.93 | 6.93 | 6.93 | 4.04 | 4.04 |
| Final CaCO3 Conversion Peak, Singlet or Doublet | Doublet | Doublet | Doublet | Doublet | Doublet | Doublet | Doublet | Doublet |
| Thin Spread, Air Cooled Sample Immediately Taken | | | | | | | | |
| Unworked Penetration | 269 | 253 | 261 | 273 | 255 | 291 | N/A | N/A |
| Worked Penetration | 287 | 267 | 281 | 281 | 263 | 299 | N/A | N/A |
| Sample Taken From Can After 24 hours | | | | | | | | |
| Unworked Penetration | 245 | N/A | 267 | 263 | N/A | 279 | 243 | 233 |
| Worked Penetration | 285 | N/A | 279 | 285 | N/A | 291 | 275 | 259 |
| Dropping Point, F. | >650 | N/A | >650 | 621 | N/A | 621 | >650 | 646 |

Example 20—Because the overbased calcium sulfonate used in Example 17 (and 18-19) was old and resulted in a long conversion time and a final doublet FTIR conversion peak pattern that is not consistent with previous testing, a new base line example was made in Example 20. The overbased calcium sulfonate used in Example 20 was a newly manufactured supply of the same commercially available overbased calcium sulfonate, supplied from the same manufacturer, as that used in Examples 17-19.

This grease behaved much differently compared to the previous Example 17 grease. By the time the temperature of the batch had reached 190 F, a very firm grease structure had already formed. The FTIR spectra showed only a single peak at about 882 $cm^{-1}$ with a very slight shoulder near the bottom of this peak. Virtually all of the original amorphous calcium carbonate peak at 862 $cm^{-1}$ was gone. After 44 minutes at 190 F, conversion was complete. The batch was completed in the same way as the previous Example 17 grease.

A portion of the batch was removed without milling and stored in a steel can. The remaining portion of the batch that was still in the mixer was given a single pass through a laboratory-scale colloid mill with the gap set at 0.005 inches. The milled grease was returned to the mixer and mixed at about 130 F for 45 minutes. Then it was stored in a steel can.

About 24 hours later, both cans of grease (unmilled and milled/stirred) were evaluated for penetration and dropping point. The final unmilled grease had an unworked penetration of 275 and a worked 60 stroke penetration of 298. The dropping point was >650 F. The milled and stirred grease had an unworked penetration of 267 and a worked 60 stroke penetration of 289. The dropping point was >650 F. The percent overbased calcium sulfonate in both grease samples was 28.58%.

Although the thickener yield of this Example 20 grease was not as good as the previous Example 17 grease, it was similar to other identical batches of grease made years earlier with samples of the same overbased calcium sulfonate when those samples of the overbased calcium sulfonate were recently manufactured. Similarly, the FTIR behavior during conversion for this Example 20 batch was what had previously been observed when similar grease batches were made with recently manufactured overbased calcium sulfonate. Accordingly, this Example 20 grease was used as the new baseline for comparison. The Example 17-19 greases were no longer used for such comparisons since it was obvious that the very old overbased calcium sulfonate had somehow caused atypical results. The next three examples used the new sample of overbased calcium sulfonate that was used for this Example 20 grease.

Example 21—Another calcium sulfonate complex grease was made that was similar to the previous Example 18 grease. HCO in its full amount was added before the conversion process began. However, about 50% more of the primary non-aqueous converting agent (propylene glycol) was added with the initial water.

The grease was made as follows: 540.07 grams of 400 TBN overbased oil-soluble calcium sulfonate were added to an open mixing vessel with 668.0 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined in U.S. Pat. No. 9,458,406. Mixing without heat began using a planetary mixing paddle. Then 49.27 grams of a primarily C12 alkylbenzene sulfonic acid were added. After mixing for 20 minutes, 91.98 grams of calcium hydroxyapatite with a mean particle size below 5 microns and 7.38 grams of food grade purity calcium hydroxide having a mean particle size below 5 microns were added and allowed to mix in for about 30 minutes. Then 1.94 grams of glacial acetic acid and 21.59 grams of 12-hydroxystearic acid were added and allowed to mix in for 10 minutes. Then 100.04 grams of finely divided calcium carbonate with a mean particle size below 5 microns were added and allowed to mix in for about 5 minutes. Then 20.00 grams of hydrogenated castor oil (HCO) were added and allowed to mix into the batch. Then, 71.35 grams water and 39.95 grams of propylene glycol were added. The heating mantle was applied and the heating process began.

When the batch temperature had reached 190 F, FTIR spectra showed a dominant peak at 882 $cm^{-1}$ (representing full conversion) and a shoulder at 874 $cm^{-1}$ that was about half the height of the dominant peak. Also, there was a low shoulder at 862 $cm^{-1}$ (representing the original amorphous calcium carbonate). After 30 minutes at 190 F, the amorphous shoulder at 862 $cm^{-1}$ was gone. The 874 $cm^{-1}$ shoulder peak had increased in height to nearly the same height as the 882 $cm^{-1}$ peak. Both peaks had merged to the point that they almost looked like one peak. After one hour of mixing at 190 F, the FTIR conversion peak profile did not change. The conversion time was judged to be no more than one hour. During this one hour of mixing at about 190 F, three portions of water totaling 127.8 grams was added to replace water lost due to evaporation. Also, 86.56 grams of the same paraffinic base oil were added due to the increasing heaviness of the grease structure. For about one more hour the batch was stirred while keeping the temperature between 190 F and about 200 F. During this time, two more portions of the same paraffinic base oil totaling 121.3 grams were added as the batch continued to thicken. Also, two portions of water totaling 87.14 grams were added to replace water lost due to evaporation. At the end of this one hour, the FTIR spectra had not changed.

Then 42.88 grams of water and 15.02 grams of the same calcium hydroxide were added and allowed to mix in for about 10 minutes. Then 55.63 grams of 12-hydroxystearic acid and 3.03 grams of acetic acid were added and allowed to react. Due to further thickening, another 91.23 grams of the same paraffinic base oil was added and allowed to mix in. After these two complexing acids had reacted, 37.04 grams of a 75% solution of phosphoric acid in water were slowly added and allowed to mix in and react. The mixture was then heated with an electric heating mantle while continuing to stir. When the grease reached 300 F, 5.01 grams of a styrene-alkylene copolymer were added as a crumb-formed solid. The grease was further heated to about 340 F at which time all the polymer was melted and fully dissolved in the grease mixture. The heating mantle was removed and the grease was allowed to cool by continuing to stir in open air. When the grease cooled to 300 F, 59.96 grams of food grade anhydrous calcium sulfate having a mean particle size below 5 microns were added. When the temperature of the grease cooled to about 200 F, 11.74 grams of a mixture of aryl amine and high molecular weight phenolic antioxidants and 12.15 grams of an amine phosphate antioxidant/anti-rust additive were added. Two portions of the same base oil totaling 93.87 grams were added. Mixing continued until the grease reached a temperature of 150 F. The heating mantle was removed and stirring was stopped. The batch cooled and remained undisturbed for 16 hours.

The next morning, the batch was heated to about 140 F with stirring. A portion of the batch was removed without milling and stored in a steel can. The remaining portion of the batch that was still in the mixer was given a single pass through a laboratory-scale colloid mill with the gap set at 0.005 inches. The milled grease was returned to the mixer and mixed at about 130 F for 45 minutes. Then it was stored in a steel can.

About 24 hours later, both cans of grease (unmilled and milled/stirred) were evaluated for penetration and dropping point. The final unmilled grease had an unworked penetration of 239 and a worked 60 stroke penetration of 275. The dropping point was >650 F. The milled and stirred grease had an unworked penetration of 245 and a worked 60 stroke penetration of 265. The dropping point was >650 F. The percent overbased calcium sulfonate in both grease samples was 25.32%.

The FTIR spectra of the final product indicated that only a very small amount of non-hydrolyzed glycerol derivative (HCO) was still present.

Four things are noteworthy concerning this Example 21 grease when compared to the previous Example 20 baseline grease. First, the thickener yield of this grease was improved. Second the conversion time was only slightly longer. Third, the HCO changed the conversion process as evidenced by the change in the final conversion peak profile. Finally, the penetration values of the unmilled and milled greases were nearly the same. Thus milling was not required to provide optimal dispersion of the thickener system, at least as determined by initial penetration values.

Example 22—Another calcium sulfonate complex grease was made that was similar to the previous Example 21 grease. The only significant difference was that the delayed non-aqueous converting agent addition technique was used. The propylene glycol was not added with the initially added water. Instead, it was added as soon as the batch temperature had reached 190 F.

During the initial heating and conversion, the FTIR behaved somewhat differently than the previous Example 21 grease. About 30 minutes after reaching 190 F, the conversion peak area showed a distinct doublet at about 882 $cm^{-1}$ and 874 $cm^{-1}$ with a significant low shoulder at 862 $cm^{-1}$. After a total of 96 minutes mixing at about 190 F, the shoulder at 862 $cm^{-1}$ was gone. The final FTIR conversion peak profile showed that the 874 $cm^{-1}$ peak had actually become somewhat higher in height than the 882 $cm^{-1}$ peak. Instead of the 874 $cm^{-1}$ peak being a shoulder to the 882 $cm^{-1}$ peak (as was the case in the Example 21 grease), the 882 $cm^{-1}$ peak was a shoulder to the dominant 874 $cm^{-1}$ peak. Both peaks had merged to the point that they almost looked like one peak. Thus the FTIR conversion peak profile of this Example 22 grease was the mirror image of the FTIR conversion peak profile of the Example 21 grease. Additional heating with additional amounts of water added to replace water lost by evaporation did not further change the conversion process. Accordingly the batch was finished in the same way as the previous Example 21.

The next morning, the batch was heated to about 140 F with stirring. A portion of the batch was removed without milling and stored in a steel can. The remaining portion of the batch that was still in the mixer was given a single pass through a laboratory-scale colloid mill with the gap set at 0.005 inches. The milled grease was returned to the mixer and mixed at about 130 F for 45 minutes. Then it was stored in a steel can.

About 24 hours later, both cans of grease (unmilled and milled/stirred) were evaluated for penetration and dropping point. The final unmilled grease had an unworked penetration of 247 and a worked 60 stroke penetration of 269. The dropping point was >650 F. The milled and stirred grease had an unworked penetration of 255 and a worked 60 stroke penetration of 269. The dropping point was >650 F. The percent overbased calcium sulfonate in both grease samples was 22.21%.

The FTIR spectra of the final product indicated that only a very small amount of non-hydrolyzed glycerol derivative (HCO) was still present.

Three things are noteworthy concerning this Example. First, the thickener yield of this grease was much improved over that of the previous Example 21 grease. Second, as was usually observed in previous Examples, the pre-conversion addition of a glycerol derivative (HCO) resulted in more than one final FTIR conversion peak. The conversion peak profile of this grease was the mirror image of the previous Example 21 grease where the delayed non-aqueous converting agent addition technique was not used. Finally, milling had no effect on the worked penetration of the grease. The same improved thickener yield resulted regardless of whether or not the grease was milled.

Figure 7:
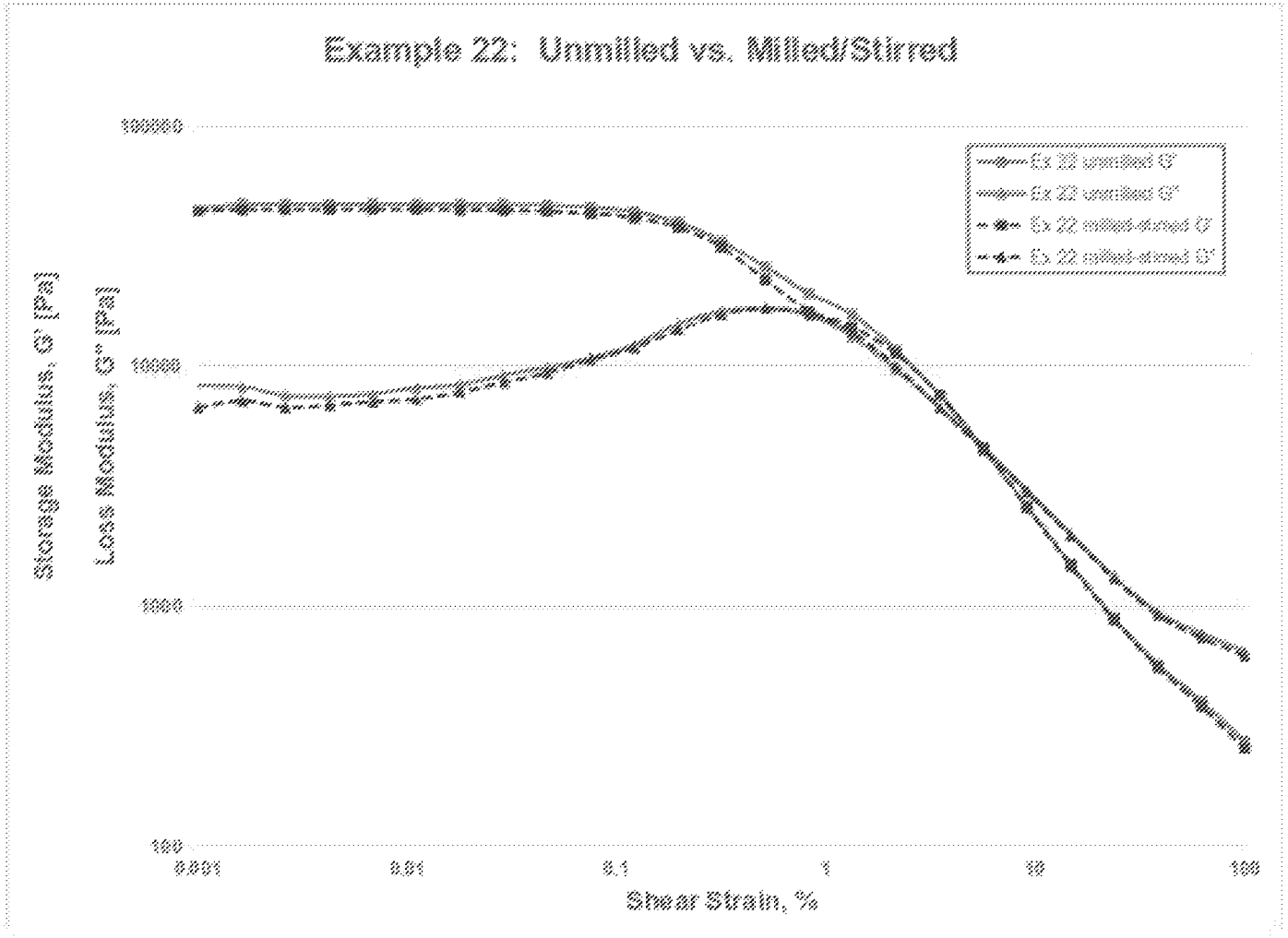
FIG. 7 is a graph showing results of an oscillatory rheometry amplitude sweep at 25 C of the Example 22 unmilled and milled/stirred greases.

FIG. 7 provides the results of an oscillatory rheometry amplitude sweep at 25 C for the unmilled and milled/stirred Example 22 greases. As can be seen, the G' curves for both greases essentially overlay each other. This parallels the identical worked penetrations of the unmilled and milled greases. Perhaps the most interesting aspect of FIG. 7 is that the crossover point of the G' and G" curves for the unmilled grease is actually at a higher relative shear strain than the milled grease. This may indicate that the unmilled Example grease has more structural stability than the corresponding milled grease.

Example 23—Another calcium sulfonate complex grease was made that was similar to the previous Example 22 grease. Like Example 22, this grease was made adding HCO before the conversion process began. This grease also used the converting agent delay method described in U.S. Pat. Nos. 9,976,101 and 9,976,102. However, unlike the previous Example 22 grease, this grease was made also using the facilitating acid delay method as described in U.S. Pat. No. 10,087,388.

The grease was made as follows: 544.46 grams of 400 TBN overbased oil-soluble calcium sulfonate were added to an open mixing vessel with 663.0 grams of a USP purity white paraffinic mineral base oil having a viscosity of about 352 SUS at 100 F. The overbased calcium sulfonate was an NSF HX-1 food-grade approved overbased calcium sulfonate suitable for making NSF H-1 approved food grade greases and was of good quality as defined by our recently issued U.S. Pat. No. 9,458,406. Mixing without heat began using a planetary mixing paddle. Then 50.48 grams of a primarily C12 alkylbenzene sulfonic acid (facilitating acid) were added. The batch was then heated with mixing to 190 F. This represents a temperature adjustment delay after addition of the facilitating acid.

When the temperature reached 190 F, 91.98 grams of calcium hydroxyapatite with a mean particle size below 5 microns and 7.44 grams of food grade purity calcium hydroxide having a mean particle size below 5 microns were added and allowed to mix in for about 30 minutes. These two reactants represented the next reactive ingredients added after the facilitating acid. Then 1.86 grams of glacial acetic acid and 21.64 grams of 12-hydroxystearic acid were added and allowed to mix in for 10 minutes. Then 100.74 grams of finely divided calcium carbonate with a mean particle size below 5 microns were added and allowed to mix in for about 5 minutes. Then 19.99 grams of hydrogenated castor oil (HCO) were added and allowed to mix into the batch. The electric heating mantle was removed from the mixer for 5 minutes to allow the inside wall of the mixer to thermally equilibrate with the grease at about 190 F. Then 71.61 grams water were added. The heating mantle was applied and the batch was mixed for 30 minutes. This represents a non-aqueous converting agent holding delay period. When the 30 minute holding delay was ended, 41.02 grams of propylene glycol were added to the batch. The measurement of the conversion time began at this point, as discussed further below. After 63 minutes, the FTIR conversion peak profile showed a merged wide peak with multiple "humps" corresponding to peaks at 882 $cm^{-1}$. 874 $cm^{-1}$, and 862 $cm^{-1}$. All three humps were of similar height. During this time 42.4 grams water were added to replace water lost due to evaporation. After another 30 minutes the original amorphous peak at 862 $cm^{-1}$ was gone. The FTIR conversion peak profile included a dominant peak at 882 cm 1 with a shoulder at about 874 $cm^{-1}$ that was almost as high. This profile was almost identical to the FTIR conversion peak profile of the previous Example 21 grease. During the next 26 minutes, two portions of water totaling 79.07 grams were added to replace water lost due to evaporation. Also, four portions of the same paraffinic base oil totaling 239.56 grams were added due to the increasing heaviness of the grease. The FTIR conversion profile did not change during these 26 minutes. The conversion time was therefore determined to be no more than 159 minutes (2 hours, 39 minutes).

Then 44.22 grams of water and 14.94 grams of the same calcium hydroxide were added and allowed to mix in for about 10 minutes. Then 55.69 grams of 12-hydroxystearic acid and 3.19 grams of acetic acid were added and allowed to react. Due to further thickening, another two portions of the same paraffinic base oil totaling 74.73 grams were added and allowed to mix in. After these two complexing acids had reacted, 37.94 grams of a 75% solution of phosphoric acid in water were slowly added and allowed to mix in and react. The mixture was then heated with an electric heating mantle while continuing to stir. When the grease reached 300 F, 5.00 grams of a styrene-alkylene copolymer were added as a crumb-formed solid. The grease was further heated to about 340 F at which time all the polymer was melted and fully dissolved in the grease mixture. The heating mantle was removed and the grease was allowed to cool by continuing to stir in open air. When the grease cooled to 300 F, 60.03 grams of food grade anhydrous calcium sulfate having a mean particle size below 5 microns were added. When the temperature of the grease cooled to about 200 F, 10.41 grams of a mixture of aryl amine and high molecular weight phenolic antioxidants and 11.90 grams of an amine phosphate antioxidant/anti-rust additive were added. Five more portions of the same base oil totaling 332.52 grams were added. Mixing continued until the grease reached a temperature of 150 F. The heating mantle was removed and stirring was stopped. The batch cooled and remained undisturbed for 16 hours.

The next morning, the batch was heated to about 140 F with stirring. A portion of the batch was removed without milling and stored in a steel can. The remaining portion of the batch that was still in the mixer was given a single pass through a laboratory-scale colloid mill with the gap set at 0.005 inches. The milled grease was returned to the mixer. A sample of the milled grease was cooled on a steel plate. The unworked penetration was 245; the worked penetration was 257. This sample of grease was returned to the mixer. The total weight of grease in the mixer was 1209.0 grams. Another 35.21 grams of the same paraffinic base oil was added to the mixer and the grease was at about 130 F for 45 minutes. Then it was stored in a steel can.

About 24 hours later, both cans of grease (unmilled and milled/stirred) were evaluated for penetration and dropping point. The final unmilled grease had an unworked penetration of 263 and a worked 60 stroke penetration of 275. The dropping point was >650 F. The percent overbased calcium sulfonate was 22.8%. The milled and stirred grease had an unworked penetration of 253 and a worked 60 stroke penetration of 265. The dropping point was >650 F. The percent overbased calcium sulfonate was 22.2%.

The FTIR spectra of the final product indicated that only a very small amount of non-hydrolyzed glycerol derivative (HCO) was still present.

Figure 8:
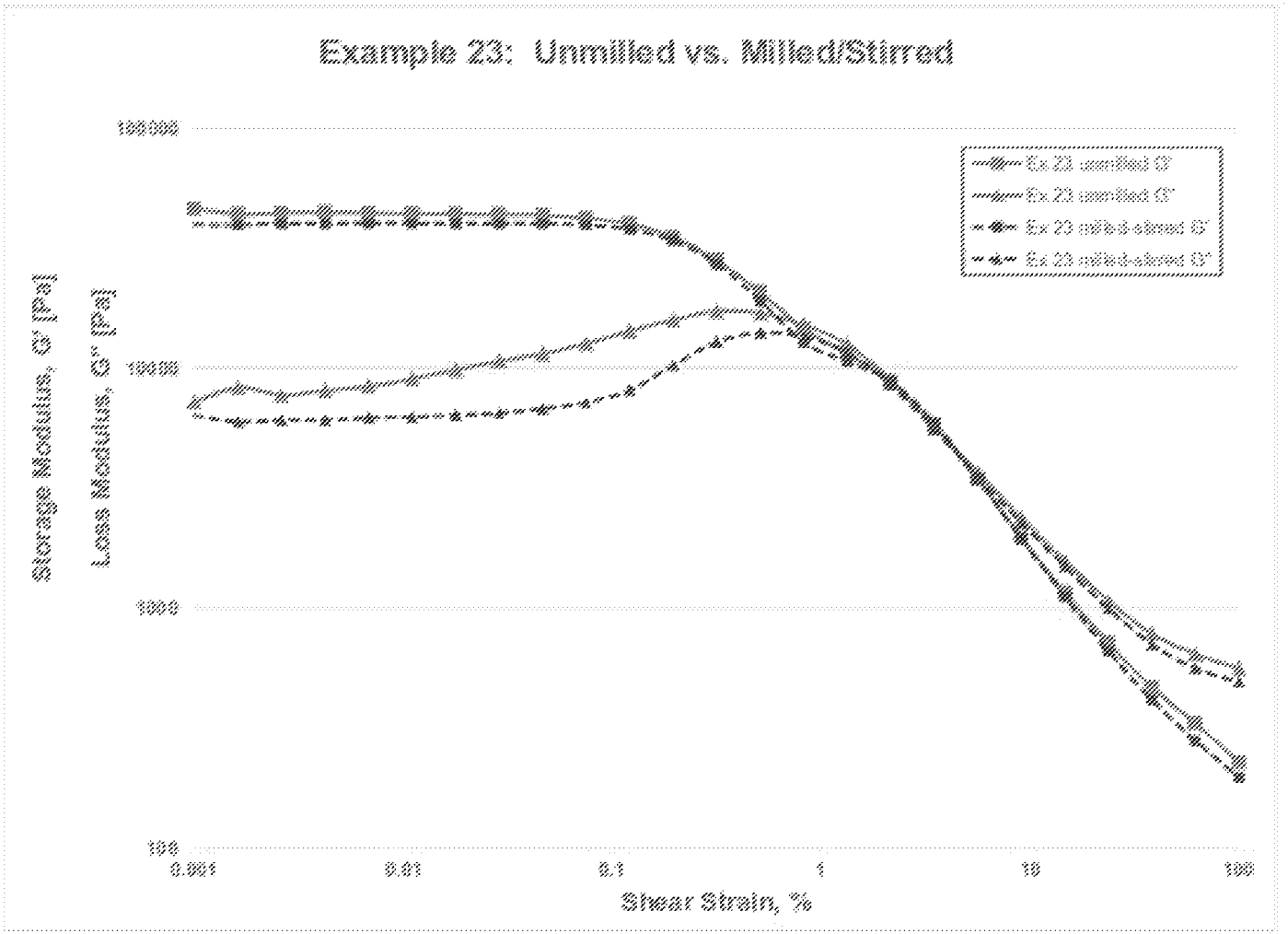
FIG. 8 is a graph showing results of an oscillatory rheometry amplitude sweep at 25 C of the Example 23 unmilled and milled/stirred greases.

FIG. 8 provides the results of an oscillatory rheometry amplitude sweep at 25 C for the unmilled and milled/stirred Example 23 greases. As can be seen, the G' curves for both greases nearly overlay each other. The G" curve of the unmilled grease is actually higher than the milled/stirred grease. This indicates that the structure provided by the base oil component of the unmilled Example 23 grease is actually greater than the corresponding milled/stirred grease. Additionally, the crossover point of the G' and G" curves for the unmilled grease is actually at a higher relative shear strain than the milled grease. This is the same feature that was observed in the unmilled and milled greases of the previous Example 22. This may indicate that the unmilled Example 23 grease has greater structural stability than the milled Example 23 grease.

A summary of the greases of Examples 20-23 with additional test results is provided below in Tables 12-15. Table 12 provides a summary of compositional information, Table 13 a summary of processing methods used, Table 14 a summary of FTIR conversion behavior and data, and Table 15 a summary of penetration values and dropping points of each example prior to milling (unmilled) and after milling, both when the grease was initially made and after a storage period.

TABLE 12

Compositional Summary for Examples 20-23

| | Example Number | | | | |
|---|---|---|---|---|---|
| | 20 | 21 | 22 | 23 (unmilled) | 23 (milled and stirred) |
| Overbased Calcium Sulfonate Quality | Good | Good | Good | Good | Good |
| Overbased Ca Sulfonate, % (wt) | 28.6 | 25.3 | 22.2 | 22.8 | 22.2 |
| Overbased Magnesium Sulfonate Used | None | None | None | None | None |
| Complexing acids added pre-conversion | 12-HSA, Acetic | 12-HSA, Acetic | 12-HSA, Acetic | 12-HSA, Acetic | 12-HSA, Acetic |

TABLE 12-continued

| Compositional Summary for Examples 20-23 | | | | | |
|---|---|---|---|---|---|
| | Example Number | | | | |
| | 20 | 21 | 22 | 23 (unmilled) | 23 (milled and stirred) |
| Complexing acids added post-conversion | 12-HSA, Acetic, Phosphoric | 12-HSA, Acetic, Phosphoric | 12-HSA, Acetic, Phosphoric | 12-HSA, Acetic, Phosphoric | 12-HSA, Acetic, Phosphoric |
| Conventional non-aq. converting agent used | Propylene Glycol | Propylene Glycol | Propylene Glycol | Propylene Glycol | Propylene Glycol |
| Conventional non-aq. converting agent, % (wt) | Not Applicable | Not Applicable | 1.73 | 1.48 | 1.48 |
| Glycerol Derivative Used | None | HCO | HCO | HCO | HCO |
| Total Glycerol Derivative, % (wt) | 0.00 | 0.94 | 0.82 | 0.84 | 0.81 |

TABLE 13

| Processing Methods for Examples 20-23 | | | | | |
|---|---|---|---|---|---|
| | Example Number | | | | |
| | 20 | 21 | 22 | 23 (unmilled) | 23 (milled and stirred) |
| When Glycerol Derivative is Added: Pre-, During, or Post-Conversion | N/A | Pre | Pre | Pre | Pre |
| % (wt) glycerol derivative added initially relative to total glycerol derivative in final grease | N/A | 100 | 100 | 100 | 100 |
| Facilitating Acid Delay Method Used? | No | No | No | Yes | Yes |
| Reactive component present when DDBSA added | Ca Sulfonate | Ca Sulfonate | Ca Sulfonate | Ca Sulfonate | Ca Sulfonate |
| First delayed reactive component added after DDBSA | Not Applicable | Not Applicable | Not Applicable | Calcium Hydroxide | Calcium Hydroxide |
| Facilitating Acid Temp. Adj. delay used? | No | No | No | Yes | Yes |
| Holding delay? | No | No | No | No | No |
| Conventional Non-Aqueous Converting Agent Delay Method Used? | No | No | Yes | Yes | Yes |
| Holding Delay temperature, F. | Not Applicable | Not Applicable | 190-200 F. | 190-200 F. | 190-200 F. |
| Holding Delay time, minutes | Not Applicable | Not Applicable | 30 | 30 | 30 |
| Alkali Metal Hydroxide Addition Method Used? | No | No | No | No | No |
| When was sodium hydroxide added: Pre-, During, or Post-Conversion | Not Applicable | Not Applicable | Not Applicable | Not Applicable | Not Applicable |

TABLE 14

| FTIR Conversion Behavior for Examples 20-23 | | | | | |
|---|---|---|---|---|---|
| | Example Number | | | | |
| | 20 | 21 | 22 | 23 (unmilled) | 23 (milled and stirred) |
| Did partial conversion occur before conventional non-aqueous converting agent added? | Not Applicable | Not Applicable | No | Yes | Yes |
| Conversion-related peak wavenumbers present when 190 F. first reached. | **882**, 874(sh), 862(sh) | **882**, 874(sh), 862(sh) | ND | 862 | 862 |
| First measured time (at 190-200 F.) when 882 peak became dominant, minutes | 0 | 0 | 16 | 223 | 223 |

TABLE 14-continued

| FTIR Conversion Behavior for Examples 20-23 | | | | | |
|---|---|---|---|---|---|
| | Example Number | | | | |
| | 20 | 21 | 22 | 23 (unmilled) | 23 (milled and stirred) |
| Conversion-related peak wave numbers present when conventional non-aq. converting agent added | Not Applicable | Not Applicable | ND | 874, 862 (joined doublet) | 874, 862 (joined doublet) |
| Time (at 190-200 F.) when conventional non-aqueous converting agent added, minutes | Not Applicable | Not Applicable | 0 | 122 | 122 |
| Conversion-related peak wavenumbers present when final extent of conversion was achieved | 882 | **882**, 874(sh) | 882(sh), **874** | **882**, 874(sh) | **882**, 874(sh) |
| Final relative peak height for 882 to 874 peaks, approximate | Not Applicable | 2/1.9 | 1.9/2 | 2/1.9 | 2/1.9 |
| Total Conversion Time (after adding primary non-aqueous converting agent) | 44 min | 60 min | 1 hr, 36 min | 2 hr, 39 min | 2 hr, 39 min |

The bolded conversion-related peak wave numbers represent the dominant peak.
"sh" means there was a shoulder present at the indicated wave numbers.

TABLE 15

| Testing Data for Examples 20-23 | | | | | |
|---|---|---|---|---|---|
| | Example Number | | | | |
| | 20 | 21 | 22 | 23 (unmilled) | 23 (milled and stirred) |
| Overbased Ca Sulfonate, % (wt) (Thickener yield) | 28.6 | 25.3 | 22.2 | 22.8 | 22.2 |
| (Unmilled) Initial Unworked Penetration | 275 | 239 | 247 | 263 | ND |
| (Unmilled) Initial Worked 60 Stroke Penetration | 297 | 275 | 269 | 275 | ND |
| (Unmilled) Initial Dropping Point, F. | >650 | >650 | >650 | >650 | ND |
| (Unmilled) Storage Period, months | 4 | 3 | 4 | 5 | Not Applicable |
| (Unmilled) Storage Unworked Penetration | 275 | 235 | 255 | 247 | ND |
| (Unmilled) Storage Worked 60 Stroke Penetration | 291 | 257 | 269 | 253 | ND |
| (Unmilled) Storage Dropping Point, F. | >650 | >650 | >650 | >650 | ND |
| (Milled & Stirred) Initial Unworked Penetration | 267 | 245 | 255 | ND | 253 |
| (Milled & Stirred) Initial Worked 60 Stroke Penetration | 289 | 265 | 269 | ND | 265 |
| (Milled & Stirred) Initial Dropping Point, F. | >650 | >650 | >650 | ND | >650 |
| (Milled & Stirred) Storage Period, months | 4 | 4 | 4 | Not Applicable | 5 |
| (Milled & Stirred) Storage Unworked Penetration | 275 | 215 | 267 | ND | 265 |
| (Milled & Stirred) Storage Worked 60 Stroke Penetration | 289 | 239 | 279 | ND | 279 |
| (Milled & Stirred) Storage Dropping Point, F. | >650 | >650 | ND | ND | >650 |

For purposes of consistency in comparison, conversion times indicated in the Examples were measured from the time the batch reached 190 F during the initial heating step, even though in some cases conversion may have started before reaching that temperature or may have stalled (or appeared to stall) based on FTIR data even after reaching that temperature. For example, in the examples where the water and conventional non-aqueous converting agent were added together at room temperature, some conversion would occur before reaching 190 F, but the conversion time clock was not started until reaching 190 F. Additionally, in the examples where a conventional non-aqueous converting agent was not added initially at 190 F, but instead was only added at 190 F after the conversion process (as determined by FTIR) had stalled (or appeared to stall), the conversion time clock began as soon as the batch reached 190 F during the initial heating step, even though there was a delay in the conversion process until the conventional non-aqueous converting agent was added.

Converted Calcium Carbonate Crystal Morphology

Another interesting aspect of the previous example greases concerns the crystalline morphology of the converted calcium carbonate. Calcium carbonate can potentially exist in three known morphologies: calcite, vaterite, and aragonite. Of these three, only calcite is stable. The other two are very unstable relative to calcite.

Several recent published research papers have described calcium sulfonate based greases that have FTIR conversion peaks within the previously described intermediate range of about 872 $cm^{-1}$ to 877 $cm^{-1}$. These research papers have claimed that such intermediate peaks indicate that the converted calcium carbonate (originally present as amorphous calcium carbonate in the overbased calcium sulfonate) is vaterite and not calcite. Where the FTIR spectra shows a peak at about 882 $cm^{-1}$ and another peak (or shoulder) at the intermediate range, these research papers claim that both calcite and vaterite are present. In all such research papers, this conclusion is based entirely and exclusively on the basis of the location of the FTIR peaks. However, such reasoning is extremely faulty, as anyone with good knowledge of crystallography will understand.

When a material (such as calcium carbonate) can exist in more than one crystalline morphology, FTIR will not provide a reliable method to determine which morphology is present. This is because the location of the characteristic FTIR peaks can significantly shift depending on the chemical environment around which the dispersed crystals exist. The particle size of the dispersed crystals can also affect the location of their characteristic FTIR spectral peaks. This can result in the possible range of the characteristic FTIR peak wavenumbers of the different crystalline morphologies overlapping with respect to each other. The one reliable method for determining crystalline morphology is X-Ray Diffraction (XRD). XRD results are not affected by the chemical environment of the crystals or their size (as long as the crystal size is large enough to diffract X-rays). The X-Ray diffraction pattern of a given inorganic crystalline material is a fingerprint that will always provide the correct identity of the morphology or morphologies present.

These previous research papers did not report any XRD results on their calcium sulfonate-based greases. They do not even mention XRD. They only used FTIR spectra. In contrast, example greases in this application have been evaluated by XRD. In all such evaluated cases, only calcite was detected. No vaterite or aragonite were detected. Even in greases with extremely unusual and atypical FTIR spectra, such as the grease of Example 12, only calcite was detected by XRD.

Without such XRD data, some might be tempted to look at the FTIR conversion peak behavior and theorize that the presence of overbased magnesium sulfonate and/or glycerol derivative causes the conversion process to generate vaterite which only partially changes to calcite in the final grease. Additionally, they might theorize that the transitory intermediate peak formed during the conversion of calcium sulfonate-based greases (without overbased magnesium sulfonate or glycerol derivative) is caused by vaterite or aragonite. However, the XRD evaluation of example greases of this application rule out any such theories. Instead, the appearance of an intermediate FTIR peak during the conversion process and (sometimes) in the final grease must be due to calcite that is either of a different particle size range, or is surrounded differently, or both. This conclusion applies to at least the greases within the span of the compositions and processes described within this application.

Although the examples provided herein fall primarily in the NLGI No. 1, No. 2, or No. 3 grade, with No. 2 grade being the most preferred, it should be further understood that the scope of this present invention includes all NLGI consistency grades harder and softer than a No. 2 grade. However, for such greases according to the present invention that are not NLGI No. 2 grade, their properties should be consistent with what would have been obtained if more or less base oil had been used so as to provide a No. 2 grade product, as will be understood by those of ordinary skill in the art.

While this invention deals primarily with greases made in open vessels, and the examples are all in open vessels, the complex calcium magnesium sulfonate grease compositions and methods may also be used in closed vessels where heating under pressure is accomplished. The use of such pressurized vessels may result in even better thickener yields than those described in the examples herein. For the purposes of this invention an open vessel is any vessel with or without a top cover or hatch as long as any such top cover or hatch is not vapor-tight so that significant pressure cannot be generated during heating. Using such an open vessel with the top cover or hatch closed during the conversion process will help to retain the necessary level of water as a converting agent while generally allowing a conversion temperature at or even above the boiling point of water. Such higher conversion temperatures can result in further thickener yield improvements for both simple and complex calcium sulfonate greases, as will be understood by those with ordinary skill in the art.

As used herein: (1) quantities of dispersed calcium carbonate (or amorphous calcium carbonate) or residual calcium oxide or calcium hydroxide contained in the overbased calcium sulfonate are by weight of the overbased calcium sulfonate; (2) some ingredients are added in two or more separate portions and each portion may be described as a percentage of the total amount for that ingredient or a percentage of final grease by weight; and (3) all other amounts (including total amounts) of ingredients identified by percentages or parts are the amounts added as an ingredient by weight of the final grease product, even though the particular ingredient (such as water, or calcium-containing bases or alkali metal hydroxides that react with other ingredients) may not be present in the final grease or may not be present in the final grease in the quantity identified for addition as an ingredient. As used herein "added calcium carbonate" means crystalline calcium carbonate that is added as a separate ingredient in addition to the amount of dispersed calcium carbonate contained in the overbased calcium sulfonate. As used herein "added calcium hydroxide" and "added calcium oxide" means calcium hydroxide and calcium oxide, respectively, that are added as a separate ingredient in addition to the amount of residual calcium hydroxide and/or calcium oxide that may be contained in the overbased calcium sulfonate. As used herein "added calcium containing bases" refers to calcium containing bases (such as added calcium carbonate and added calcium hydroxide) that are added as separate ingredient(s).

As used herein to describe the invention (as opposed to how the term is used in some prior art references), calcium hydroxyapatite means (1) the compound having the formula $Ca_5(PO_4)_3OH$ or (2) a mathematically equivalent formula (a) having a melting point of around 1100 C or (b) specifically excluding mixtures of tricalcium phosphate and calcium hydroxide by such equivalent formula. As used herein and in the '406 patent, "poor" quality overbased calcium sulfonate refers to any commercially available or manufactured overbased calcium sulfonate that results in an overbased calcium sulfonate grease having a dropping point less than 575 F when the overbased calcium sulfonate grease is made using added calcium carbonate as the sole added calcium containing base for reacting with complexing acids as described in the '265 patent and similarly a "good" quality overbased calcium sulfonate is one that results in a dropping point of 575 F or higher when made using added calcium carbonate as described in the '265 patent.

As used herein, the term "thickener yield" as it applies to the subject invention shall be the conventional meaning, namely, the concentration of the highly overbased oil-soluble calcium sulfonate required to provide a grease with a specific desired consistency as measured by the standard penetration tests ASTM D217 or D1403 commonly used in lubricating grease manufacturing. As used herein, "penetration value" refers to a 60 stroke worked penetration value, unless an unworked penetration value is specifically described. In like manner, as used herein the "dropping point" of a grease shall refer to the value obtained by using the standard dropping point test ASTM D2265 as commonly used in lubricating grease manufacturing. Four Ball EP tests as described herein shall refer to ASTM D2596. Four Ball Wear tests as described herein shall refer to ASTM D2266. Cone Oil Separation tests as described herein shall refer to ASTM D6184. Roll Stability tests as described herein shall refer to ASTM D1831. As used herein, "non-aqueous converting agent" means any conventional converting agent other than water and includes such conventional converting agents that may contain some water as a diluent or an impurity. Overbased magnesium sulfonate may be considered a non-conventional non-aqueous converting agent, but references herein to "non-aqueous converting agent," refer to "conventional" non-aqueous converting agents, which do not include overbased magnesium sulfonate. All amounts for ingredients or ratios of ingredients indicated herein as a range include each individual amount or ratio within those ranges and any and all subset combinations within ranges, including subsets that overlap from one preferred range to a more preferred range. Those of ordinary skill in the art will appreciate upon reading this specification, including the examples contained herein, that modifications and alterations to the composition and methodology for making the composition may be made within the scope of the invention and it is intended that the scope of the invention disclosed herein be limited only by the broadest interpretation of the appended claims to which the inventor is legally entitled.

We claim:

1. A method for making a complex sulfonate-based grease comprising the steps of:

adding and mixing (1) 33% or less overbased calcium sulfonate having amorphous calcium carbonate dispersed therein and (2) water;

adding and mixing 0.1 to 5% of one or more conventional non-aqueous converting agents after a converting agent delay period comprising (1) a converting agent holding delay period wherein a mixture comprising the overbased calcium sulfonate and the water is maintained at a temperature or within a range of temperatures for a period of time of at least 20 minutes or (2) a converting agent temperature adjustment delay period where the mixture comprising the overbased calcium sulfonate and the water is heated or (3) a combination thereof;

converting a mixture comprising the overbased calcium sulfonate, the water, and the one or more conventional non-aqueous converting agents by heating until conversion of the amorphous calcium carbonate contained in the overbased calcium sulfonate to a crystalline form has occurred;

adding and mixing 1.25 to 18% total of one or more complexing acids prior to the converting step, during the converting step, or after the converting step;

adding and mixing 1 to 20% total of one or more calcium containing bases prior to the converting step, during the converting step, or after the converting step; and adding and mixing 0.1 to 6% of a glycerol derivative after the converting step, wherein the addition of the glycerol derivative forms an acid reaction product from hydrolyzing the glycerol derivative, wherein no glycerol derivative is added prior to the converting step, and wherein the glycerol derivative comprises (1) glycerol mono-oleate, (2) hydrogenated castor oil, (3) glycerol mono-stearate, (4) glycerol mono-tallowate, or (5) a combination thereof;

adding and mixing an alkali metal hydroxide after the converting step, wherein no alkali metal hydroxide is added prior to the converting step;

heating to a temperature sufficient to remove the water;

wherein the percentages are by weight.

2. The method of claim 1 further comprising adding and mixing a facilitating acid prior to the converting step;

wherein the one or more complexing acids comprise 12-hydroxystearic acid, acetic acid, and phosphoric acid;

wherein the one or more calcium containing bases comprise calcium hydroxyapatite, added calcium carbonate, added calcium hydroxide, or a combination thereof; and wherein the one or more conventional non-aqueous converting agents comprise an alcohol, ether, glycol, glycol ether, glycol polyether, or combinations thereof.

3. The method of claim 2 wherein the adding and mixing the glycerol derivative step is after the adding and mixing the alkali metal hydroxide step.

4. The method of claim 3 wherein none of the one or more complexing acids are added between completion of the converting step and the adding and mixing the glycerol derivative step.

5. The method of claim 4 wherein the one or more complexing acids further comprise boric acid.

6. The method of claim 5 wherein a first portion of the 12-hydroxystearic acid and a first portion of the acetic acid are added prior to or during the converting step; and wherein a second portion of the 12-hydroxystearic, a second portion of the acetic acid, all of the phosphoric acid, and all of the boric acid are added after the adding and mixing the glycerol derivative step.

7. The method of claim 6 wherein the calcium hydroxyapatite, a first portion of the added calcium carbonate, and a first portion of the added calcium hydroxide are added prior to the converting step;

wherein a second portion of the added calcium carbonate and a second portion of the added calcium hydroxide are added after the converting step; and wherein the glycerol derivative comprises hydrogenated castor oil.

8. The method of claim 7 wherein no overbased magnesium sulfonate is added.

9. A method for making a complex sulfonate-based grease comprising the steps of:

adding and mixing (1) 33% or less overbased calcium sulfonate having amorphous calcium carbonate dispersed therein and (2) water;

adding and mixing 0.1 to 5% of one or more conventional non-aqueous converting agents after a converting agent delay period, wherein the one or more conventional non-aqueous converting agents comprise an alcohol, ether, glycol, glycol ether, glycol polyether, or combinations thereof and wherein the converting agent delay period comprises (1) a converting agent holding delay period wherein a mixture comprising the overbased calcium sulfonate and the water is maintained at a temperature or within a range of temperatures for a period of time of at least 20 minutes or (2) a converting agent temperature adjustment delay period where the mixture comprising the overbased calcium sulfonate and the water is heated or (3) a combination thereof;

converting a mixture comprising the overbased calcium sulfonate, the water, and the one or more conventional non-aqueous converting agents by heating until conversion of the amorphous calcium carbonate contained in the overbased calcium sulfonate to a crystalline form has occurred;

adding and mixing 1.25 to 18% total of one or more complexing acids, wherein the one or more complexing acids comprise 12-hydroxystearic acid, acetic acid, phosphoric acid, and boric acid;

adding and mixing 1 to 20% total of one or more calcium containing bases prior to the converting step, during the converting step, or after the converting step, wherein the one or more calcium containing bases comprise calcium hydroxyapatite, added calcium carbonate, added calcium hydroxide, or a combination thereof;

adding and mixing an alkali metal hydroxide after the converting step, wherein no alkali metal hydroxide is added prior to the converting step;

adding and mixing 0.1 to 1.0% of a glycerol derivative after the adding and mixing the alkali metal hydroxide step, wherein the addition of the glycerol derivative forms an acid reaction product from hydrolyzing the glycerol derivative, wherein no glycerol derivative is added prior to the converting step, and wherein the glycerol derivative comprises hydrogenated castor oil;

adding and mixing a facilitating acid prior to the converting step; and heating to a temperature sufficient to remove the water;

wherein a first portion of the 12-hydroxystearic acid and a first portion of the acetic acid are added prior to or during the converting step; and wherein a second portion of the 12-hydroxystearic, a second portion of the acetic acid, all of the phosphoric acid, and all of the boric acid are added after the adding and mixing the glycerol derivative step;

wherein none of the one or more complexing acids are added between completion of the converting step and the adding and mixing the glycerol derivative step;

wherein the calcium hydroxyapatite, a first portion of the added calcium carbonate, and a first portion of the added calcium hydroxide are added prior to the converting step;

wherein a second portion of the added calcium carbonate and a second portion of the added calcium hydroxide are added after the converting step;

wherein no overbased magnesium sulfonate is added; and wherein the percentages are by weight.

10. The method of claim 9 wherein the overbased calcium sulfonate is a good quality overbased calcium sulfonate.

11. The method of claim 9 wherein the overbased calcium sulfonate is a poor quality overbased calcium sulfonate.

12. The method of claim 9 wherein the one or more conventional non-aqueous converting agents comprises hexylene glycol or propylene glycol or both.

13. The method of claim 9 wherein the overbased calcium sulfonate is a good quality overbased calcium sulfonate and wherein the one or more conventional non-aqueous converting agents comprises hexylene glycol.

14. The method of claim 9 wherein the overbased calcium sulfonate is a poor quality overbased calcium sulfonate and wherein the one or more conventional non-aqueous converting agents comprises hexylene glycol.

15. The method of claim 1 wherein the complex sulfonate-based grease has a dropping point of 575 F or higher.

16. The method of claim 1 wherein the complex sulfonate-based grease has a dropping point of 600 F or higher.

17. The method of claim 1 wherein the complex sulfonate-based grease has a dropping point of 650 F or higher.

18. The method of claim 1 wherein the glycerol derivative comprises the glycerol mono-stearate.

19. The method of claim 18 wherein the overbased calcium sulfonate is a poor quality overbased calcium sulfonate.

20. The method of claim 1 wherein the glycerol derivative comprises the hydrogenated castor oil and wherein the one or more complexing acids comprises 12-hydroxystearic acid.

21. The method of claim 20 wherein the overbased calcium sulfonate is a poor quality overbased calcium sulfonate.

22. The method of claim 1 wherein the overbased calcium sulfonate is a poor quality overbased calcium sulfonate.

23. The method of claim 1 wherein there is no milling step.

24. The method of claim 1 wherein the complex sulfonate-based grease has a first storage modulus curve G' that has a first cross over point with a first loss modulus curve G" in an unmilled state and a second storage modulus curve G' that has a second cross over point with a second loss modulus curve G" in an milled state; and wherein the first and second cross over points are substantially the same with respect to relative shear strain.

25. A method for making a complex sulfonate-based grease comprising the steps of:

adding and mixing (1) 33% or less overbased calcium sulfonate having amorphous calcium carbonate dispersed therein and a Total Bae Number of 400 or higher, and (2) water;

adding and mixing 0.1 to 5% of one or more conventional non-aqueous converting agents after a converting agent delay period comprising (1) a converting agent holding delay period wherein a mixture comprising the overbased calcium sulfonate and the water is maintained at a temperature or within a range of temperatures for a period of time of at least 20 minutes or (2) a converting agent temperature adjustment delay period where the mixture comprising the overbased calcium sulfonate and the water is heated or (3) a combination thereof;

converting a mixture comprising the overbased calcium sulfonate, the water, and the one or more conventional non-aqueous converting agents by heating until conversion of the amorphous calcium carbonate contained in the overbased calcium sulfonate to a crystalline form has occurred;

adding and mixing 1.25 to 18% total of one or more complexing acids comprising 12-hystoxystearic acid prior to the converting step, during the converting step, or after the converting step;

adding and mixing 1 to 20% total of one or more calcium containing bases prior to the converting step, during the converting step, or after the converting step;

heating to a temperature sufficient to remove the water; and adding and mixing 0.1 to 1.0% of a glycerol derivative prior to the heating to a temperature sufficient to remove the water step, wherein the addition of the glycerol derivative forms an acid reaction product from hydrolyzing the glycerol derivative with the water, and wherein the glycerol derivative comprises hydrogenated castor oil; and wherein the percentages are by weight.

26. The method of claim 25 further comprising:

adding and mixing a facilitating acid prior to the converting step;

wherein the one or more complexing acids further comprise acetic acid, phosphoric acid, and boric acid; and wherein 25% or less overbased calcium sulfonate is added and mixed.

27. The method of claim 26 wherein a first portion of the 12-hydroxystearic acid and a first portion of the acetic acid are added prior to or during the converting step;

wherein a second portion of the 12-hydroxystearic, a second portion of the acetic acid, all of the phosphoric acid, and all of the boric acid are added after the adding and mixing the glycerol derivative step; and wherein 20% or less overbased calcium sulfonate is added and mixed.

28. The method of claim 27 wherein the calcium hydroxyapatite, a first portion of the added calcium carbonate, and a first portion of the added calcium hydroxide are added prior to the converting step;

wherein a second portion of the added calcium carbonate and a second portion of the added calcium hydroxide are added after the converting step; and wherein around 16-21% overbased calcium sulfonate is added and mixed.

29. The method of claim 28 wherein no facilitating acid delay is used.

30. The method of claim 29 wherein no overbased magnesium sulfonate is added.

31. The method of claim 30 further comprising adding and mixing an alkali metal hydroxide after the converting step, wherein no alkali metal hydroxide is added prior to the converting step; and wherein no glycerol derivative is added prior to the converting step.

32. The method of claim 31 wherein the one or more conventional non-aqueous converting agents comprises hexylene glycol.

33. The method of claim 1 wherein 0.1 to 1% of the glycerol derivative is added and mixed.

34. The method of claim 33 wherein 15-22% overbased calcium sulfonate having amorphous calcium carbonate dispersed therein is added and mixed.

35. The method of claim 33 wherein the overbased calcium sulfonate has a Total Base Number of 400 or higher.

36. The method of claim 8 wherein 0.7 to 1.0% of the glycerol derivative is added and mixed.

37. The method of claim 36 wherein 15-22% overbased calcium sulfonate having amorphous calcium carbonate dispersed therein is added and mixed.

38. The method of claim 36 wherein the overbased calcium sulfonate is a poor quality overbased calcium sulfonate.

39. The method of claim 38 wherein the complex sulfonate-based grease has a first storage modulus curve G' that has a first cross over point with a first loss modulus curve G" in an unmilled state and a second storage modulus curve G' that has a second cross over point with a second loss modulus curve G" in an milled state; and wherein the first and second cross over points are substantially the same with respect to relative shear strain.

40. The method of claim 39 wherein there is no milling step.

41. The method of claim 36 wherein the overbased calcium sulfonate is a good quality overbased calcium sulfonate.

42. The method of claim 41 wherein the complex sulfonate-based grease has a first storage modulus curve G' that has a first cross over point with a first loss modulus curve G" in an unmilled state and a second storage modulus curve G' that has a second cross over point with a second loss modulus curve G" in an milled state; and wherein the first and second cross over points are substantially the same with respect to relative shear strain.

43. The method of claim 42 wherein there is no milling step.

* * * * *